US005512103A

United States Patent [19]

Edwards et al.

[11] Patent Number: 5,512,103

[45] Date of Patent: Apr. 30, 1996

[54] SILVER HALIDE COLOR PHOTOGRAPHY ELEMENT WITH IMPROVED HIGH DENSITY CONTRAST AND BRIGHT LOW DENSITY COLORS

[75] Inventors: James L. Edwards, Rochester; Eric L. Bell, Webster; Benjamin T. Chen, Penfield; Richard L. Parton, Webster, all of N.Y.

[73] Assignee: Eastman Kodak Company, Rochester, N.Y.

[21] Appl. No.: 374,054

[22] Filed: Jan. 19, 1995

Related U.S. Application Data

[63] Continuation-in-part of Ser. No. 199,035, Feb. 18, 1994, Pat. No. 5,418,118.

[51] Int. Cl.[6] ..... G03C 7/30

[52] U.S. Cl. ..... 430/383; 430/384; 430/385; 430/386; 430/387; 430/388; 430/389; 430/505; 430/506; 430/535

[58] Field of Search ..... 430/506, 502, 430/503, 543, 554, 535, 557, 558, 464, 383, 384, 385, 386, 387, 388, 389, 505, 588

[56] References Cited

U.S. PATENT DOCUMENTS

| | | | |
|---|---|---|---|
| H1,167 | 4/1993 | Uezawa et al. | 430/506 |
| Re. 32,097 | 3/1986 | Silverman et al. | 430/217 |
| 2,318,597 | 5/1943 | Davey et al. | 430/571 |
| 3,628,960 | 12/1971 | Martael et al. | 430/571 |
| 3,790,386 | 2/1974 | Posse et al. | 430/642 |
| 3,843,369 | 10/1974 | Kumai et al. | 430/506 |
| 3,849,138 | 11/1974 | Wyckoff | 430/506 |
| 3,941,595 | 3/1976 | Ranz et al. | 430/494 |
| 3,989,527 | 11/1976 | Locker | 430/567 |
| 4,373,022 | 2/1983 | Hoffman et al. | 430/434 |
| 4,444,865 | 4/1984 | Silverman et al. | 430/217 |
| 4,446,228 | 5/1984 | Honda et al. | 430/567 |
| 4,481,288 | 11/1984 | Yamada et al. | 430/506 |
| 4,497,895 | 2/1985 | Matsuzaka et al. | 430/569 |
| 4,506,008 | 3/1985 | Sugimoto et al. | 430/502 |
| 4,521,507 | 6/1985 | Iijima et al. | 430/503 |
| 4,554,245 | 11/1985 | Hayashi et al. | 430/567 |
| 4,564,588 | 1/1986 | Sakamoto et al. | 430/509 |
| 4,575,578 | 3/1986 | Bogan et al. | 174/35 |
| 4,643,965 | 2/1987 | Kubota et al. | 430/567 |
| 4,659,646 | 4/1987 | Inoue | 430/230 |
| 4,677,052 | 6/1987 | Inoue | 430/568 |
| 4,680,253 | 7/1987 | Shibahara et al. | 430/504 |
| 4,727,016 | 2/1988 | Bando | 430/567 |
| 4,745,047 | 5/1988 | Asami et al. | 430/376 |
| 4,746,593 | 5/1988 | Kitchin et al. | 430/264 |
| 4,749,644 | 6/1988 | Toeaka et al. | 430/544 |
| 4,786,587 | 11/1988 | Kuwahara | 430/566 |
| 4,792,518 | 12/1988 | Kuwashima et al. | 430/505 |
| 4,806,460 | 2/1989 | Ogawa et al. | 430/504 |
| 4,812,390 | 3/1989 | Giannesi | 430/434 |
| 4,830,956 | 5/1989 | Waki | 430/558 |
| 4,902,609 | 2/1990 | Hahm | 430/504 |
| 4,939,078 | 7/1990 | Kuramoto et al. | 430/505 |
| 4,945,036 | 7/1990 | Arai et al. | 430/567 |
| 4,957,849 | 9/1990 | Inoue et al. | 430/264 |
| 5,039,601 | 8/1991 | Ohya et al. | 430/569 |
| 5,084,374 | 1/1992 | Waki et al. | 430/504 |
| 5,206,132 | 4/1993 | Mitsuhashi | 430/567 |
| 5,213,942 | 5/1993 | Deguchi et al. | 430/218 |
| 5,300,381 | 4/1994 | Buhr et al. | 430/30 |
| 5,314,794 | 5/1994 | Sutton | 430/506 |
| 5,360,703 | 11/1994 | Chang et al. | 430/506 |
| 5,418,118 | 5/1995 | Edwards et al. | 430/506 |

FOREIGN PATENT DOCUMENTS

| | | |
|---|---|---|
| 0126644 | 11/1984 | European Pat. Off. . |
| 248442A | 12/1987 | European Pat. Off. . |
| 0308872A2 | 3/1989 | European Pat. Off. . |
| 0409019 | 1/1991 | European Pat. Off. . |
| 0533033A1 | 3/1993 | European Pat. Off. . |
| 0544319 | 6/1993 | European Pat. Off. . |
| 60-225142 | 10/1985 | Japan . |
| 61-121052 | 6/1986 | Japan . |
| 62-44731 | 2/1987 | Japan . |
| 1-167743 | 7/1989 | Japan . |
| 4-68338 | 3/1992 | Japan . |
| 635849 | 4/1950 | United Kingdom . |

OTHER PUBLICATIONS

Derwent Publications (Japanese Abstract) 63–202739, Dec. 22, 1988.

*Primary Examiner*—Janet C. Baxter
*Attorney, Agent, or Firm*—Paul A. Leipold

[57] ABSTRACT

The invention provides a cyan color producing silver halide emulsion layer or a magenta color producing silver halide emulsion layer wherein said at least one layer has an exposure range of at least 0.6 log E from the point where the instantaneous contrast is 1.0 and wherein the instantaneous contrast of said layer increases as a function of increasing exposure over at least 70 percent of said exposure range.

34 Claims, 8 Drawing Sheets

SILVER HALIDE COLOR PHOTOGRAPHY ELEMENT WITH IMPROVED HIGH DENSITY CONTRAST AND BRIGHT LOW DENSITY COLORS

CROSS-REFERENCE TO RELATED APPLICATIONS

This is a Continuation-in-Part of application serial No. 199,035, filed Feb. 18, 1994, now U.S. Pat. No. 5,418,118, entitled SILVER HALIDE COLOR PHOTOGRAPHIC ELEMENT WITH IMPROVED HIGH DENSITY CONTRAST AND BRIGHT LOW DENSITY COLORS by James L. Edwards et al.

FIELD OF THE INVENTION

The present invention relates to the field of silver halide color photographic element materials. In particular, to a color negative silver halide color print material which exhibits superior tone reproduction and shadow detail.

BACKGROUND OF THE INVENTION

Tone and color reproduction have been studied in detail and more thorough discussions of the consequences of each can be found in numerous references such as "*The Theory of the Photographic Process 4th Ed.*", Chapter 19, edited by T. H. James and published by Macmillan Publishing Co., Inc. of New York, or "*The Reproduction of Colour 4th Ed.*", Chapter 13, by R. W. G. Hunt and published by Fountain Press, Tolworth, England.

The problems found in designing color papers with preferred color and tone reproduction have not gone unnoticed by the photographic industry. Indeed, there are numerous choices of color negative films and color negative papers presently available to match any variety of photographic needs. To date however, no combination of color negative film and paper has succeeded in producing a clearly preferred tone and color reproduction combination.

Generally, in the design of color negative printing papers, it is necessary to consider the range of exposure and contrast in the previously exposed color negative film. Since the purpose of the color negative paper is to receive color and tonal information previously recorded in the negative, the paper must be designed so that the resulting color print is pleasing to the eye both in color, contrast and tonal range.

Additionally, it is highly desirable that color negative printing papers have speed (sensitivity) and contrast characteristics that are invariant to exposure time. This feature permits their usage in a wide variety of applications, including high speed printers, easel printing and other electronic printing devices. Exposing devices for color papers may include light sources consisting of tungsten lamps, halogen lamps, lasers, light emitting photodiodes (LED's) or other light sources. To accommodate this variety of exposing devices, the emulsions used in the color negative papers are capable of recording the exposure between the exposure range of nanoseconds ($1\times10^{-9}$ seconds) to several minutes while maintaining printing speed and contrast.

Color negative films are designed to have inherently broad exposure ranges. This feature allows for over and under exposures which are common in amateur and professional film markets. Many commercially available color negative films have exposure ranges which allow the photographer to under expose the film up to 2 stops (0.6 log exposure), or to overexpose by as much as 4 stops (1.2 log exposure). This broad exposure latitude provides greater flexibility for amateur photographers and insures that the entire original scene lightness range is captured by the color negative film.

The contrast of the color negative material may, however vary between film types. For example, portrait photographers may prefer films of lower contrast to provide prints which appear less contrasty than a standard amateur color negative film. Amateur films are designed for a wider variety of applications. Higher contrast color negative films may be the choice of commercial photographers wishing to draw greater attention to their work by increasing color saturation and contrast.

Clearly, it is important for the negative film to maintain a constant contrast (or gamma) over this broad range of exposure. Failure to do so would cause contrast mismatches as a function of exposure when printing onto the color negative paper, resulting in incorrect color and poor tone reproduction.

The color negative paper must be adjusted for contrast so as to provide a preferred color print with the appropriate color negative. Historically this has been achieved by manufacturing a series of color negative films and papers each having a range of contrasts. For example, the Kodak Ektacolor 74™ and Kodak Ektacolor 78™ papers which differed primarily in contrast, were the choice of many professional and amateur photo finishers, for many years. These products were improved upon by Kodak Ektacolor Professional™ and the Kodak Ektacolor Plus™ color negative papers which also differed in contrast. More recently, new color papers have been introduced into the market widening the contrast range from low to medium to high. Products such as Kodak Ektacolor Portra™ (lowest contrast), Kodak Ektacolor Supra™ (medium contrast) and Kodak Ektacolor Ultra™ (highest contrast) utilize the rapid processing cycle known worldwide as the Kodak Ektacolor RA-4 Color Paper Process™, further increasing their utility and ease of use in the marketplace.

As the contrast of any color negative paper increases however, a problem occurs in the higher exposure areas, (darker area of the print) which lose detail and become 'blocked in'. The paper appears to lose printing latitude resulting in the loss of shadow detail. Reducing the contrast of the paper to lighten the dark areas results in lower than desired contrast, desaturated colors and blacks (shadows) which are insufficiently black. This problem is especially troublesome when photographing weddings or brightly lit outdoor scenes with heavy shadows.

In wedding scenes it is especially difficult to print a white wedding dress with sufficient detail as to be pleasing and yet in the bridegrooms black tuxedo, keeping the folds in a sleeve from disappearing and becoming 'blocked in', for example. A similar problem exists in outdoor scenes where there exist a very wide range of scene luminance's. For example, on a sunny day with shadows from buildings or trees, it is especially difficult to print the directly lit area dark enough to have detail and keep the areas covered by shadow in shadow, light enough to see the detail in the shadow.

Custom printing using techniques such as masking, or dodging and burning are frequently used by professional print finishers to aid in printing scenes which contain large differences in scene illumination to reduce the difficulty. A fill-in flash is often used to illuminate dark shadow areas in the scene and reduce scene contrast.

Another factor to be considered when designing a color paper is the effect of the viewing conditions under which the print is to be viewed. Viewing flare results from the light reflected onto the print in the viewing room. The effect of adding reflectance to the color print is to reduce reflection density and hence contrast. Since the effect of viewing flare is logarithmic, areas in the print of higher density are affected more so than areas of lower density. Thus the result of viewing flare is to reduce upper scale density which reduces contrast and reduces detail in shadows.

The use of blended emulsions in a color photographic system is not new or novel. For example, to obtain wider exposure latitude in color negative film, Wyckoff in U.S. Pat. No. 3,849,138 describes combining emulsions of different sensitivity but equal slopes (contrast) in separate layers. Ohya, et al, in U.S. Pat. No. 5,039,601 describe a process for manufacturing silver halide grains of different sensitivity by growing together mixed silver halide seed grains where the seed grains themselves differ in inherent sensitivity. P ätzold, et al, in U.S. Pat. No. 4,301,242 describes a process for preparing silver halide grains differing in sensitivity for color reversal papers. Emulsions used in these examples have different sensitivities but the same slope (contrast). Thus when combined, the exposure latitude is increased, but the contrast of the material remains unchanged. Asami, et al, in U.S. Pat. No. 4,745,047 describes the use of blended emulsions of different grain sizes in a color paper format to maintain gradation (contrast) in high density areas when benzyl alcohol is removed from the development process. Their use of blended emulsions is to maintain contrast, not increase contrast in high density areas when benzyl alcohol is removed from the color development process.

Buhr and Franchino U.S. application Ser. No. 950,871 filed Sep. 24, 1992 describes a system "for presenting a preferential tone mapping in a reproduction of an original scene, the system being of the type having means for capturing original scene parameters onto a medium from which a reproduction of the original scene is to be derived and means for creating a visual reproduction of the scene from the captured scene parameters." However, there is not disclosed therein a way to practice their invention for the conventional color negative positive film system for either a color negative film or color paper.

In Kuwashima U.S. Pat. No. 4,792,518, the recognition is made that in order to make an exact reproduction of a color transparency or reflection original, the characteristic S-shaped D vs. log-E curve should be avoided and a preferred curve having the shape of a "saw" should be made, with great care to maintain linearity throughout the range of exposures between densities of 0.8 and 1.8 and also having a sharp toe for "clearing of highlight details". This linear exposure scale produces an instantaneous contrast vs. log exposure curve where the instantaneous contrast reaches a preferred value and does not, in general, exceed that value over the course of the entire exposure range. FIG. 3 of Kuwashima shows the instantaneous contrast having a generally constant value of approximately 1.2 over the entire exposure range; for example, this constant value is due to the linear nature of the D vs. log-E curve. Indeed, they cannot achieve their stated goal of making an exact, faithful reproduction, since they illustrate the preferred reproduction having an instantaneous contrast of 1.2 and not 1.0. To make an exact reproduction would require the contrast of the reproduction to be 1.0 otherwise it would not be an exact reproduction.

Kubotera et al in EP 0 533 033 A1 describe a method for manufacturing a silver halide emulsion in which chemical sensitization is performed at higher temperatures than spectral sensitization. This process leads to a performance improvement in which upper scale contrast is raised. However, they point out that they desire to improve gradation (contrast) while maintaining linearity across the entire exposure range from low to medium to high densities.

Hahm in U.S. Pat. No. 4,902,609 describes a method to improve exposure latitude in a color negative paper by false sensitizing the red light sensitive emulsion with a small amount of green sensitizing dye. The result of this is to desaturate colors such as red by adding a small amount of cyan dye in areas of high exposure. False sensitizing the red sensitive layer with a green sensitizing dye causes cyan dye to be added to colors such as red or blue. The added cyan color darkens the red or blue dye image making it appear to have more contrast.

Similar to Hahm is Waki et al in U.S. Pat. No. 5,084,374 who describe the improvement in shadow detail in high density regions of a color print which is achieved by false sensitizing the green and red light sensitive emulsions with blue sensitizing dye. This technical approach has the same deficiencies as Hahm in desaturating colors.

Problem to be Solved by the Invention

The disadvantage of the prior products to be overcome by the invention is that present color paper products cannot provide sufficient shadow detail in high density exposures without raising contrast in the lower exposure areas which makes the color and contrast in those areas less pleasing.

SUMMARY OF THE INVENTION

It is an object of the invention to provide photographic elements with improved high density contrast and low density colors.

An object of the invention is to provide a color negative reflection print photosensitive material of improved overall tone reproduction and increased shadow detail.

A further object of the invention is to produce color prints of improved color saturation at high densities while maintaining preferred color saturation and contrast at lower densities.

A further object of the invention is to increase the printing latitude of the color negative paper.

These and other objects of the invention are generally accomplished by providing a cyan color producing silver halide emulsion layer or a magenta color producing silver halide emulsion layer wherein said at least one layer has an exposure range of at least 0.6 log E from the point where the instantaneous contrast is 1.0 and wherein the instantaneous contrast of said layer increases as a function of increasing exposure over at least 70 percent of said exposure range.

Advantageous Effect of the Invention

The invention has numerous advantages over prior color paper products and over other negative-working color photographic products. The invention provides improved contrast in high exposure areas. Further, the invention provides color papers that have color saturation in the lower scale, although the upper scale provides very good detail. Further, color prints of the invention have a more natural look to them with good detail in the high density areas. Additionally, the papers of the invention provide pleasing flesh tones for a wide range of flesh colors. The paper provides particularly desirable tones for a wide variety of flesh tones.

Another advantage of the invention is that the invention compensates in the color photographic paper for ambient viewing flare typical in ambient surrounds by increasing the contrast in high density regions of the print without simultaneously increasing the preferred contrast in lower density regions of the print.

DETAILED DESCRIPTION OF THE INVENTION

Figure 1:
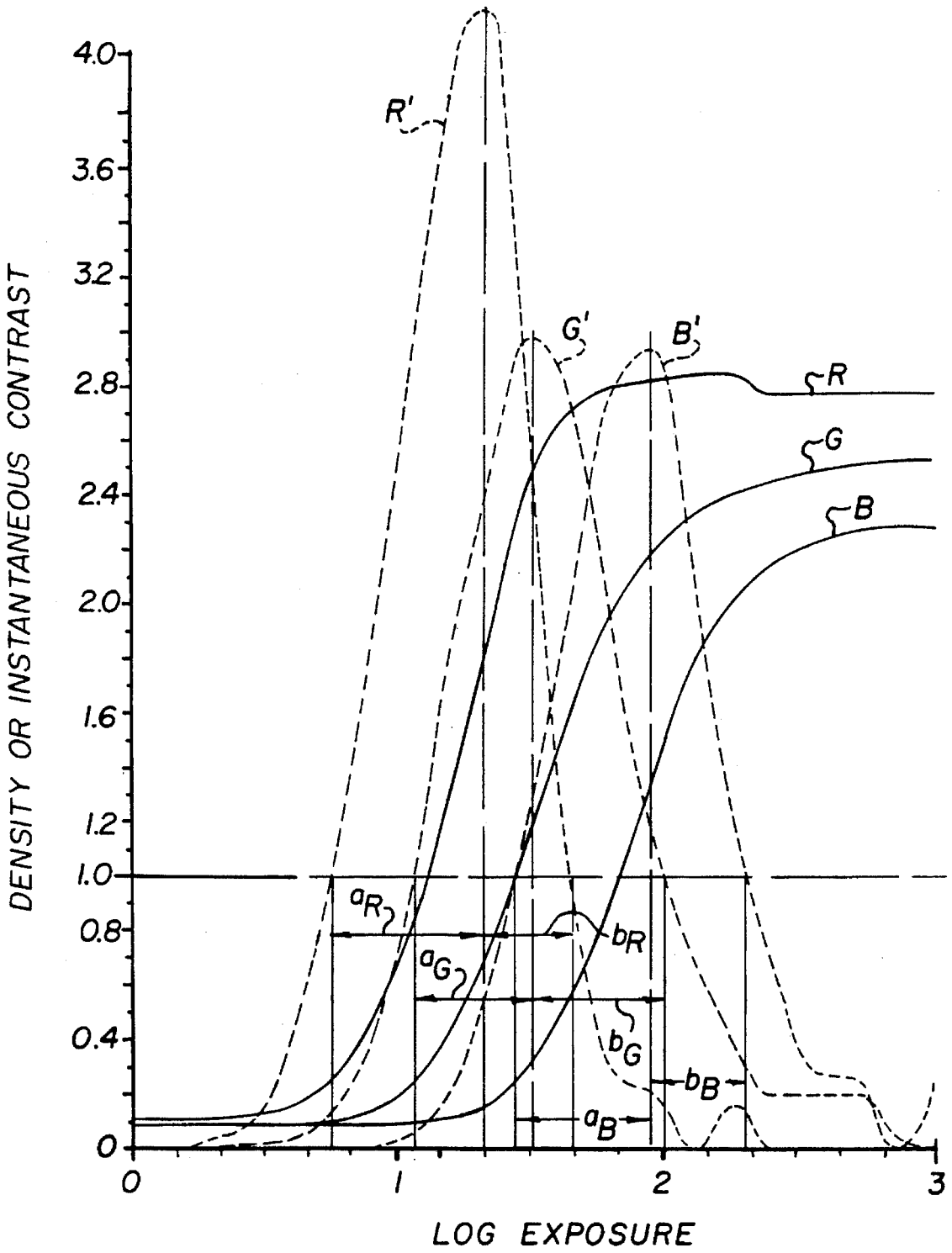
FIG. 1 shows prior art characteristic red, green and blue D vs. log-E curves for Kodak Ektacolor Supra™ color paper (solid line) and the calculated dD/dlog-E curves (shown as dashed lines) as an example of a representative silver halide color negative paper.
Figure 2:
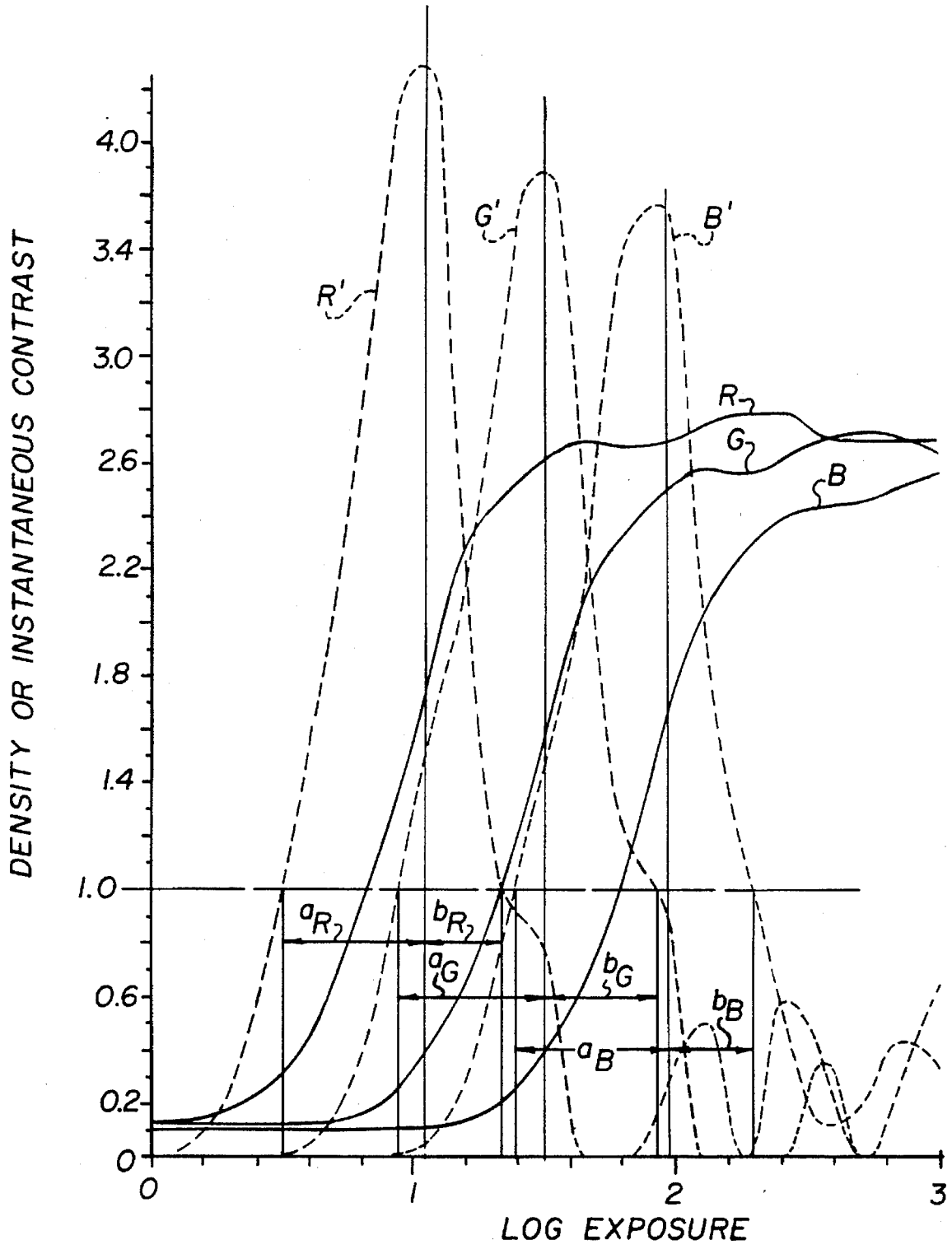
FIG. 2 shows prior art characteristic red, green and blue D vs. log-E curves for Fujicolor SFA 3 Type C™ color paper (solid line) and the calculated dD/dlog-E curves (shown as dashed lines) as an example of a second representative silver halide color negative paper.
Figure 3:
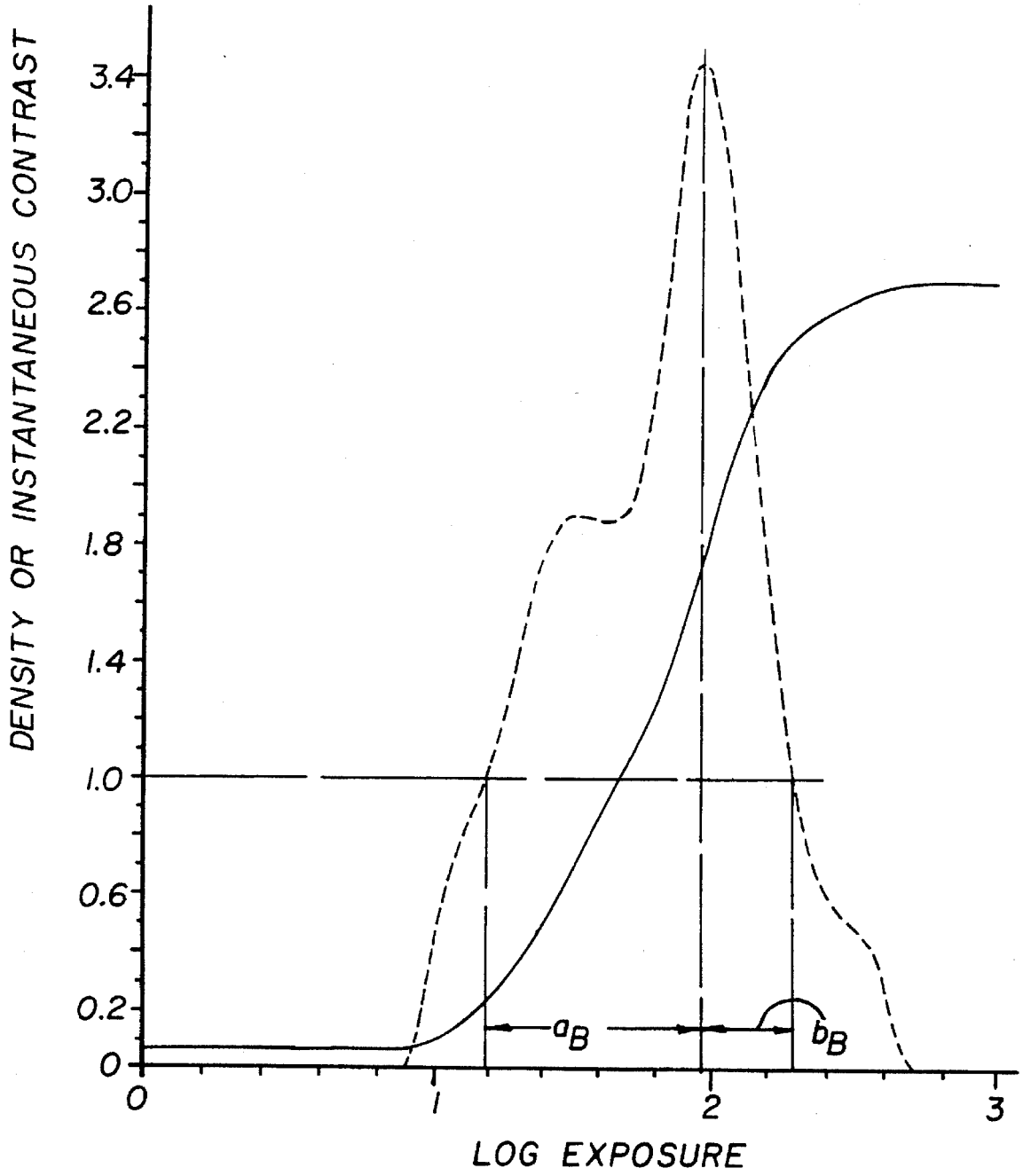
FIG. 3 shows the characteristic blue curve from coating Example 1 (solid line) and the calculated dD/dlog-E curves (shown as dashed lines).
Figure 4:
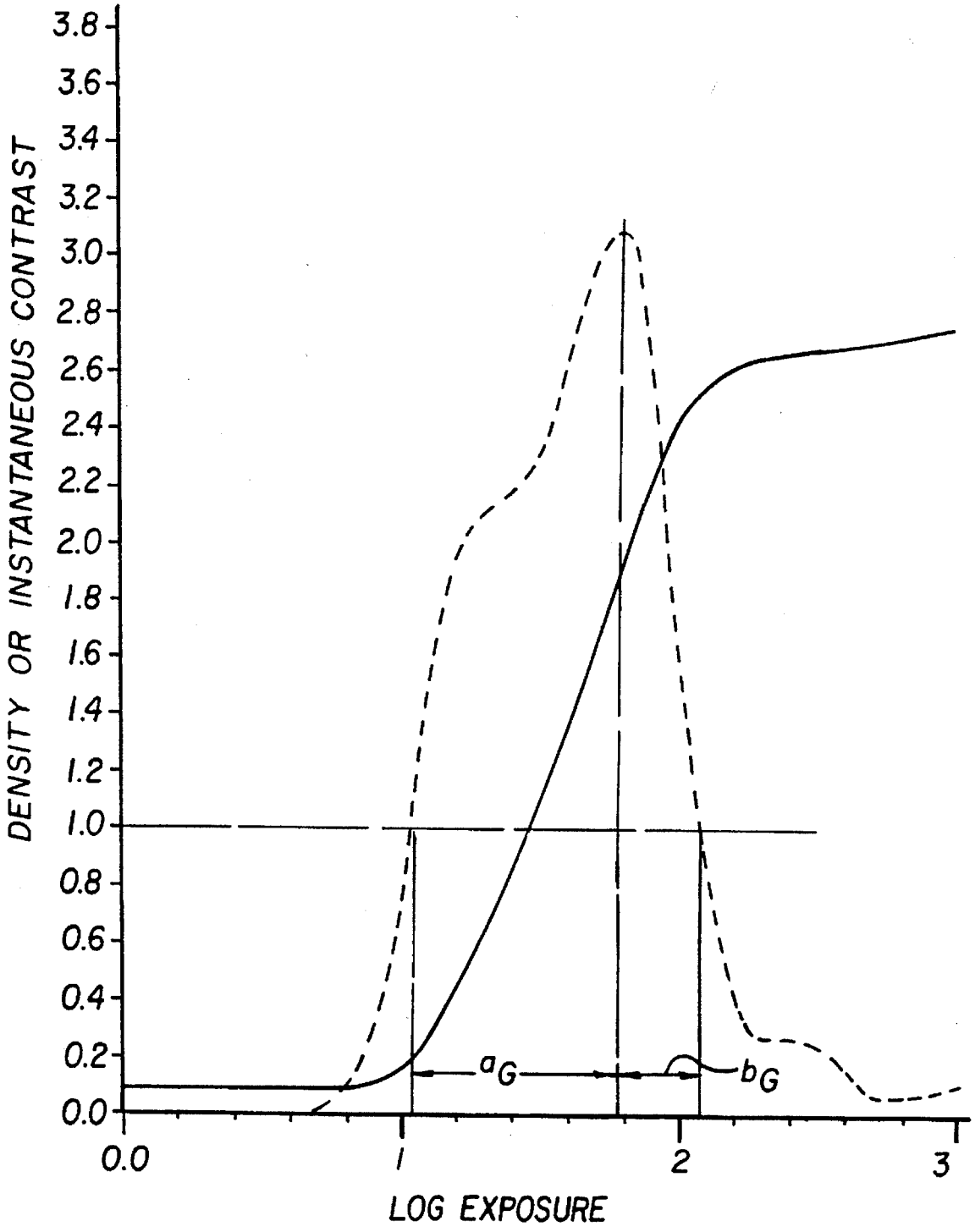
FIG. 4 shows the characteristic green curve from coating Example 2 (solid line) and the calculated dD/dlog-E curve (shown as dashed lines).
Figure 5:
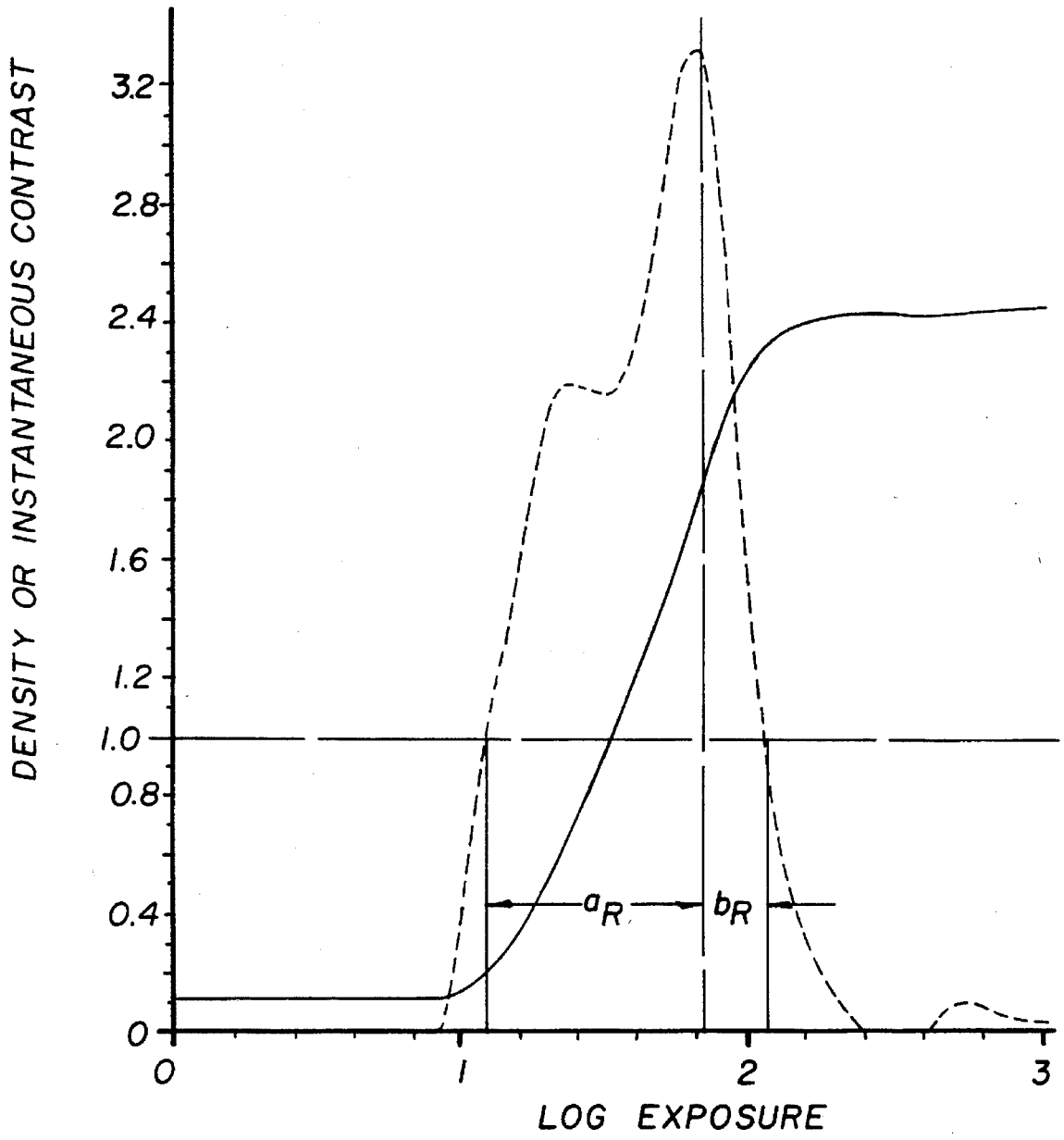
FIG. 5 shows the characteristic red curve from coating Example 3 (solid line) and the calculated dD/dlog-E curve (shown as dashed lines).

The use of D vs. log-E curves is common practice in the photographic industry to describe the relationship between the amount of density (D) obtained as exposure (E) is increased in a logarithmic fashion. In FIGS. 1 and 2 the red (R), green (G) and blue (B) characteristic responses for two commercially available color negative papers (solid lines) are given as a function of increasing log exposure.

The term point-gamma, or instantaneous contrast used here-in is defined as the change in density as a function of changing exposure. Hence:

point gamma=instantaneous contrast=dD/dlog-E.

The definitions of instantaneous contrast or point gamma is the same as that defined in Kuwashima referred to earlier (U.S. Pat. No. 4,792,518). In FIGS. 1 and 2, the instantaneous contrasts for the red (R'), green (G') and blue (B') responses (dashed lines) are also shown as a function of increasing log exposure.

As is apparent from FIGS. 1 and 2, there is a bell-shaped distribution of instantaneous contrasts as a function of log exposure. This means that instantaneous contrast is continually changing as a function of exposure. At low exposures, instantaneous contrast is zero at the minimum density (Dmin) and increases monotonically to a maximum. At higher exposures, instantaneous contrast decreases until the maximum exposure is reached (Dmax) and instantaneous contrast becomes zero. The invention is based on the realization that instantaneous contrast is decreasing at higher exposures and that this decrease accounts for the loss of shadow detail in the resultant print.

What is desired then, is to have the instantaneous contrast continually increase from a minimum exposure to a maximum exposure to increase detail. The minimum exposure is defined as the point on the log exposure axis where the instantaneous contrast reaches a value of 1.0. The maximum useful exposure is defined as the point on the same axis where additional exposure fails to produce an increasing instantaneous contrast and hence, instantaneous contrast falls to levels below 1.0. It is extremely difficult to visually recognize changes in tone when contrast is less than 1.0. The difference between the two points, therefore, represents the useful exposure range of the element and is expressed in log exposure units.

In this exposure range, it is important that contrast continually and generally increase across the entire range of exposures. For optimum tone reproduction, the paper should be printed with an appropriately exposed color negative of the proper contrast. The exposure range of the paper should be greater than 0.6 log exposure units to insure that all the elements of the information recorded in the negative can be reproduced. Since it is generally not practical for contrast to continually increase between Dmin and Dmax, some softening (decrease) of the upper scale densities are to be anticipated as exposure increases.

However, for optimum tone and color reproduction, we have found that instantaneous contrast should increase for more than 70% of the useful exposure range. This percentage is determined by measuring the exposure range from the point where instantaneous contrast reaches an initial value of 1.0 to the maximum instantaneous contrast. This exposure range is referred to as 'a'. The total exposure range is the exposure between the points on the instantaneous contrast range where instantaneous contrast falls below 1.0. The value 'b' represents the exposure range between the maximum instantaneous contrast and the point where instantaneous contrast falls below 1.0. The fractional percentage of increasing contrast, f, then is represented by the equation:

$$f=a/(a+b)\times 100$$

These non-linear requirements of the invention in the D vs. log-E curve have been achieved by combining two or more silver halide emulsions of the same spectral sensitivity but having different sensitivities and contrasts in the same color record. In the simplest instance, two emulsions having the same spectral sensitivity are combined in a single layer of a color negative paper. Their individual sensitivities can be adjusted using a variety of techniques such as changing grain edge length or size or size dispersity or by changing the amount of sensitizer or desensitizer present in each grain. Contrast control can be made by simply changing the amount of each emulsion present or through the use of organic or inorganic additives to the emulsion which act as sensitizers or desensitizers.

In a preferred way to achieve the invention, each color record is comprised of two or more silver halide emulsions of like spectral sensitivity which may be coated in separate layers in the photosensitive element or they may be combined into a single layer of said photosensitive element. Two of the emulsion combinations of like spectral sensitivity differ from the other in their own unique sensitivity and contrast. Their combined response provides the unique tone scale in which instantaneous contrast increases as exposure onto the color paper increases in such a fashion as to produce a color negative print having the unique and preferred tone scale and improved color reproduction.

Therefore, to form a preferred color paper of the invention it is necessary to extend the upper scale (high density) latitude of the color paper and at the same time do so by increasing upper scale contrast without raising lower scale (low density) contrast. This complexity in color paper has never been achieved until this invention.

We have found that in order to achieve this preferred embodiment, a complex characteristic curve of generally more than a single emulsion component must be used in each color record. Additionally, each emulsion must be of a different sensitivity, and two emulsions must be of differing contrast so that when the individual characteristic curves are combined, the preferred characteristic curve will result.

The preferred image on the color paper of the invention preferably is formed when at least the layers comprising the red sensitized emulsion or emulsions has an exposure range, $a_{Red}$, of greater than 0.6 log-E from the point where instantaneous gamma reaches 1.0 and wherein the instantaneous gamma of said element increases as a function of increasing exposure over said exposure range. It has been found that a more preferred exposure range is 0.7 log-E from the point where instantaneous gamma reaches 1.0 for good contrast in the high density regions.

Color photographic papers of the invention have an improved performance when only the layer containing red sensitized emulsion or the green sensitized emulsions has the specified exposure range of greater than 0.6 log-E from the point where instantaneous gamma reaches 1.0 and wherein the instantaneous gamma increases as a function of increasing exposure over said exposure range; however, it has been found that a more preferred color paper of the invention is formed when both the red and the green sensitive layers have an exposure range of greater than 0.6 log-E from the point wherein the instantaneous gamma reaches 1.0 and wherein the instantaneous gamma of said red layer and green layer increases as a function of increasing exposure over said exposure range. It is most preferred that all three-color record layers blue, green, and red sensitized layers have an exposure range of greater than 0.6 log-E from the point wherein the instantaneous gamma reaches 1.0 and wherein the instantaneous gamma of each layer increases as a function of increasing exposure over said exposure range.

The instantaneous gamma increase as a function of increasing exposure over said exposure range may be continuous. In the alternative, the instantaneous gamma increase may include a deviation of up to about 15% from a continuous increase or more preferably a deviation of up to 10% from a continuous increase. Such deviations are not significantly noticeable to the viewer of the color print; however, it is believed that a generally continuous increase is preferred for best high density contrast with good color saturation and contrast in the low density regions. The phrases "red sensitive layer", "blue sensitive layer", or "green sensitive layer" as used herein may be considered as including multiple layers of the same light sensitivity but having different speed and contrast characteristics. These emulsions may be either in the form of different layers, or the emulsions may be mixed such that a single layer of one color sensitization of blended emulsions is utilized in the photographic element.

In the following discussion of suitable materials for use in the emulsions and elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Ser. No. 07/978,589 filed Nov. 19, 1992, and U.S. Ser. No. 07/978,568 filed Nov. 19, 1992, both granted, in conjunction with elements of the invention.

In addition, emulsions can be sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response.

In addition, emulsions of this invention may contain a mixture of spectral sensitizing dyes which are substantially different in their light absorptive properties. For example, Hahm, in U.S. Pat. No. 4,902,609, describes a method for broadening the effective exposure latitude of a color negative paper by adding a smaller amount of green spectral sensitizing dye to a silver halide emulsion having predominately a red spectral sensitivity. Thus when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and hence a broader exposure latitude.

Waki et al. in U.S. Pat. No. 5,084,374, describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

The silver halide emulsions employed in the elements of this invention generally are negative-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624; Maskasky U.S. Pat. No. 5,264,337; and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Patent 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 November/December 1980, pp. 265–267; Hochstetter U.S. Pat. No. 1,951,933 (Cu); De Witt U.S. Pat. No. 2,628,167; Mueller et al U.S. Pat. No. 2,950,972; Spence et al U.S. Pat. No. 3,687,676 and Gilman et al U.S. Pat. No. 3,761,267; Ohkubu et al U.S. Pat. No. 3,890,154; Iwaosa et al U.S. Pat. No. 3,901,711; Habu et al U.S. Pat. No. 4,173,483; Atwell U.S. Pat. No. 4,269,927; Weyde U.S. Pat. No. 4,413,055; Akimura et al U.S. Pat. No. 4,452,882; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Kuno U.S. Pat. No. 5,057,402; Maekawa et al U.S. Pat. No. 5,134,060; Kawai et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Marchetti et al U.S. Pat. Nos. 5,264,336 and 5,268,264; Komarita et al EPO 0 244 184; Miyoshi et al EPO 0 488 737 and 0 488 601; Ihama et al EPO 0 368 304; Tashiro EPO 0 405 938; Murakami et al EPO 0 509 674 and Budz WO 93/02390; Ohkubo et al U.S. Pat. No. 3,672,901; Yamasue et al U.S. Pat. No. 3,901,713; and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Ser. No. 08/091,148.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965; Shiba et al U.S. Pat. No. 3,790,390; Habu et al U.S. Pat. No. 4,147,542; Hasebe et al EPO 0 273 430; Ohshima et al EPO 0 312 999; and Ogawa U.S. Statutory Invention Registration H760.

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_3IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate)tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also especially useful.

The materials of the invention can be used with photographic elements in any of the ways and in any of the combinations known in the art. Typically, the photographic materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

It is understood throughout this specification and claims that any reference to a substituent by the identification of a group containing a substitutable hydrogen (e.g., alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, acylamino, sulfonamide, alkylthio, arylthio, alkenyl, cycloalkyl, and further to these exemplified are halogen, cycloalkenyl, alkinyl, heterocycle, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, spiro compound residues and bridged hydrocarbon compound residues.

The photographic elements can be single color elements or the preferred multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. It is also contemplated for the practice of the present invention that one or more of the cyan, magenta, and yellow dye image-forming units may be spectrally sensitized to a region of the spectrum other than its complimentary color (red, green, and blue, respectively). Specifically one or more of the dye image-forming units may be sensitized to the infrared region of the spectrum as described in Simpson et al U.S. Pat. No. 4,619,892. The element can contain additional layers, such as filter layers, interlayers, overcoat layers, subbing layers, and the like.

Typical couplers, stabilizers, and coupler solvents that could be used with the elements of this invention are shown below:

C-1

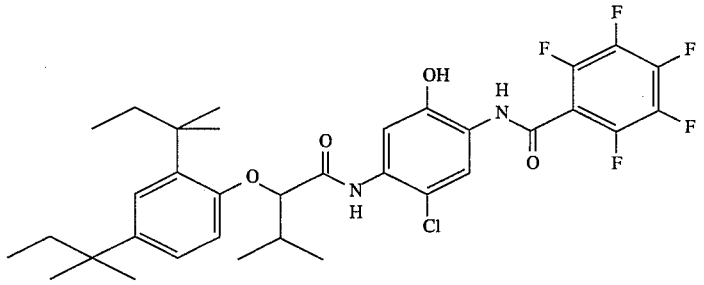

C-2

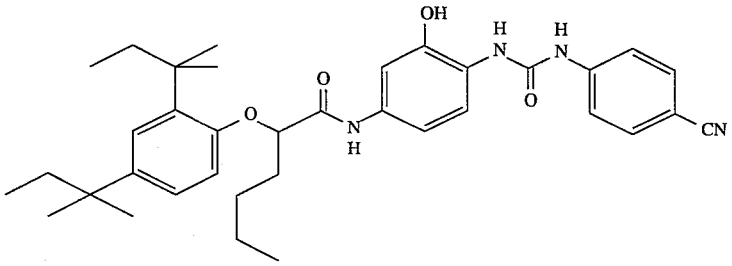

C-3

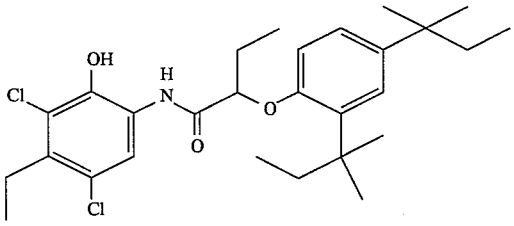

C-4

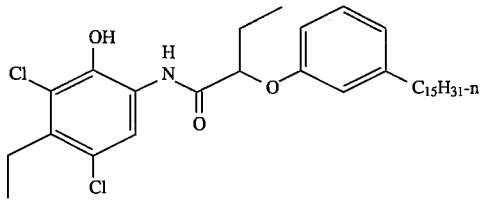

C-5

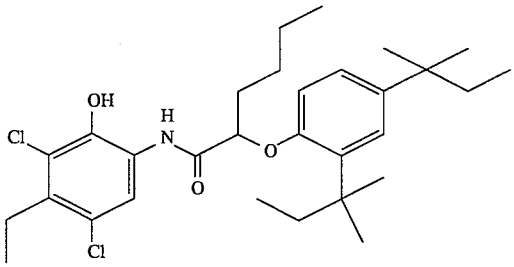

C-6

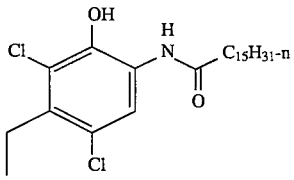

-continued
C-7
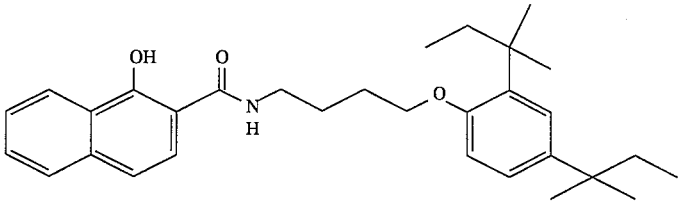
C-8
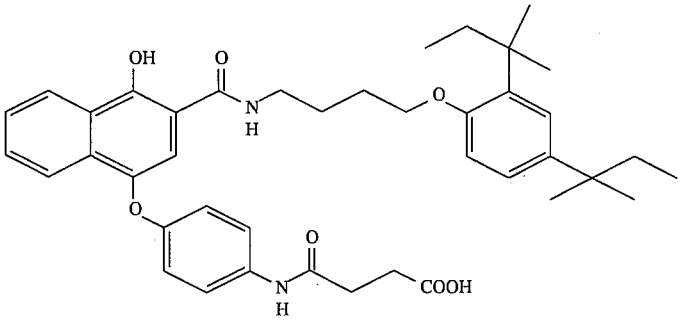
C-9
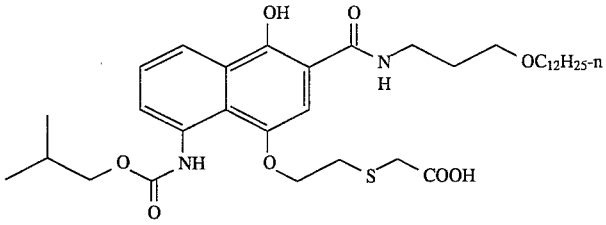
C-10
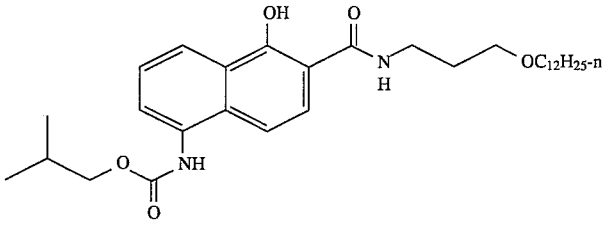
C-11
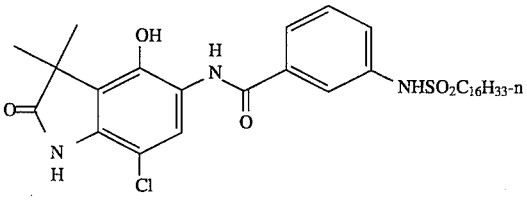
C-12
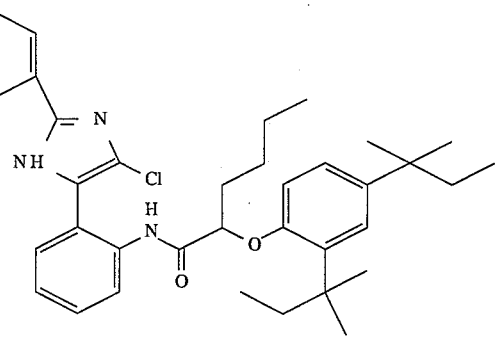
C-13
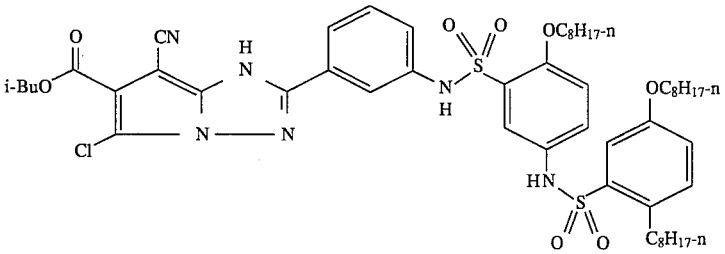

-continued
C-14
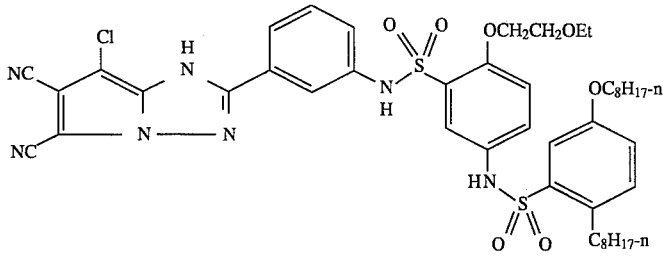
C-15
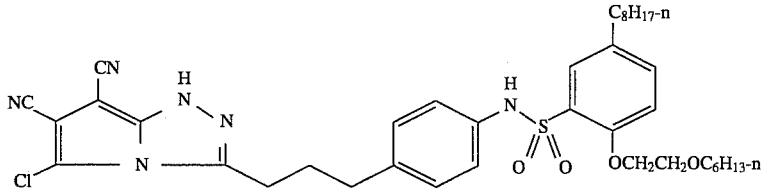
C-16
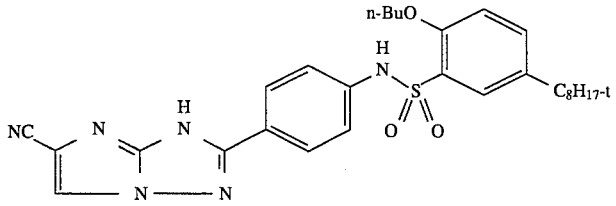
C-17
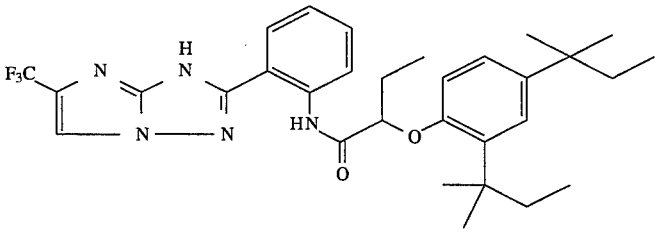
C-18
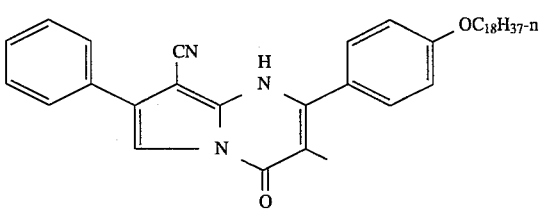
C-19
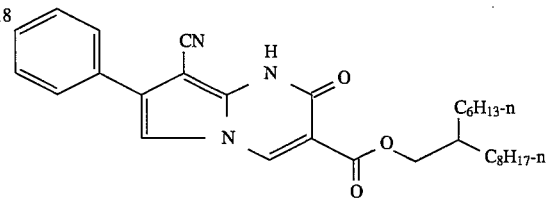
C-20
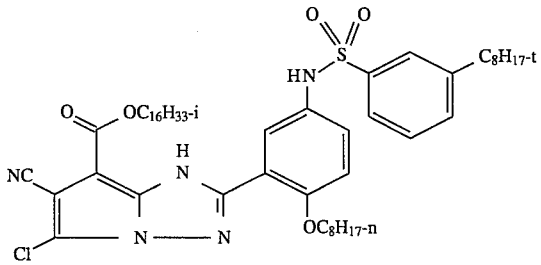
C-21
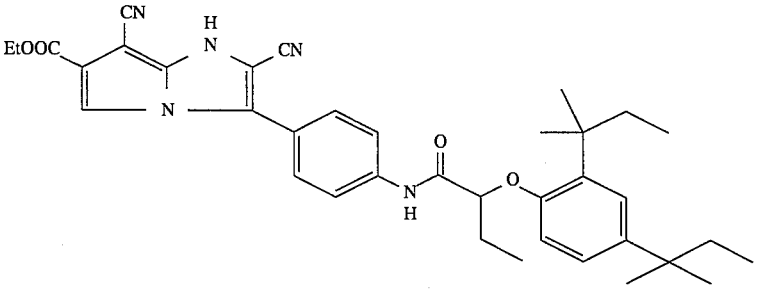

-continued
M-1
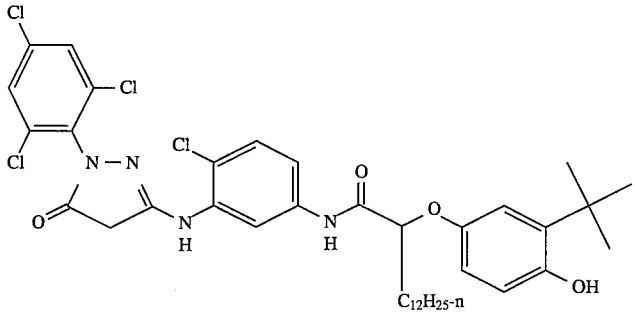
M-2
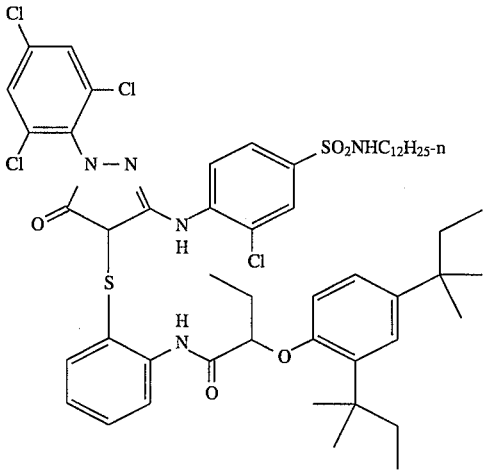
M-3
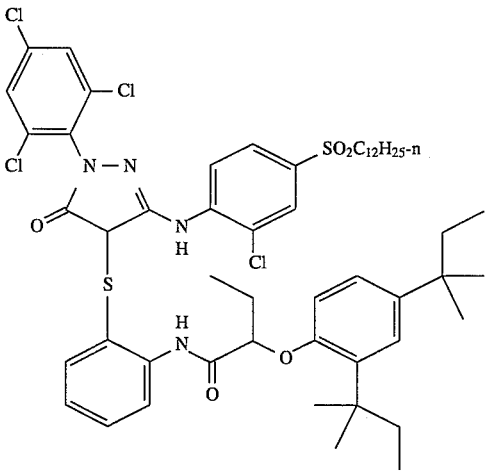
M-4
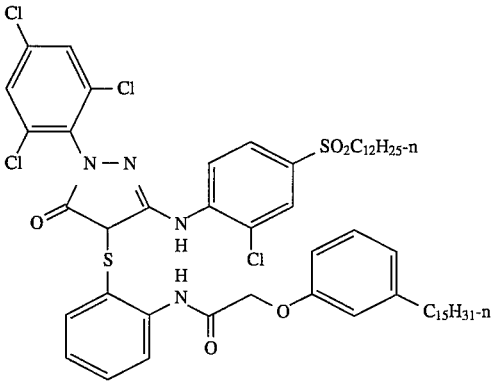
M-5
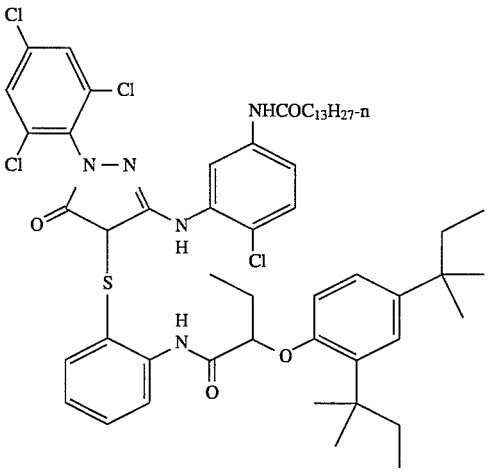
M-6
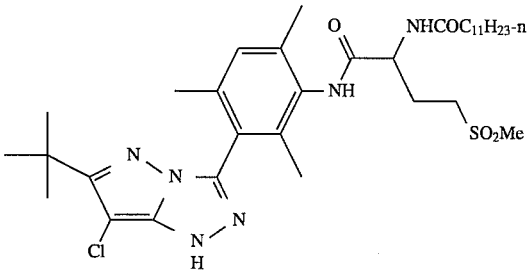

-continued
M-7
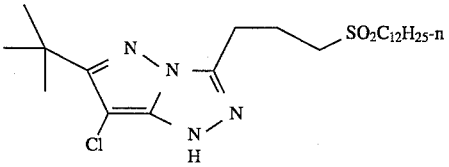
M-8
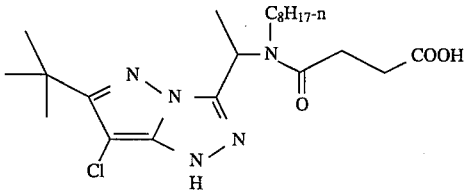
M-9
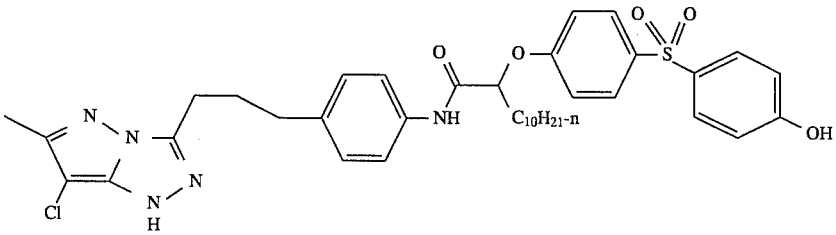
M-10
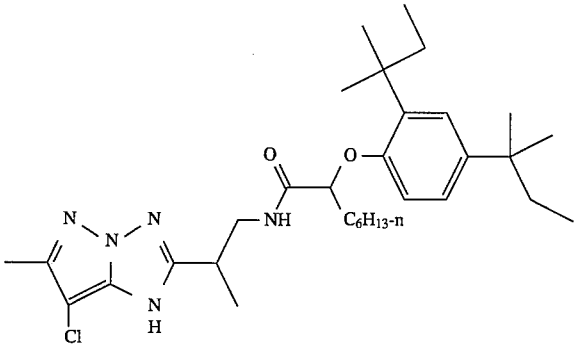
M-11
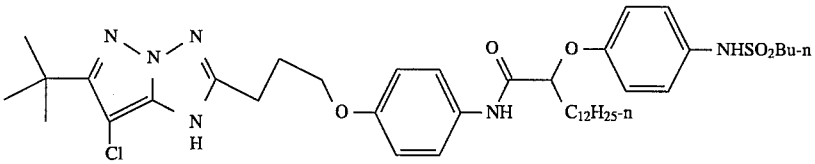
M-12
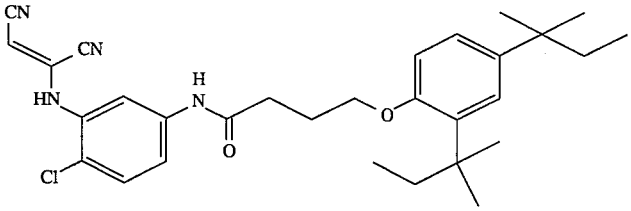
Y-1
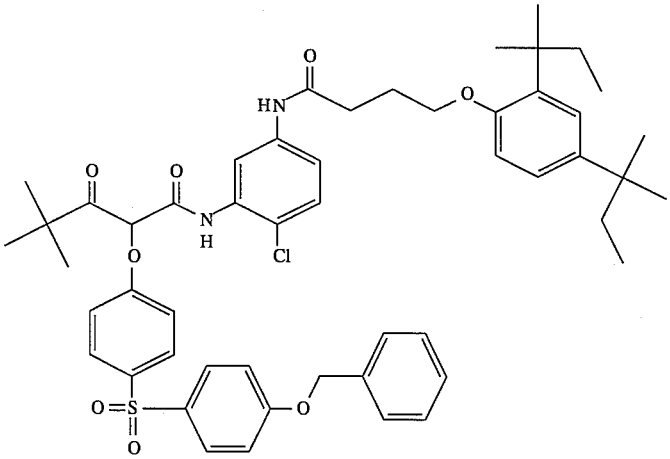

-continued
Y-2
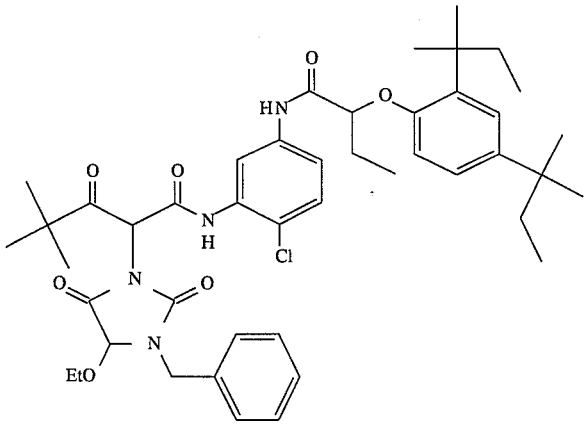
Y-3
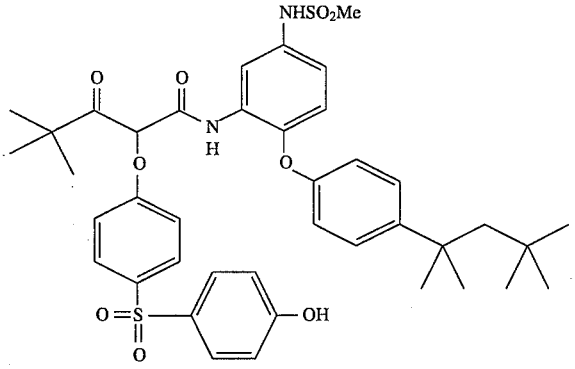
Y-4
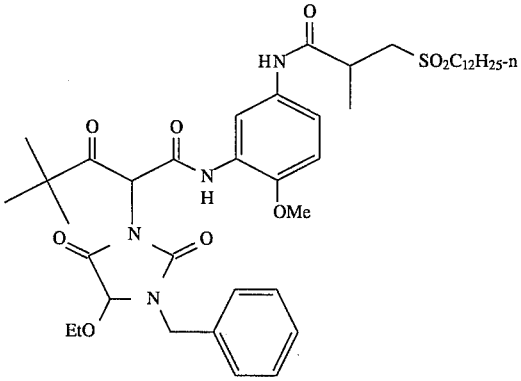
Y-5
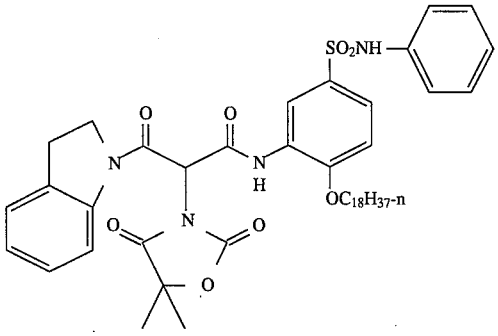
Y-6
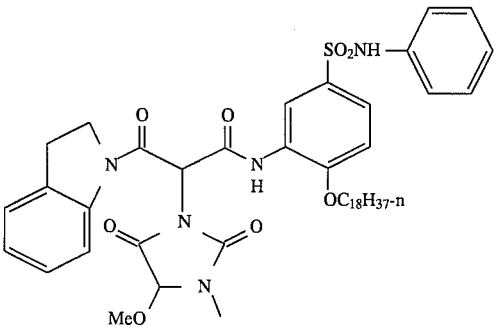
Y-7
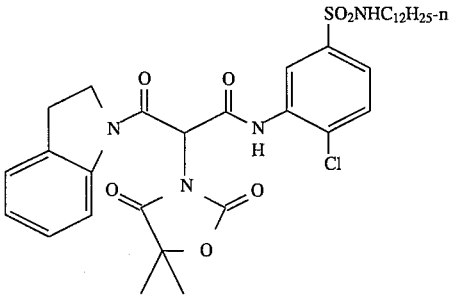

-continued
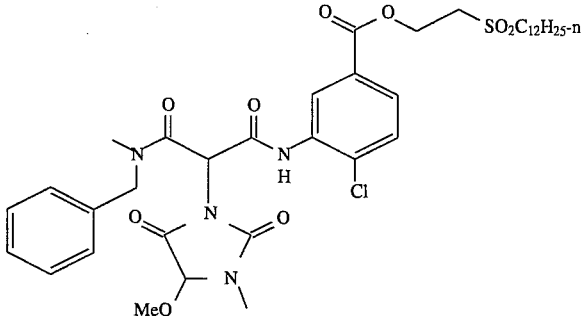
Y-8
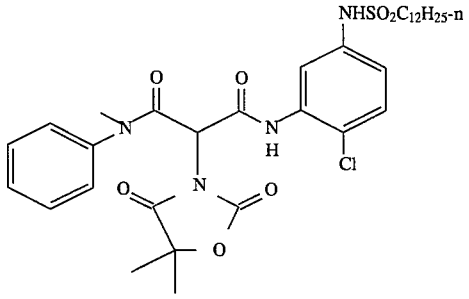
Y-9
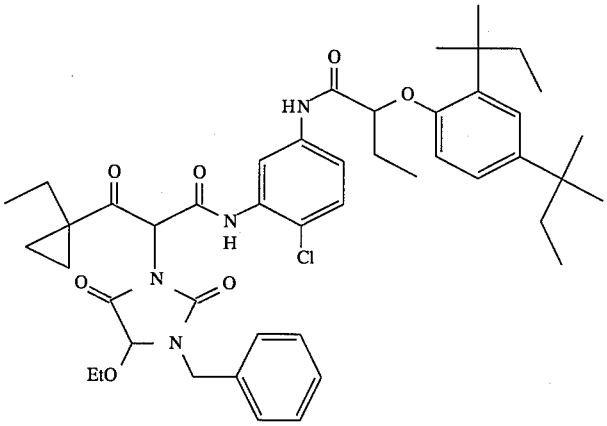
Y-10
Solvents
| | | | |
|---|---|---|---|
| Dibutyl phthalate | S-1 | Tritolyl phosphate | S-2 |
| N,N-Diethyldodecanamide | S-3 | Tris(2-ethylhexyl)phosphate | S-4 |
| 2-(2-Butoxyethoxy)ethyl acetate | S-5 | 2,5-Di-tert-pentylphenol | S-6 |
| Acetyl tributyl citrate | S-7 | | |
UV Stabilizers (UV Absorbers)
UV-1
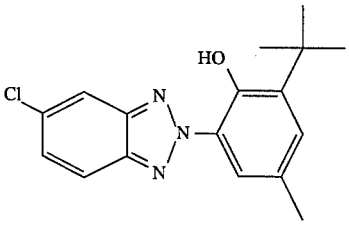
UV-2
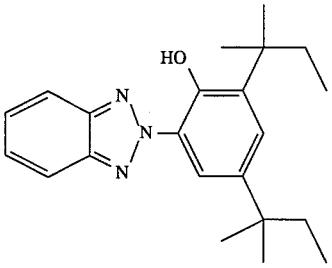

-continued
UV-3
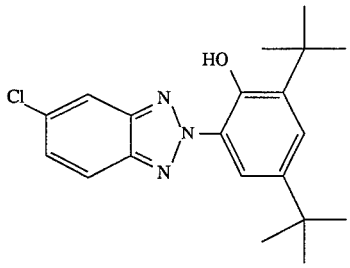
UV-4
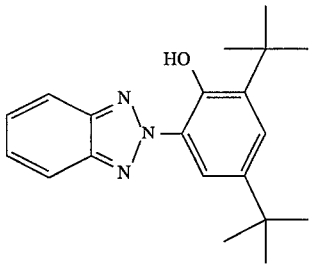
UV-5
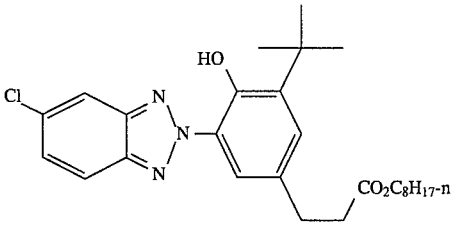
UV-6
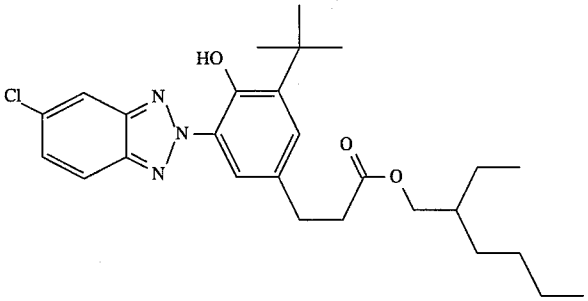
UV-7
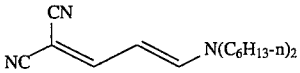
UV-8
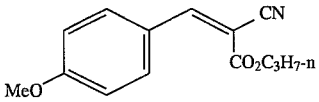
Stabilizers
ST-1
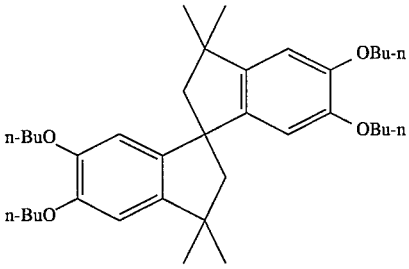
ST-2
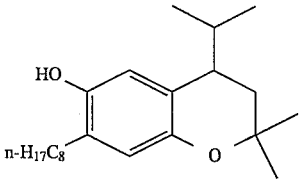
ST-3
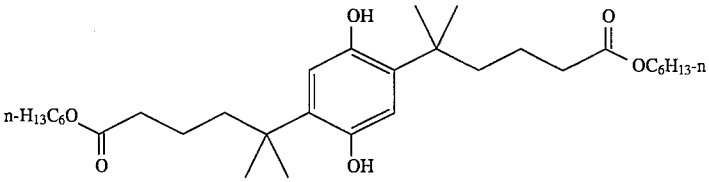
ST-4
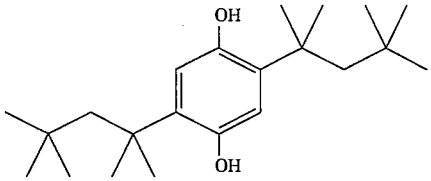
ST-5
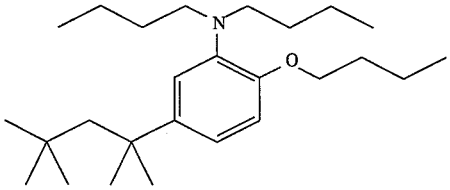

-continued

ST-6

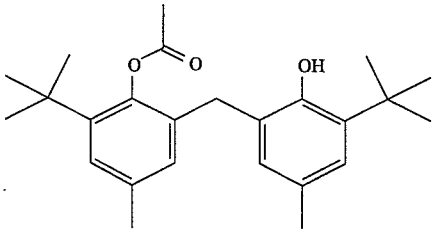

ST-7

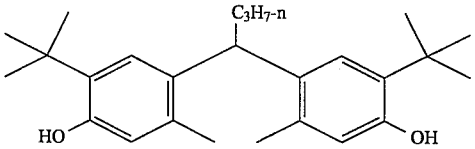

ST-8

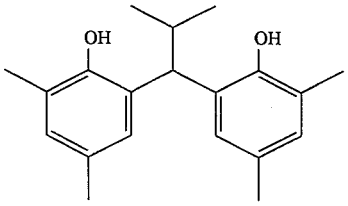

ST-9

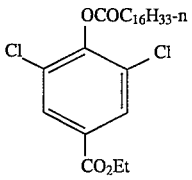

ST-10

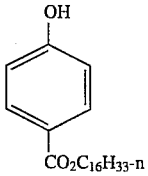

ST-11

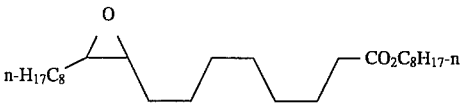

ST-12

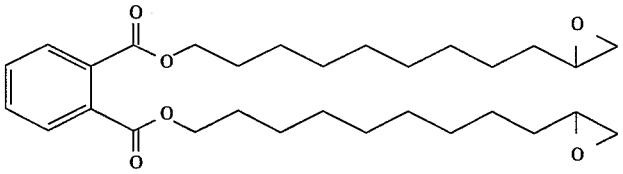

ST-13

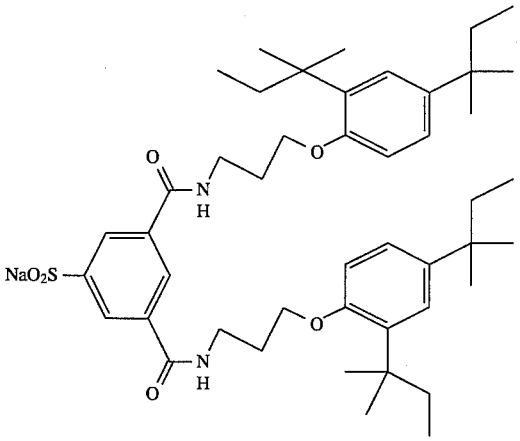

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND.

Various types of hardeners are useful in conjunction with elements of the invention. In particular, bis(vinylsulphonyl-)methane, bis(vinylsulfonyl)methyl ether, 1,2-bis(vinylsulfonyl-acetamido)ethane, 2,4-dichloro-6-hydroxy-s-triazine, triacrylooyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142, 4,618,573, 4,673,632, 4,863,841, 4,877,724, 5,009,990, and 5,236,822.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455, 169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Couplers that form magenta dyes upon reaction with oxidized color developing agent are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo[1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765; U.S. Pat. Nos. 4,659,652; 5,066,575; and 5,250,400.

A typical pyrazolotriazole coupler is represented by formula MAGENTA-1:

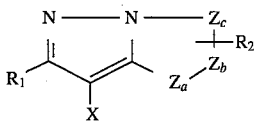

MAGENTA-1 wherein $R_1$ and $R_2$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_2$.

Couplers that form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Especially preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

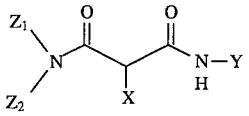

YELLOW-1

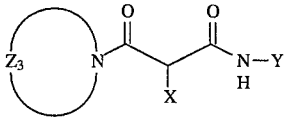

YELLOW-2

-continued

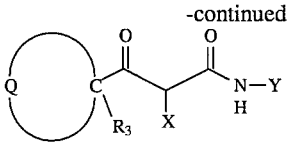

YELLOW-3 wherein $R_3$, $Z_1$ and $Z_2$ each represent a substituent; X is hydrogen or a coupling-off group; Y represents an aryl group or a heterocyclic group; $Z_3$ represents an organic residue required to form a nitrogen-containing heterocyclic group together with the >N—; and Q represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Z_1$ and $Z_2$ each represent an alkyl group, an aryl group, or a heterocyclic group.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Even more preferable are the cyan couplers described in, for instance, European Patent Application Nos. 544,322; 556,700; 556,777; 565,096; 570,006; and 574,948.

Typical preferred cyan couplers are represented by the following formulas:

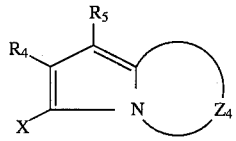

CYAN-1

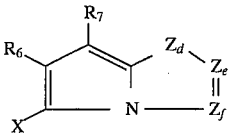

CYAN-2

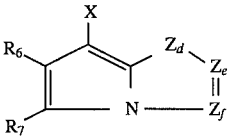

CYAN-3

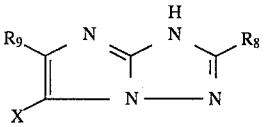

CYAN-4 wherein $R_4$, $R_8$ and $R_{11}$ each represent a hydrogen or a substituent; $R_5$ represents a substituent; $R_6$, $R_7$ and $R_{10}$ each represent an electron attractive group having a Hammett's substituent constant $\sigma_{para}$ of 0.2 or more and the sum of the $\sigma_{para}$ values of $R_6$ and $R_7$ is 0.65 or more; $R_9$ represents an electron attractive group having a Hammett's substituent constant $\sigma_{para}$ of 0.35 or more; X represents a hydrogen or a coupling-off group; $Z_4$ represents nonmetallic atoms necessary for forming a nitrogen-containing, six-membered, heterocyclic ring which has at least one dissociative group; $Z_d$ represents —C($R_{10}$)= and —N=; and $Z_e$ and $Z_f$ each represent —C($R_{11}$)= and —N=.

A dissociative group has an acidic proton, e.g., —NH—, —CH(R)—, etc., that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

It may be useful to use a combination of couplers any of which may contain known ballasts or coupling-off groups such as those described in U.S. Pat. Nos. 4,301,235; 4,853,319 and 4,351,897.

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-D,D,D',D'-tetramethyl-, dihexyl ester; 1,4-Benzenedipentanoic acid, 2-hydroxy-5-methoxy-D,D,D',D'-tetramethyl-, dihexyl ester; and 2,5-dimethoxy-D,D,D',D'-tetramethyl-, dihexyl ester. In addition, it is contemplated that materials of this invention may be used with so called liquid ultraviolet absorbers such as described in U.S. Pat. Nos. 4,992,358; 4,975,360; and 4,587,346.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydrorychromans, 5-hydroxycoumarans, spirochromans are disclosed in U.S. Pat. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589.; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. Nos. 3,700,455; 4,228,235; Japanese Published Patent Applications 52-072,224 and 52-006,623; and so on; gallic acid derivatives, methylenedioxybenzenes and aminophenols are disclosed in U.S. Pat. Nos. 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Various types of polymeric addenda could be advantageously used in conjunction with elements of the invention. Recent patents, particularly relating to color paper, have described the use of oil-soluble water-insoluble polymers in coupler dispersions to give improved image stability to light, heat and humidity, as well as other advantages, including abrasion resistance, and manufacturability of product. These are described, for instance, in EP 324,476, U.S. Pat. Nos. 4,857,449, 5,006,453, and 5,055,386. In a preferred embodiment, a yellow or cyan image coupler, permanent solvent, and a vinyl polymer with a high glass transition temperature and moderate molecular weight (ca. 40,000) are dissolved together with ethyl acetate, the solution is emulsified in an aqueous solution containing gelatin and surfactant to give fine particles, and the ethyl acetate is removed by evaporation. Preferred polymers include poly(N-t-butylacrylamide) and poly(methyl methacrylate).

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629; 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

Common place in most silver halide photographic film systems are the inclusion of water soluble dyes which absorb red, green, and/or blue light. These dyes are removed from the film during processing either by washing out or by being bleached during processing and hence are not part of the final image. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are most useful. The dyes can have one or more functions in the film. Their very presence can serve to attenuate light in proportion to their concentration, extinction coefficient and spectral absorptive properties. This can serve the purpose of adjusting the sensitivity of a previously spectrally sensitized emulsion. The more dye added, the more light is absorbed and hence the emulsion will exhibit lower sensitivity. This is especially useful in color reversal materials as a means of precisely adjusting the sensitivities of each silver halide emulsion to a prescribed sensitivity point so that the optimum color balance will be obtained. The same technique is useful in color papers to adjust the emulsion speeds to a prescribed sensitivity so that printer balance can be maintained as different batches of color paper are processed.

The very presence of these dyes also improves the sharpness of the resultant image after processing. The dyes serve to also absorb light during the exposing process which may have been scattered during interaction with either the support or the silver halide grains themselves. Hence the presence of these dyes serves to prevent exposure of a silver halide grain at a point away from where exposure took place by absorbing the scattered light. This concept is especially useful in color photographic papers where the support is highly reflective and there is not an anti-halation layer to absorb scattered light which has not been absorbed by the silver halide emulsion.

These dyes may be water soluble at time of coating or processing or solubilized during processing so that they may be removed via diffusion or bleaching. The may be included as a dye dispersion or as a solid particle dye dispersion. They may also be incorporated into a polymer.

In the photographic element, they be may included in any layer of the element.

Anti-halation are often included to improve image sharpness. These non-imaging layers are generally placed between the silver halide emulsion imaging layers and the support. The anti-halation layer is comprised of a hydrophilic gelatin binder, polymer or gelatin mixed with a polymer which contains one or more materials such as soluble dyes, bleachable dyes, finely divided black colloidal silver particles, or other visible or infra-red light absorbing materials. A more complete description of this layer may be found in EP 578,173. This layer absorbs light during the exposing process, which is not absorbed by the silver halide imaging emulsion, to prevent halation. This anti-halation process reduces light scatter, prevents non-imagewise exposure and increases the resultant sharpness of the final image.

After exposure, and during processing, the layer is cleared, either by solubilizing the light absorbing materials, causing them to diffuse out of the element or by chemically bleaching them to eliminate their color.

Any suitable base material may be utilized for the color paper of the invention. Typically, base materials are formed of paper or polyester. The paper may be resin-coated. Further, the paper base material may be coated with reflective materials that will make the image appear brighter to the viewer such as polyethylene impregnated with titanium dioxide. In addition, the paper or resins may contain stabilizers, tints, stiffeners or oxygen barrier providing materials such as polyvinyl alcohol (PVA). The particular base material utilized in the invention may be any material conventionally used in silver halide color papers. Such materials are disclosed in *Research Disclosure* 308119, December 1989, page 1009. Additionally materials like polyethylene naphthalate and the materials described in U.S. Pat. Nos. 4,770,931; 4,942,005; and 5,156,905 may be used.

Inclusion of a hydrophilic colloid layer in the light sensitive photographic element can afford several advantages. A properly designed colloid layer can provide an increase in sharpness, reduce curl and improve image stability.

The hydrophilic colloid layer contains about to 80 percent by weight of a white pigment and from about 15 to about 35 percent by weight of hollow micro spheres having a mean diameter of from about 0.2 to about 2.0 μm. Any suitable white pigment may be used, such as, for example, barium sulfate, zinc oxide, barium stearate, silver flakes, silicates, alumina, calcium carbonate, antimony trioxide, zirconium oxide, zirconium acetyl acetate, sodium zirconium sulfate, kaolin, mica, titanium dioxide, and the like. The anatase and rutile crystal forms of titanium dioxide are preferred. The anatase form is most preferred because of its whiteness. The white pigment should preferably have an average particle size of from 0.1 to about 1.0 μm and most preferably from about 0.2 to about 0.5 μm.

As indicated above, the hydrophilic colloid layer also contains from about 15 to about 35 percent by weight of hollow micro spheres having a mean diameter less than 2 μm preferably from about 0.1 to about 1 μm and most preferably from about 0.25 to about 0.8 μm. The micro spheres are hollow or air containing microcapsular polymers having a polymeric wall. Any suitable polymeric material may be employed, such as, for example, polyvinyl chloride, polystyrene, polyvinyl acetate, vinyl chloride-vinylidene chloride co-polymers, cellulose acetate, ethyl cellulose, novalac resins having a linear polymeric configuration, acrylic resins, such as for example, polymethylmethacrylate, polyacrylamide, and the like, copolymers of any suitable combination of ethylenically unsaturated monomers including those specifically mentioned above, and the like. Particularly suitable micro spheres for use in accordance with this invention are those formed from a copolymer of styrene and acrylic acid and sold by Robm and Haas Company under the trade designation ROPAQUE OP-42, OP-62 and OP-84.

A particularly suitable coating composition for deposition of the hydrophilic colloid layer includes a water dispersion of about 10 to 20 parts by weight of anatase titanium dioxide, a particularly preferred material being a product sold under the trade designation UNITANE 0-310 by Kemira Inc., Savanna Ga., about 0.015 to about 0.045 of a suitable dispersing aid to uniformly aid in the distribution of the solid particles in the dispersion, a particularly useful dispersing aid is a mixture of sodium salt of polycarboxcyclic acid sold under the trade designation DISPEX N-40 by Allied Colloids and tetrasodium pyrophosphate, which is sold under the trade designation TSPP by FMC; about 0.001 to about 0.0025 parts of a suitable biostat agent, a particularly suitable material is one sold under the trade designation Ottasept by Ferro Corp. from about 3 to about 5 parts by weight of gelatin, from about 6.5 to about 8 parts of hollow micro spheres, a particularly suitable material is one sold under the trade designation ROPAQUE OP-84 by the Robm and Haas Company; from about 0.04 to about 0.07 parts of an optical brightener, a particularly suitable material is one sold under the trade designation UVITEX-OB by Ceiba-Geigy; about 0.001 to 0.003 parts of a combination of cyan and magenta tinting pigments sold under the trade designation TINT-AYD WD-2018 by Daniel Products Company and the balance of water in order to make 100 parts by weight of coating composition.

In a preferred method of preparing the coating composition for forming the hydrophilic colloid layer the white pigment, dispersing agents and biocide are intimately mixed in water in a media mill or other suitable high shear apparatus. The pigment dispersion is next mixed with the remainder of components including the micro spheres, the optical brightener, tinting aids, and the like, and then added to the gelatin which has been previously melted. The following table gives a preferred coating melt composition.

TABLE 15

Hydrophilic Colloid Coating Formula

| Ingredient | Dry Wt. (Kg) | Wet Wt. (Kg) |
|---|---|---|
| TiO2 dispersion | 14.39 | 20.56 |
| Water | — | 12.27 |
| Optical Brightener | 3.14 | 9.84 |
| Ropaque OP-84 | 7.2 | 17.99 |
| Tint Ayd WD-2018 | 0.0019 | 0.086 |
| Gelatin | 3.93 | 39.25 |

Polyester supports may be clear or voided. Clear supports such as polyethylene terphthlate manufactured by E. I. DuPont as Mylar™ and by the Eastman Kodak Co. as Estar™. Other clear supports such as polyvinyl acetate, polyvinyl chloride or cast supports such as acetate films in general may be used. These supports may be further treated with a resin coated layer such as polyethylene impregnated with particles of barium sulfate, silicon dioxide or titanium dioxide, or other highly reflective small particles, so as to impart a reflective layer on the surface of the support. This reflective layer may be extruded or coated from an aqueous or non-aqueous solution.

Voided supports, such as E. I. DuPont's Melinex™, may also be used. These supports are formed by premixing the support material with rigid particles such as barium sulfate or polystyrene beads before sheet formation. During sheet formation, the support material is stretched and since the solid particles cannot, they create micro-voids as the material around them is pulled into a sheet. These micro-voids are effective in scattering light and hence result in a reflective support material.

The color paper of the invention may use any conventional peptizer material. A typical material utilized in color paper as a peptizer and carrier is gelatin. Such gelatin may be any of the conventional utilized gelatins for color paper. Preferred are the ossein gelatins.

The color papers of the invention further may contain materials such as typically utilized in color papers including biostats, such as described in U.S. Pat. No. 4,490,462, fungicides, stabilizers, inter layers, overcoat protective layers.

It is specifically contemplated to use in conjunction with elements of the invention an overcoat layer that contains a polydimethylsiloxane fluid (such as Dow Corning DC200™) which has a linear structure and a, molecular weight of between 10,000–15,000, which has been dispersed in gelatin in combination with suitable surfactants. In a preferred embodiment, a conventional oil in water dispersion of the polydimethylsiloxane is made using gelatin as the peptizer and Alkanol XC™ (E. I. DuPont Co.), Fluortenside FT-248™ (Mobay Chemical Co.), and Tergitol 15-S-5™ (Continental Chemical Co.) as surfactants.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes, such as the RA-4 process of Eastman Kodak Company as described in the British Journal of Photography Annual of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable.

In these color photographic systems, the color-forming coupler is incorporated in the light-sensitive photographic emulsion layer so that during development, it is available in the emulsion layer to react with the color developing agent that is oxidized by silver image development. For image-transfer color processes, couplers are used which will produce diffusible dyes capable of being mordanted or fixed in the receiving sheet.

Photographic color light-sensitive materials often utilize silver halide emulsions where the halide, for example chloride, bromide and iodide, are present as mixtures or combinations of at least two halides. The combinations significantly influence the performance characteristics of the silver halide emulsion. As explained in Atwell, U.S. Pat. No. 4,269,927, issued May 26, 1981, silver halide with a high chloride content, that is, light-sensitive materials in which the silver halide grains are at least 80 mole percent silver chloride, possess a number of highly advantageous characteristics. For example, silver chloride possess less native sensitivity in the visible region of the spectrum than silver bromide, thereby permitting yellow filter layers to be omitted from multicolor photographic light-sensitive materials. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps, color development (for color reversal light-sensitive materials, black-and-white first development is necessary) and desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state equilibrium concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that have an effect of restraining development, will be present at a lower concentration in the replenisher or not present at all. In other cases a material may be contained in a replenisher in order to remove the influence of a materials that will wash out of the photographic light-sensitive material. Further, in other cases, for example, the alkali, or the concentration of a chelating agent where there may be no consumption, the component in the replenisher is the same concentration as in the processor tank. Typically the replenisher has a higher pH to account for the acid that is released during development and coupling reaction so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution of the invention is applied:

1) Color developing, bleach-fixing, washing/stabilizing
2) Color developing, bleaching, fixing, washing/stabilizing
3) Color developing, bleaching, bleach-fixing, washing/stabilizing
4) Color developing, bleach-fixing, fixing, washing/stabilizing
5) Color developing, bleaching, bleach-fixing, fixing, washing/stabilizing Among the processing steps indicated above, the steps 1), 2) and 3) are preferably applied. Additionally, each of the steps indicated can be used with multistage applications as described in Hahm, U.S. Pat. No. 4,719,173, with co-current, counter-current, and contraco arrangements for replenishment and operation of the multistage processor. Alternatively, the elements of the present invention are advantageously processed in the processing apparatus described in Bartell et al U.S. Pat. No. 5,179,404.

The color developing solution for use in the present invention may contain aromatic primary amine color developing agent, which are well known and widely used in a variety of color photographic processes. Preferred examples are p-phenylenediamine derivatives. They are usually added to the formulation in a salt form, such as the hydrochloride, sulfate, sulfite, p-toluenesulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit the present invention:

4-amino-3-methyl-N-ethyl-N-(β-hydroxyethyl)aniline sulfate, 4-amino-3-methyl-N-ethyl-N-(β-(methanesulfonamido)ethyl)aniline sesquisulfate hydrate, 4-amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, the first two may preferably be used. There may be some instances where the above mentioned color developing agents may be used in combination so that they meet the purposes of the application.

The color developing agent is generally employed in concentrations of from 0.0002 to 0.2 mole per liter of developing solution and more preferably from about 0.001 to 0.05 mole per liter of developing solution.

The developing solution should also contain chloride ions in the range 0.006 to 0.33 mole per liter, preferably 0.02 to 0.16 moles per liter and bromide ions in the range of zero to 0.001 mole per liter, preferably $2\times10^{-5}$ to $5\times10^{-4}$ mole per liter. The chloride ions and bromide ions may be added directly to the developer or they may be allowed to dissolve out from the photographic material in the developer and may be supplied from the emulsion or a source other than the emulsion.

If chloride is added directly to the color developer, the chloride-ion-supplying salt can be (although not limited to) sodium chloride, potassium chloride, ammonium chloride, lithium chloride, magnesium chloride, manganese chloride, and calcium chloride, with sodium chloride and potassium chloride preferred.

If bromide is added directly to the color developer, the bromide-ion-supplying salt can be (although not limited to) sodium bromide, potassium bromide, ammonium bromide, lithium bromide, calcium bromide, magnesium bromide, and manganese bromide, with sodium bromide and potassium bromide preferred.

The chloride-ions and bromide-ions may be supplied as a counter ion for another component of the developer, for example the counter ion for a stain reducing agent.

Preferably, the pH of the color developer is in the range of 9 to 12, more preferably 9.6 to 11.0 and it can contain other known components of a conventional developing solution.

To maintain the above-mentioned pH, it is preferable to use various buffer agent. Examples of buffer agents that can be mentioned include sodium carbonate, potassium carbonate, sodium bicarbonate, potassium bicarbonate, trisodium-phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). Preferably the amount of buffer agent to be added is 0.1 mole per liter to 0.4 mole per liter.

Additional components of the developer include preservatives to protect the color developing agent from decomposition. The 'preservative' is characterized as a compound that generally can reduce the rate of decomposition of the color developing agent. When it is added to the processing solution for the color photographic material it prevents the oxidation of the color developing agent caused by oxygen in the air. It is preferable that the developer used in the present invention contain an organic preservative. Particular examples include hydroxylamine derivatives (but excluding hydroxylamine, as described later), hydrazines, hydrazides, hydroxamic acids, phenols, hydroxamic acids, aminoketones, sacharides, monoamines, diamines, polyamines, quaternary ammonium salts, nitroxy radicals, alcohols, oximes, diamide compounds, and condensed ring-type amines.

For the preferable organic preservatives mentioned above, typical compounds are mentioned below, however, the present invention is not limited to them. It is desirable that the amount of the compounds mentioned below be added to the developer solution at a concentration of 0.005 to 0.5 mole per liter, and preferably 0.025 to 0.1 mole per liter.

As hydroxylamine derivatives, the following are preferable:

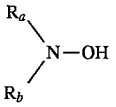

Formula (I)

where $R_a$ and $R_b$ each represent a hydrogen atom, a substituted or unsubstituted alkyl group, a substituted or unsubstituted alkenyl group, a substituted or unsubstituted aryl group, a substituted or unsubstituted heteroaromatic group, they do not represent hydrogen atoms at the same time, and they may bond together to form a heterocyclic ring with the nitrogen atom. The ring structure of the heterocyclic ring is a 5–6 member ring, it is made up of carbon atoms, oxygen atoms, nitrogen atoms, sulfur atoms, etc. and it may be saturated or unsaturated.

It is preferable that $R_a$ and $R_b$ each represent an alkyl group or an alkenyl group having 1 to 5 carbon atoms. As nitrogen containing heterocyclic rings formed by bonding $R_a$ and $R_b$ together examples are a piperidyl group, a pyrolidyl group, an N-alkylpiperazyl group, a morpholyl group, an indolinyl group, and a benzotriazole group.

Preferable substituents of $R_a$ and $R_b$ are a hydroxyl group, an alkoxy group, an alkylsulfonyl group, an arylsulfonyl group, an amido group, a carboxyl group, a sulfo group, a nitro group, and an amino group. Exemplified compounds are:

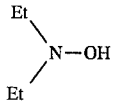

I-1

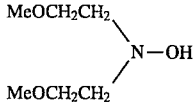

I-2

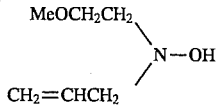

I-3

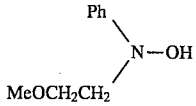

I-4

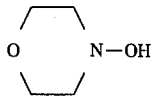

I-5

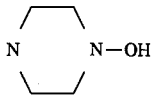

I-6

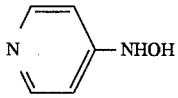

I-7

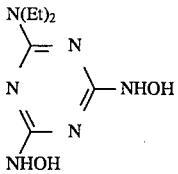

I-8

The hydrazines and hydrazides preferably include those represented by the formula II:

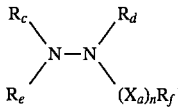

Formula (II)

where $R_c$, $R_d$, and $R_e$, which may be the same or different, represents a hydrogen atom, a substituted or unsubstituted alkyl group, a substituted or unsubstituted aryl group, a substituted or unsubstituted heterocyclic group; $R_f$ represents a hydroxyl group, a hydroxylamino group, a substituted or unsubstituted alkyl group, a substituted or unsubstituted aryl group, a substituted or unsubstituted saturated or unsaturated 5- or 6-member heterocyclic group comprising of a carbon atom, a hydrogen atom, an oxygen atom, a nitrogen atom, a sulfur atom, etc., a substituted or unsubstituted alkoxyl group, a substituted or unsubstituted aryloxy group, a substituted to unsubstituted carbamoyl group, or a substituted or unsubstituted amino group; $X_a$ represents a divalent group selected from —CO—, —SO— and —NHC— and n represents 0 or 1; provided that when n is 0, $R_f$ is selected from an alkyl group, an aryl group, and a heterocyclic group; $R_d$ and $R_e$ may combine to form a heterocylic group.

In formula (II) $R_c$, $R_d$, $R_f$ each preferably represents a hydrogen atom or an alkyl group having from 1 to 10 carbon atoms. $R_c$ and $R_d$ each more preferably represent a hydrogen atom.

$R_f$ preferably represents an alkyl group, an aryl group, an alkoxyl group, a carbamoyl group, or an amino group, and more preferably an alkyl group or a substituted alkyl group. Preferred substituents for alkyl group include a carboxyl group, a sulfo group, a nitro group, an amino group, a phosphono group, etc. $X_a$ preferably represents —CO— or —SO—.

Specific examples of the hydrazines and hydrazides represented by formula (II) are shown below.

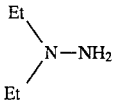
II-1

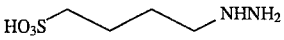
II-2

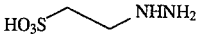
II-3

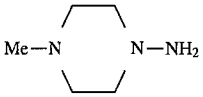
II-4

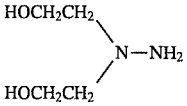
II-5

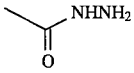
II-6

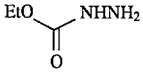
II-7

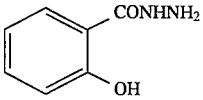
II-8

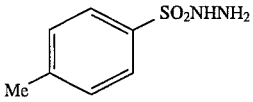
II-9

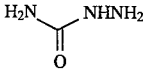
II-10

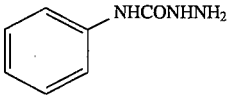
II-11

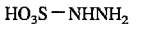
II-12

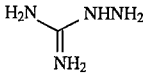
II-13

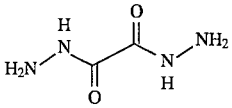
II-14

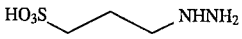
II-15

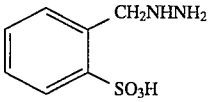
II-16

-continued

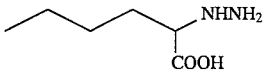
II-17

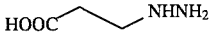
II-18

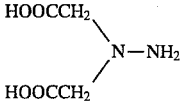
II-19

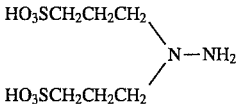
II-20

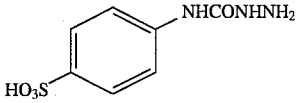
II-21

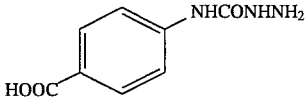
II-22

Other organic preservatives of potential use are mentioned by Yoshida, et. al., in U.S. Pat. No. 5,077,180 with lists of examples from each of the classes for the following organic preservative classes: phenols, hydroxamic acids, aminoketones, sacharides, monoamines, diamines, polyamines, quaternary ammonium salts, nitroxy radicals, alcohols, oximes, diamide compounds, and condensed ring-type amines. Additionally, a sulfinic acid or salt thereof may be used to improve the stability of the color developing agent in concentrated solutions, with examples described by Nakamura et. al in U.S. Pat. No. 5,204,229.

A further ingredient which can optionally be included in the color developing composition to improve the stability of the color developer and assure stable continuous processing represented by formula (III):

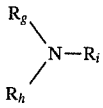
Formula (III)

where $R_g$, $R_h$, and $R_i$ each represents a hydrogen atom, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; or $R_g$ and $R_h$, $R_g$ and $R_i$, or $R_h$ and $R_i$ may combine to form a nitrogen-containing heterocyclic ring. As described in Case et. al. U.S. Pat. No. 4,170,478 a preferred example of formula (III) are alkanolamines, wherein $R_g$ is an hydroxyalkyl group and each of $R_h$ and $R_i$ is a hydrogen atom, an alkyl group, a hydroxyalkyl group, an aryl group, or a $—C_nH_{2n}N(Y)Z$ group wherein n is an integer of from 1 to 6 and each of Y and Z is a hydrogen atom, an alkyl group or an hydroxylalkyl group.

Specific examples of the amine and hydroxylamine compounds represented by formula (III) are shown below.

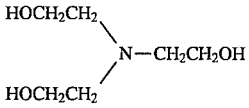
III-1

-continued

III-2 $H_2NCH_2CH_2OH$

III-3 $HOCH_2CH_2-NH-CH_2CH_2OH$

III-4

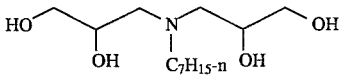

III-5

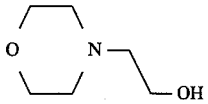

III-6

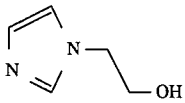

III-7

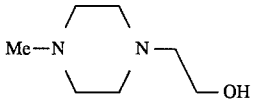

III-8

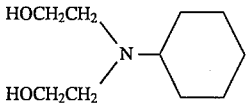

III-9

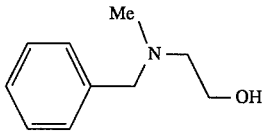

III-10

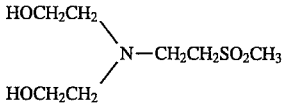

III-11

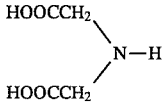

III-12

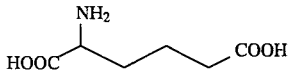

III-13

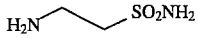

III-14

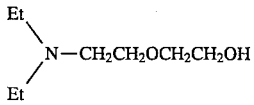

III-15

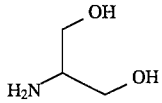

III-16

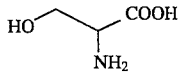

III-17

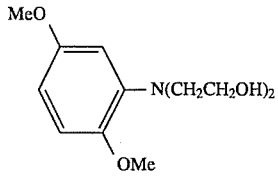

-continued

III-18

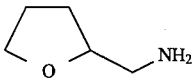

III-19

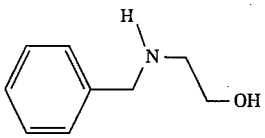

III-20

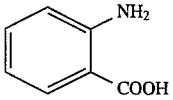

A small amount of sulfite can optionally be incorporated in the developing compositions used with this invention to provide additional protection against oxidation. In view of the fact that sulfite competes in the developer with coupler for oxidized developing agent and can have a resultant effect to decrease the desired image dye formation, it is preferred that the amount of sulfite be very small, for example in the range from zero to 0.04 moles per liter. The use of a small amount of sulfite is especially desirable when the color developing composition is packaged in a concentrated form to preserve the concentrated solution from oxidation.

For use with the current invention it is preferable that the developer is substantially free of hydroxylamine, often used as a developer preservative. This is because hydroxylamine has an undesired effect on the silver development and results in low yields of image dye formation. The expression 'substantially-free from hydroxylamine' means that the developer contains only 0.005 moles per liter or below of hydroxylamine per liter of developer solution.

To improve the clarity of the working developer solution and reduce the tendency for tarring to take place it is preferred to incorporate therein a water-soluble sulfonated polystyrene. The sulfonated polystyrene can be used in the free acid form or in the salt form. The free acid form of the sulfonated polystyrene is comprised of units having the formula:

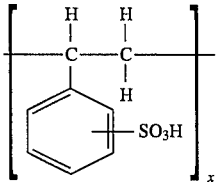

where X is an integer representing the number of repeating units in the polymer chain and is typically in the range from about 10 to about 3,000 and more preferably in the range from about 100 to 1,000.

The salt form of the sulfonated polystyrene is comprised of units having the formula:

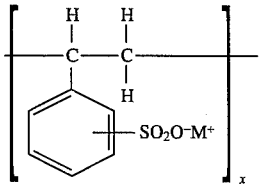

where X is as defined above and M is a monovalent cation, such as, for example, an alkali metal ion.

The sulfonated polystyrenes utilized in the developing compositions with this invention can be substituted with substituents such as halogen atoms, hydroxy groups, and substituted or unsubstituted alkyl groups. For example, they can be sulfonated derivatives of chlorostyrene, alpha-methyl styrene, vinyl toluene, and the like. Neither the molecular weight nor the degree of sulfonation are critical, except that the molecular weight should not be so high nor the degree of sulfonation so low as to render the sulfonated polystyrene insoluble in aqueous alkaline photographic color developing solutions. Typically, the average degree of sulfonation, that is the number of sulfonic acid groups per repeating styrene unit, is in the range from about 0.5 to 4 and more preferably in the range from about 1 to 2.5. A variety of salts of the sulfonated polystyrene can be employed, including, in addition to alkali metal salts, the amine salts such as salts of monoethanolamine, diethanolamine, triethanolamine, morpholine, pyridine, picoline, quinoline, and the like.

The sulfonated polystyrene can be used in the working developer solution in any effective amount. Typically, it is employed in amount of from about 0.05 to about 30 grams per liter of developer solution, more usually in amount of from about 0.1 to about 15 grams per liter, and preferably in amounts of from 0.2 to about 5 grams per liter.

In addition various chelating agents may also be added to the developer to prevent calcium or magnesium from precipitating or to improve the stability of the color developer. Specific examples are shown below:

nitrilotriacetic acid, diethylenetriaminepentaacetic acid, ethylenediaminetetraacetic acid, triethylenetetraaminehexaaacetic acid, N,N,N-trimethylenephosphonic acid, ethylenediamine-N,N,N',N'-tetramethylenephosphonic acid, 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycoletherdiaminetetraacetic acid, hydroxyethylenediaminetriacetic acid, ethylenediamineorthohydroxy-phenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetate N-N'-bis(2-hydroxybenzyl)ethylenediamine-N,N'-diacetic acid, catechol-3,4,6-trisulfonic acid, catechol-3,5-disulfonic acid, 5-sulfosalycylic acid, 4-sulfosalicylic acid.

A particularly useful chelating agents for photographic color developer compositions are the hydroxyalkylidene diphosphonic acid of the formula:

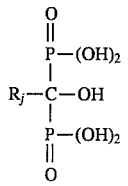

Formula (IV)

where Rj is an alkyl or substituted alkyl group. When Rj is an ethyl group a preferred chelating agent example, is 1-hydroxyethylidene-1,1-diphosphonic acid. The hydroxyalkylidene diphosphonic acid chelating agents can serve as both the chelating agent which functions to sequester calcium and which functions to sequester calcium, as they have the ability to effectively sequester both iron and calcium. As described in Brown, U.S. Pat. No. 3,839,045, they are preferably utilized in combination with small amounts of lithium salts, such as lithium sulfate or lithium chloride.

The chelating agents can be utilized in the form of a free acid or in the form of a water soluble salt form. If desired, the above mentioned chelating agents may be used as a combination of two or more. One preferred combination is demonstrated by Buongiorne et al U.S. Pat. No. 4,975,357 as a combination of the class of polyhydroxy compounds, such as catechol-3,5-disulfonic acid, and of the class of an aminocarboxylic acid, such as ethylenetriamine pentaacetic acid.

It is preferable that the color developer to be used with the present invention be substantially free of benzyl alcohol. Herein the term "substantially free of benzyl alcohol" means that the amount of benzyl alcohol is no more than 2 milliliters per liter, but even more preferably benzyl alcohol should not be contained at all.

It is preferred that the color developer of the present invention contain a triazinyl stilbene type stain reducing agent, which is often referred to as a fluorescent whitening agent. The triazinyl stilbene type of stain reducing agent may be used in an amount within the range of, preferably 0.2 grams to 10 grams per liter of developer solution and more preferably, 0.4 to 5 grams per liter.

In addition, to the color developing solution to be used with the current invention compounds can be added to increase the solubility of the developing agent. Examples of materials, if required, include methyl cellosolve, methanol, acetone, dimethyl formamide, cyclodextrin, dimethyl formamide, diethylene glycol, and ethylene glycol.

It is also mentioned that the color developer solution may contain an auxiliary developing agent together with the color developing agent. Examples of known auxiliary developing agents include for example, N-methyl-p-aminophenol sulfate, phenidone, N,N-diethyl-p-aminophenol hydrochloride and an N,N,N'N'-tetramethyl-p-phenylenediamine hydrochloride. The auxiliary developing agent may be added in an amount within the range of, typically, 0.01 to 1.0 grams per liter of color developer solution.

It may be preferable, if required to enhance the effects of the color developer, to include an anionic, cationic, amphoteric and nonionic surfactant. If necessary, various other components may be added to the color developer solution, including dye-forming couplers, competitive couplers, and fogging agents such as sodium borohydride.

If desired, the color developing agent may contain an appropriate development accelerator. Examples of development accelerators include thioether compound as described in U.S. Pat. No. 3,813,247; quaternary ammonium salts; the amine compounds as described in U.S. Pat. Nos. 2,494,903, 3,128,182, 3,253,919, and 4,230,796; the polyalkylene oxides as described in U.S. Pat. No. 3,532,501.

An antifoggant may be added if required. Antifoggants that can be added include alkali metal halides, such as sodium or potassium chloride, sodium or potassium bromide, sodium or potassium iodide, and organic antifoggants. Representative examples of organic antifoggants include nitrogen-containing heterocyclic compounds such as benzotriazole, 6-nitrobenzimidazole, 5-nitrobenzotriazole, 5-chloro-benzotriazole, 2-thiazolylbenzimidazole, 2-thiazolylmethylbenzimidazole, indazoles, hydroxyazindolizine, and adenine.

With the invention the above-mentioned color developer solutions may be used at a processing temperature of preferably 25° C. to 45° C. and more preferably from 35° C. to 45° C. Further, the color developer solution may be used with a processing time in the developer step of the process with a time of not longer than 120 seconds and preferably within a range from 3 seconds to 60 seconds, and more preferably not shorter than 5 seconds and not longer than 45 seconds.

As previously described, a color developer processing tank in a continuous processor is replenished with a replenisher solution to maintain the correct concentration of color developer solution components. The color developer replenisher solution used with this invention may be replenished in an amount of, ordinarily not more than 500 milliliters per square meter of a light sensitive material. Since replenishment results in a quantity of waste solution, the rate of replenishment is preferably minimized so that waste volume and costs can be minimized. A preferred replenishment rate is within a range of 10 to 215 milliliters per square meter, and more preferably 25 to 160 milliliters per square meter.

Additionally the developer waste volume and material costs may be reduced by recovering the overflow from the developer tank as it is being replenished and treating the overflow solution in a manner so that the overflow solution can be used again as a replenisher solution. In one operating mode, chemicals are added to the overflow solution to make up for the loss of chemicals from that tank solution that resulted from the consumption of chemicals that occurred during the development reactions. Addition of water and the aqueous solutions of the make-up chemicals also have the effect to reduce the concentration of the materials that wash out of the light-sensitive material and are present in the developer overflow. This dilution of materials that wash out of the light-sensitive material prevents concentration of these materials from increasing to concentrations that can lead to undesired photographic effects, reduced solution stability, and precipitates. The method for the regeneration of a developer is described in Kodak Publication No. Z-130, 'Using EKTACOLOR RA Chemicals'. If the materials that wash out of the light-sensitive material are found to increase to an objectionable concentration, the overflow solution can be treated to remove the objectionable material. Ion-exchange resins, cationic, anionic and amphoteric are especially well suited to remove specific components found to be objectionable. The recovery of developer solution overflow can be characterized as the percentage of the original replenisher solution that is recovered and reused, thus a 55% "reuse ratio" indicates that of the original replenisher volume used, 55% of the original volume was recovered and reused. A packaged chemical mix of chemical concentrates can be designed to be used with a designated amount of overflow to produce a replenisher solution for use in the continuous processor. While it is useful to be able to recover any amount of developer overflow solution, it is preferable to be able to recover at least 50% (a 50% reuse ratio) of the developer overflow. It is preferred to have a reuse ratio of 50% to 75%, and it is more preferred to have a reuse ratio of 50% to 95%.

Other preferred embodiments of this invention are described below:

The element wherein said exposure range is at least 0.7 log E.

The element wherein the fraction of exposure range of increasing contrast is at least 75 percent.

The element wherein the fraction of exposure range of increasing contrast is at least 75 percent.

The element having an exposure range of at least 0.75 log E.

The element having an exposure range of at least 0.8 log E.

The element wherein the fraction of exposure range of increasing contrast is at least 80 percent.

The element wherein the fraction of exposure range of increasing contrast is at least 75 percent.

The element wherein the fraction of exposure range of increasing contrast is at least 80 percent.

The element wherein said at least one layer comprises silver halide emulsion comprising silver halide particles of greater than 90 mole percent chloride.

The element wherein said at least one layer comprises silver halide particles of greater than 95 mole percent chloride.

The element which when printed with a color negative film having a spectral sensitivity in the red region of the visible light spectrum of between 610 nm and 645 nm produces pictures of improved color accuracy and higher quality.

The element having a spectral sensitivity in the blue region of the visible light spectrum of between 450 nm and 470 nm.

The invention is shown in the Examples below which are intended to exemplify the invention and not be exhaustive of the performance of the invention. Parts and percentages are by weight unless otherwise indicated.

EXAMPLES

EMULSION PREPARATION

The emulsions for the following examples use conventional double-jet precipitation techniques employing thioether silver halide ripening agents of the type disclosed in U.S. Pat. No. 3,271,157.

Emulsion 1a:

A reaction vessel containing 6.9 liters of a 2.8 percent by weight gelatin aqueous solution and 1.9 grams of 1,8-dihydroxy-3,6-dithiaoctane was adjusted to a temperature of 68° C., pH of 5.8, and a pAg of 7.2 by the addition of sodium chloride solution. A 3.75 molar aqueous solution of silver nitrate and a 3.75 molar aqueous solution of sodium chloride were simultaneously run into the reaction vessel with vigorous stirring. The flow rates increased from 0.193 moles/minute to 0.332 moles/minute while the silver potential was controlled at 7.2 pAg. The emulsion was washed to remove excess salts. A total of 10 moles of silver chloride emulsion was precipitated. The emulsion having cubic morphology and 0.78 micron average cubic edge length.

Emulsion 1b:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride were simultaneously run into the reaction vessel with vigorous stirring. The flow rates held constant at 0.50 moles/minute and the silver potential was controlled at 7.2 pAg. The emulsion was washed to remove excess salts. A total of 10 moles of silver chloride emulsion was precipitated. The emulsion having cubic morphology and 0.39 micron average cubic edge length.

Emulsion 1c:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride were simultaneously run into the reaction vessel with vigorous stirring. The flow rates held constant at 0.50 moles/ minute and the silver potential was controlled at 7.2 pAg. Additionally, an aqueous solution of $Cs_2OsNOCl_5$ was separately added to the emulsion kettle during the addition of the salt and silver using a separate pump. The total amount of $Cs_2OsNOCl_5$ added to the emulsion was the equivalent of $7.54\times10^{-8}$ moles. The emulsion was washed to remove excess salts. A total of 10 moles of silver chloride emulsion was precipitated. The emulsion having cubic morphology and 0.39 micron average cubic edge length.

Emulsion 1d:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride were simultaneously run into the reaction vessel with vigorous stirring. The flow rates held constant at 0.50 moles/minute and the silver potential was controlled at 7.2 pAg. Additionally, an aqueous solution of $Cs_2OsNOCl_5$ was separately added to the emulsion kettle during the addition of the salt and silver using a separate pump. The total amount of $Cs_2OsNOCl_5$ added to the emulsion was the equivalent of $4.52\times10^{-7}$ moles. The emulsion was washed to remove excess salts. A total of 10 moles of silver chloride emulsion was precipitated. The emulsion having cubic morphology and 0.39 micron average cubic edge length.

Emulsion 1e:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride containing $Cs_2Os(NO)Cl_5$ and $K_4Ru(CN)_6$ were simultaneously run into the reaction vessel with vigorous stirring. The amounts of $Cs_2Os(NO)Cl_5$ and $K_4Ru(CN)_6$ were adjusted so that their final concentrations in the emulsion were $1.51\times10^{-8}$ moles per mole of silver chloride and $5.00\times10^{-5}$ moles per mole of silver chloride. The flow rates held constant at 0.50 moles/minute and the silver potential was controlled at 7.2 pAg. The emulsion was washed to remove excess salts. A total of 10 moles of silver chloride emulsion was precipitated. The emulsion having cubic morphology and 0.39 micron average cubic edge length.

Emulsion 1f:

A reaction vessel containing 5.7 liters of a 3.9 percent by weight gelatin aqueous solution and 1.44 grams of 1,8-dihydroxy-3,6-dithiaoctane was adjusted to a temperature of 46° C., pH of 5.8, and a pAg of 7.2 by the addition of sodium chloride solution. A 2.00 molar aqueous solution of silver nitrate and a 2.00 molar aqueous solution of sodium chloride containing into which was dissolved $Cs_2Os(NO)Cl_5$ and $K_4Ru(CN)_6$ were simultaneously run into the reaction vessel with vigorous stirring. The amounts of $Cs_2Os(NO)Cl_5$ and $K_4Ru(CN)_6$ were adjusted so that their final concentrations in the emulsion were $6.79\times10^{-9}$ moles per mole of silver chloride and $5.00\times10^{-5}$ moles per mole of silver chloride. The flow rates held constant at 0.50 moles/minute and the silver potential was controlled at 7.2 pAg. The emulsion was washed to remove excess salts. A total of 10 moles of silver chloride emulsion was precipitated. The emulsion having cubic morphology and 0.39 micron average cubic edge length.

Emulsion 1g:

Emulsion 1g was prepared in the same manner as Emulsion 1b except an aqueous solution of $Cs_2OsNOCl_5$ was added during the time where the silver and salts were added so that the final concentration of $Cs_2OsNOCl_5$ was $7.54\times10^{-9}$ moles per mole of emulsion.

Emulsion 1h:

Emulsion 1h was prepared in the same manner as Emulsion 1b except an aqueous solution of $K_2IrCl_6$ was added during the time where the silver and salts were added so that the final concentration of $K_2IrCl_6$ was $7.58\times10^{-9}$ moles per mole of emulsion.

Emulsion 1i:

A reaction vessel containing 6.9 liters of a 2.8 percent by weight gelatin aqueous solution and 1.9 grams of 1,8-dihydroxy-3,6-dithiaoctane was adjusted to a temperature of 68° C., pH of 5.8, and a pAg of 7.2 by the addition of sodium chloride solution. A 3.75 molar aqueous solution of silver nitrate and a 3.75 molar aqueous solution of sodium chloride were simultaneously run into the reaction vessel with vigorous stirring. The flow rates increased from 0.193 moles/minute to 0.332 moles/minute, while the silver potential was controlled at 7.2 pAg. At the point in time equivalent to 93% of the silver run, 7.65 ml of 0.392 molar aqueous solution of potassium bromide was rapidly added to the emulsion precipitation kettle. The final concentration of bromide was 0.3 mole percent. The emulsion was washed to remove excess salts. A total of 10 moles of silver chlorobromide emulsion was precipitated. The emulsion having a generally cubic morphology and 0.78 micron average cubic edge length.

Emulsion 1j:

A reaction vessel containing 6.9 liters of a 2.8 percent by weight gelatin aqueous solution and 1.9 grams of 1,8-dihydroxy-3,6-dithiaoctane was adjusted to a temperature of 68° C., pH of 5.8, and a pAg of 7.2 by the addition of sodium chloride solution. A 3.75 molar aqueous solution of silver nitrate and a 3.75 molar aqueous solution of sodium chloride were simultaneously run into the reaction vessel with vigorous stirring. The flow rates increased from 0.193 moles/minute to 0.332 moles/minute, while the silver potential was controlled at 7.2 pAg. At the point in time equivalent to 93% of the silver run, 7.65 ml of 0.392 molar aqueous solution of potassium iodide was rapidly added to the emulsion precipitation kettle. The final concentration of iodide was 0.3 mole percent. The emulsion was washed to remove excess salts. A total of 10 moles of silver chloroiodide emulsion was precipitated. The emulsion having 0.78 micron average edge length.

Emulsion 1k:

Emulsion 1k was prepared in the same manner as Emulsion 1j except an aqueous solution of $Cs_2OsNOCl_5$ was simultaneously added during the first 70% of the silver halide growth stage so that the final concentration of $Cs_2OsNOCl_5$ was $6.03\times10^{-10}$ moles per mole of emulsion.

Emulsion 2:

A reaction vessel containing 4.0 liters of a 5.6 percent by weight gelatin aqueous solution was adjusted to a temperature of 40° C., pH of 5.8, and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 milliliter (ml)/minute. The double jet precipitation continued for 3 minutes at a controlled pAg of 8.86, after which the precipitation was continued for 17 minutes during which the pAg was decreased linearly from 8.86 to 8.06. A total of 10 moles of silver bromide emulsion was precipitated. The silver bromide having an average grain size of 0.05 microns.

Emulsion 2b:

Emulsion 2b was prepared in a manner identical to that of emulsion 2 except that a solution of $K_2IrCl_6$ was added during the addition of salt and silver in a concentration resulting in the addition of $4.49\times10^{-6}$ moles per mole of silver.

Emulsion 2c:

Emulsion 2c was prepared in a manner identical to that of emulsion 2 except that a solution of $Cs_2OsNOCl_5$ was added during the addition of salt and silver in a concentration resulting in the addition of $1.66\times10^{-6}$ moles per mole of silver.

Emulsion 3a:

Emulsion 3a was prepared like Emulsion 2 except a solution of 12.9 grams of $K_4Fe(CN)_6.3H_2O$ in 125 ml water was added at a constant flow rate during the initial 35% of the double jet precipitation. A total of 10 moles of a 0.05 micron particle diameter silver bromide emulsion was produced.

Emulsion 3b:

Emulsion 3b was prepared like Emulsion 2 except a solution of 12.6 grams of $K_4Ru(CN)_6$ in 125 ml water was added at a constant flow rate during the initial 35% of the double jet precipitation. A total of 10 moles of a 0.05 micron particle diameter silver bromide emulsion was produced.

Emulsion 4:

Emulsion 4 was prepared exactly as Emulsion 2 except a solution of $1.65\times10^{-5}$ moles of $Cs_2Os(NO)Cl_5$ dissolved in 125 ml water was added at a constant flow rate during the precipitation. This triple jet precipitation produced 10 moles of a 0.05 micron particle diameter silver bromide emulsion.

Emulsion 5:

Emulsion 5 was prepared exactly as Emulsion 2 except a solution of $1.65\times10^{-4}$ moles of $Cs_2Os(NO)Cl_5$ dissolved in 125 ml water was added at a constant flow rate during the precipitation. This triple jet precipitation produced 10 moles of a 0.05 micron particle diameter silver bromide emulsion.

Emulsion 6: Chemical and blue spectral sensitization

Emulsion 6 was prepared by chemically and spectrally sensitizing emulsion 1a using the following procedure:

A 1.0 mole sample of emulsion 1a was heated to 40° C., and spectrally sensitized by the addition of $2.52\times10^{-4}$ moles of blue spectral sensitizing Dye A, followed by addition of 45.0 millimoles (mmole) of emulsion 2, 33.75 mmole of emulsion 3a and 11.25 mmole of emulsion 4. The temperature was then raised to 60° C. to accelerate recrystalization of the silver bromide emulsions onto the surfaces of the host grain. The emulsion was then cooled to 40° C. Subsequently, $1.05\times10^{-5}$ moles of sodium thiosulfate pentahydrate and $2.66\times10^{-5}$ moles of 4-hydroxy- 6-methyl-1,3,3a,7-tetraazaindene were added and the emulsion heated at 60° C. for 30 minutes to achieve optimal chemical sensitization. After cooling the emulsion to 40° C., the addition of $3.57\times10^{-4}$ moles of 1-(3-acetamidophenyl)-5-mercaptotetrazole completed the sensitization.

Emulsion 7: Chemical and blue spectral sensitization

Emulsion 7 was prepared in the same way as emulsion 6 except that the amounts of emulsions 2 and 3a were changed as follows: 67.5 mmole of emulsion 2, 11.25 mmole of emulsion 3a and, additionally, emulsion 5 was added in place of emulsion 4 in the amount of 11.25 mmole.

Emulsion 8: Chemical and green spectral sensitization

Emulsion 8 was prepared by chemically and spectrally sensitizing emulsion 1a using the following procedure:

A 1.0 mole sample of emulsion 1a was heated to 40° C., and spectrally sensitized by the addition of $2.46\times10^{-4}$ moles of spectral sensitizing Dye A and $1.91\times10^{-5}$ moles of green spectral sensitizing Dye B, followed by addition of 39.375 mmole of emulsion 2, 33.75 mmole of emulsion 3a and 16.875 mmole of emulsion 4. The temperature was then raised to 60° C. to accelerate recrystalization of the silver bromide emulsions onto the host grain surfaces. After cooling the emulsion to 40° C., 1.42×10–5 moles of sodium thiosulfate pentahydrate and $5.49\times10^{-5}$ moles of 4-hydroxy-6-methyl-1,3,3a,7-tetraazaindene were added and the emulsion re-heated to 60° C. for 30 minutes to achieve optimal chemical sensitization. After cooling the emulsion to 40° C., the addition of $3.57\times10^{-4}$ moles of 1-(3-acetamidophenyl)-5-mercaptotetrazole completed the sensitization.

Emulsion 9: Chemical and green spectral sensitization

Emulsion 9 was prepared in the same way as emulsion 8 except that the amounts of emulsions 2 and 3a were changed as follows: 69.75 mmole of emulsion 2, 11.25 mmole of emulsion 3a and, additionally, emulsion 5 was added in place of emulsion 4 in the amount of 9.0 mmole.

Emulsion 10: Chemical and red spectral sensitization

Emulsion 10 was prepared by chemically and spectrally sensitizing emulsion 1a using the following procedure:

A 1.0 mole sample of emulsion 1a was heated to 40° C., and spectrally sensitized by the addition of $2.46\times10^{-4}$ moles of spectral sensitizing Dye A and $1.01\times10^{-5}$ moles of red spectral sensitizing Dye C, followed by addition of 39.375 mmole of emulsion 2, 33.75 mmole of emulsion 3a and 16.875 mmole of emulsion 4. The temperature was then raised to 60° C. to accelerate recrystalization of the silver bromide emulsion onto the host grain surfaces. After cooling the emulsion to 40° C., $1.05\times10^{-5}$ moles of sodium thiosulfate pentahydrate and $5.49\times10^{-5}$ moles of 4-hydroxy-6-methyl-1,3,3a,7-tetraazaindene were added and the emulsion heated at 60° C. for 30 minutes to achieve optimal sensitization. After cooling the emulsion to 40° C., the addition of $3.57\times10^{-4}$ moles of 1-(3-acetamidophenyl)-5-mercaptotetrazole completed the sensitization.

Emulsion 11: Chemical and red spectral sensitization

Emulsion 11 was prepared in the same way as emulsion 10 except that the amounts of emulsions 2 and 3a were changed as follows: 67.5 mmole of emulsion 2, 11.25 mmole of emulsion 3a and, additionally, emulsion 5 was added in place of emulsion 4 in the amount of 11.25 mmole.

Emulsion 12: Chemical and red spectral sensitization

Emulsion 1b (1.0M) was adjusted to a pH and pAg of 4.3 and 7.6 with nitric acid and potassium chloride solutions respectively. Compound S was then added at $3.36\times10^{-4}$ moles. After stirring for 15 minutes, $4.52\times10^{-8}$ moles of $Cs_2OsNOCl_5$ dissolved in water was added. The temperature was then increased to 65° C. and 0.011 moles of emulsion 2 was added. Then, the emulsion was conventionally sensitized with a gold (aurous bis(1,4,5-trimethyl-1,2,4-triazolium-3-thiolate)tetrafluoroborate at $5.79\times10^{-6}$ moles) plus sulfur (sodium thiosulfate pentahydrate at $4.03\times10^{-3}$ moles) sensitization. After continued stirring, $7.28\times10^{-5}$ moles of sensitizing dye D was added followed by $8.87\times10^{-4}$ moles of 1-(3-acetamidophenyl)-5-mercaptotetrazole. The temperature was lowered to 40° C. and the pH of the emulsion was adjusted to 5.6 with sodium hydroxide solution.

Emulsion 13: Chemical and red spectral sensitization

Emulsion 13 was made using a procedure identical to emulsion 12 except the pH and pAg of the emulsion were adjusted to 5.6 and 7.6 respectively. Additionally, $1.66\times10^{-7}$ moles of $Cs_2OsNOCl_5$ was added instead of $4.52\times10^{-8}$ moles.

Emulsion 14: Chemical and green spectral sensitization

Emulsion 1b (1.0M) was adjusted to a pH of 4.3 and pAg of 7.6 with nitric acid and potassium chloride solutions respectively. Sensitizing dye B was then added at 2.82×10–4 moles. After stirring for 20 minutes, a mixture of emulsion 2 and emulsion 5 was added and the temperature was then increased to 60° C. The mixture of emulsions 2 and 5 added 0.5M % of silver bromide and $3.02\times10^{-8}$ moles of $Cs_2OsNOCl_5$. Then, the emulsion was conventionally sensitized with a gold (aurous bis(1,4,5-trimethyl- 1,2,4-triazolium-3-thiolate)tetrafluoroborate at $1.75\times10^{-3}$ moles) plus sulfur (sodium thiosulfate pentahydrate at $4.03\times10^{-3}$ moles) sensitization. After continued stirring, $1.28\times10^{-3}$ moles of 1-(3-acetamidophenyl)- 5-mercaptotetrazole was added. The temperature was lowered to 40° C. and the sensitization was completed.

Emulsion 15: Chemical and green spectral sensitization

Emulsion 15 was made using a procedure identical to emulsion 14 except that the mixture of emulsions 2 and 5 was adjusted so that the amount of $Cs_2OsNOCl_5$ added was $9.05\times10^{-8}$ moles.

Emulsion 16: Chemical and green spectral sensitization

Emulsion 1b (1.0M) was adjusted to a pH of 4.3 and pAg of 7.6 with nitric acid and potassium chloride solutions respectively. Sensitizing dye B was then added at $2.82\times10^{-4}$ moles. After stirring for 20 minutes, a mixture of emulsion 2 and emulsion 5 was added and the temperature was then increased to 60° C. The mixture of emulsions 2 and 5 added 0.5M % of silver bromide and $3.02\times10^{-8}$ moles of $Cs_2OsNOCl_5$. Then, the emulsion was conventionally sensitized with a colloidal gold sulfide suspension $3.52\times10^{-5}$ moles. After continued stirring, $1.28\times10^{-3}$ moles of 1-(3-acetamidophenyl)-5-mercaptotetrazole was added. The temperature was lowered to 40° C. and the sensitization was completed.

Emulsion. 17: Chemical and green spectral sensitization

Emulsion 17 was made using a procedure identical to emulsion 16 except that the mixture of emulsions 2 and 5 was adjusted so that the amount of $Cs_2OsNOCl_5$ added was $9.05\times10^{-8}$ moles instead of $3.02\times10^{-8}$ moles.

Emulsion 18: Chemical and green spectral sensitization

Emulsion 1c (1.0M) was adjusted to a pH of 4.3 and pAg of 7.6 with nitric acid and potassium chloride solutions respectively. Sensitizing dye B was then added at $2.82\times10^{-4}$ moles. After stirring for 20 minutes, the emulsion was conventionally sensitized with a colloidal gold sulfide suspension at $3.52\times10^{-5}$ moles and the temperature was raised to 60° C. and held constant for 20 minutes. After continued stirring, $1.28\times10^{-3}$ moles of 1-(3-acetamidophenyl)-5-mercaptotetrazole was added, followed by an aqueous solution of potassium bromide in an amount equivalent to 0.5M %. The temperature was subsequently lowered to 40° C. and the sensitization was completed.

Emulsion 19: Chemical and green spectral sensitization

Emulsion 19 was made using a procedure identical to emulsion 18 except that emulsion 1d was used in place of emulsion 1c.

Emulsion 20: Chemical and green spectral sensitization

Emulsions 1c and 1d were combined by weighing 0.5 moles of each into a container and adjusted to a pH of 4.3 and pAg of 7.6 with nitric acid and potassium chloride solutions respectively. Sensitizing dye B was then added at $2.82\times10^{-4}$ moles. After stirring for 20 minutes, the emulsion was conventionally sensitized with a colloidal gold sulfide suspension at $3.52\times10^{-5}$ moles and the temperature was raised to 60° C. and held constant for 20 minutes. After continued stirring, $1.28\times10^{-3}$ moles of 1-(3-acetamidophenyl)-5-mercaptotetrazole was added, followed by an aqueous solution of potassium bromide in an amount equivalent to 0.5M %. The temperature was subsequently lowered to 40° C. and the sensitization was completed.

Emulsion 21: Chemical and green spectral sensitization

Emulsion 1c (1.0M) was adjusted to a pH of 4.3 and pAg of 7.6 with nitric acid and potassium chloride solutions respectively. Sensitizing dye B was then added at $2.82\times10^{-4}$ moles. After stirring for 20 minutes, the emulsion was conventionally sensitized with a gold (aurous bis(1,4,5-trimethyl-1,2,4-triazolium-3-thiolate)tetrafluoroborate at $1.75\times10^{-3}$ moles) plus sulfur (sodium thiosulfate pentahydrate at $4.03\times10^{-3}$ moles) sensitization and the temperature was raised to 60° C. and held constant for 20 minutes. After continued stirring, $1.28\times10^{-3}$ moles of 1-(3-acetamidophenyl)-5-mercaptotetrazole was added, followed by an aqueous solution of potassium bromide in an amount equivalent to. 0.5M %. The temperature was subsequently lowered to 40° C. and the sensitization was completed.

Emulsion 22: Chemical and green spectral sensitization

Emulsion 22 was made using a procedure identical to emulsion 21 except that emulsion 1d was used in place of emulsion 1c.

Emulsion 23: Chemical and red spectral sensitization

Emulsion 1g (1.0M) at 40° C. was adjusted to a pH of 4.3 and a pAg of 7.6 with nitric acid and potassium chloride solutions respectively. Compound S ($2.24\times10^{-4}$ moles) was then added. After stirring for 20 minutes, the temperature was increased to 65° C. and after stirring an additional 10 minutes, a mixture of emulsion 2 ($9.85\times10^{-3}$ moles) and emulsion 2b ($1.15\times10^{-3}$ moles) was added. The emulsion was then sensitized with gold (aurous bis(1,4,5-trimethyl 1,2,4-triazolium-3-thiolate)tetrafluoroborate) at $7.37\times10^{-6}$ moles and sulfur (sodium thiosulfate pentahydrate) at $3.22\times10^{-6}$ moles. After continued stirring, $7.28\times10^{-5}$ moles of sensitizing dye D was added followed by $9.50\times10^{-4}$ moles of 1-(3-acetamidophenyl)-5-mercaptotetrazole. The temperature was lowered to 40° C. and the pH was adjusted to 5.6 with sodium hydroxide solutions.

Emulsion 24: Chemical and blue spectral sensitization

Emulsion 24 was prepared by chemically and spectrally sensitizing a pure chloride cubic emulsion having an average grain size of 1.0u using the following procedure:

An 0.3 mole sample of emulsion was heated to 40° C., and the pH and pAg adjusted to 4.3 and 7.6 with dilute nitric acid and potassium chloride respectively. A colloidal gold sulfide suspension ($8.4\times10^{-7}$ moles) was added and the temperature raised to 60° C. After 20 minutes of chemical ripening, blue spectral sensitizing dye A3 ($9.0\times10^{-5}$ moles) was added followed by the addition of $2.43\times10^{-4}$ moles of 1-(3-acetamidophenyl)-5-mercaptotetrazole. The addition of 1.0M % of emulsion 2 completed the sensitization and after recrystallization the temperature was reduced to 40° C.

Emulsion 25: Chemical and blue spectral sensitization

Emulsion 25 was prepared by chemically and spectrally sensitizing a pure chloride cubic emulsion having an average grain size of 1.0μ using the following procedure:

An 0.3 mole sample of emulsion was heated to 40° C., and the pH and pAg adjusted to 4.3 and 7.6 with dilute nitric acid and potassium chloride respectively. A colloidal gold sulfide suspension ($8.4\times10^{-7}$ moles) was added and the temperature raised to 60° C. After 20 minutes of chemical ripening, a mixture of blue spectral sensitizing dyes A and A2 ($2.25\times10^{-5}$ moles and $6.75\times10^{-5}$ moles respectively) was added followed by the addition of $2.43\times10^{-4}$ moles of 1-(3-acetamidophenyl)-5-mercaptotetrazole. The addition of 1.0M % of emulsion 2 completed the sensitization and after recrystallization the temperature was reduced to 40° C.

Emulsion 26: Chemical and blue spectral sensitization

Emulsion 26 was prepared by chemically and spectrally sensitizing a pure chloride cubic emulsion having an average grain size of 1.0μ and containing $6.79\times10^{-10}$ moles of $Cs_2OsNOCl_5$ per mole of silver using the following procedure:

An 0.3 mole sample of emulsion was heated to 40° C., and the pH and pAg adjusted to 4.3 and 7.6 with dilute nitric acid and potassium chloride respectively. A colloidal gold sulfide suspension ($8.4\times10^{-7}$ moles) was added and the temperature raised to 60° C. After 20 minutes of chemical ripening, blue spectral sensitizing dye A3 ($9.0\times10^{-5}$ moles) was added followed by the addition of $2.43\times10^{-4}$ moles of 1-(3-acetamidophenyl)-5-mercaptotetrazole. The addition of 1.0M % of emulsion 2 completed the sensitization and after recrystallization the temperature was reduced to 40° C.

Emulsion 27: Chemical and blue spectral sensitization

Emulsion 27 was prepared by chemically and spectrally sensitizing a pure chloride cubic emulsion having an average grain size of 1.0μ and containing $3.14\times10^{-9}$ moles of $Cs_2OsNOCl_5$ per mole of silver using the following procedure:

An 0.3 mole sample of emulsion was heated to 40° C., and the pH and pAg adjusted to 4.3 and 7.6 with dilute nitric acid and potassium chloride respectively. A colloidal gold sulfide suspension ($8.4\times10^{-7}$ moles) was added and the temperature raised to 60° C. After 20 minutes of chemical ripening, blue spectral sensitizing dye A3 ($9.0\times10^{-5}$ moles) was added followed by the addition of $2.43\times10^{-4}$ moles of 1-(3-acetamidophenyl)-5-mercaptotetrazole. The addition of 1.0M % of emulsion 2 completed the sensitization and after recrystallization the temperature was reduced to 40° C.

Emulsion 28: Chemical and red spectral sensitization

To a pure silver chloride cubic emulsion having an edge length of 0.38μ which had been precipitated using conventional double jet techniques, was added 59.0 mg/Ag-M of a colloidal suspension of gold sulfide as a chemical sensitizer. The emulsion temperature was then raised to 65° C. to effect sensitization. During the sensitization process, $1.28\times10^{-3}$ moles of 1-(3-acetamidophenyl)- 5-mercaptotetrazole and 1.0 moles of an aqueous solution of KBr per Ag-M was added. The temperature was lowered to 40° C. and the pH was adjusted to 5.6 with sodium hydroxide solutions. A red spectral sensitizing dye (Dye C) was added in the amount of $3.08\times10^{-5}$ moles per Ag-M to complete the sensitization.

Emulsion 29: Chemical and green spectral sensitization

To a pure silver chloride cubic emulsion having an edge length of 0.28μ which had been precipitated using conventional double jet techniques, was added sensitizing dye B in the amount of $4.95\times10^{-4}$ moles per Ag-M, followed by a colloidal suspension of gold sulfide as a chemical sensitizer in the amount of 20.3 mg per Ag-M. The emulsion temperature was then raised to 70° C. to effect sensitization. After the sensitization process, $1.62\times10^{-3}$ moles of 1-(3-acetamidophenyl)-5-mercaptotetrazole and 0.5 moles of an aqueous solution of KBr per Ag-M was added.

Emulsion 30: Chemical and blue spectral sensitization

To a pure silver chloride cubic emulsion having an edge length of 0.78μ which had been precipitated using conventional double jet techniques, was added a colloidal suspension of gold sulfide as a chemical sensitizer in the amount of 3.9 mg per Ag-M. The emulsion temperature was then raised to 60° C. to effect sensitization. During the sensitization process, $2.88\times10^{-4}$ moles of 1-(3-acetamidophenyl)- 5-mercaptotetrazole and 0.80 moles of an aqueous solution of KBr per Ag-M was added.

Emulsion 31

To one mole of a pure silver chloride cubic emulsion having an edge length of 1.19μ which had been precipitated using conventional double jet techniques and contains $1.09\times10^{-9}$ moles of $Cs_2OsNOCl_5$, was added a colloidal suspension of gold sulfide as a chemical sensitizer in the amount of 1.51 mg per Ag-M. The emulsion temperature was then raised to 60° C. to effect sensitization. During the sensitization process, $2.71\times10^{-4}$ moles of blue spectral sensitizing dye A3 was added followed by $1.94\times10^{-4}$ moles of 1-(3-acetamidophenyl)-5-mercaptotetrazole, a solution of $5.0\times10^{-8}$ moles of $K_2IrCl_6$ and 0.0080 moles of emulsion 2.

Emulsion 32:

To one mole of a pure silver chloride cubic emulsion having an edge length of 0.78μ which had been precipitated using conventional double jet techniques and contains $1.66\times10^{-9}$ moles of $Cs_2OsNOCl_5$, was added a colloidal suspension of gold sulfide as a chemical sensitizer in the amount of 2.05 mg per Ag-M. The emulsion temperature was then raised to 60° C. to effect sensitization. During the sensitization process, $5.05\times10^{-4}$ moles of blue spectral sensitizing dye A3 was added followed by $2.96\times10^{-4}$ moles of 1-(3-acetamidophenyl)-5-mercaptotetrazole, a solution of $7.6\times10^{-8}$ moles of $K_2IrCl_6$ and 0.0122 moles of emulsion 2.

Emulsion 33:

To one mole of a pure silver chloride cubic emulsion having an edge length of 0.78μ which had been precipitated using conventional double jet techniques and contains $2.85\times10^{-9}$ moles of $Cs_2OsNOCl_5$, was added a colloidal suspension of gold sulfide as a chemical sensitizer in the amount of 2.05 mg per Ag-M. The emulsion temperature was then raised to 60° C. to effect sensitization. During the sensitization process, $5.05\times10^{-4}$ moles of blue spectral sensitizing dye A3 was added followed by $2.96\times10^{-4}$ moles of 1-(3-acetamidophenyl)-5-mercaptotetrazole, a solution of $7.6\times10^{-8}$ moles of $K_2IrCl_6$ and 0.0122 moles of emulsion 2.

Emulsion 34:

To one mole of a pure silver chloride cubic emulsion having an edge length of 0.54μ which had been precipitated using conventional double jet techniques and contains $3.95\times10^{-9}$ moles of $Cs_2OsNOCl_5$, was added $1.80\times10^{-4}$ moles of green spectral sensitizing dye Dye B, followed by a colloidal suspension of gold sulfide as a chemical sensitizer in the amount of 2.95 mg per Ag-M. The emulsion temperature was then raised to 70° C. to effect sensitization. During the sensitization process, $7.71\times10^{-4}$ moles of 1-(3-acetamidophenyl)-5-mercaptotetrazole was added followed by solutions of $3.1\times10^{-8}$ moles of $K_2IrCl_6$ and 0.005 moles of emulsion 2.

Emulsion 35:

To one mole of a pure silver chloride cubic emulsion having an edge length of 0.54μ which had been precipitated using conventional double jet techniques and contains $9.36\times10^{-9}$ moles of $Cs_2OsNOCl_5$, was added $1.80\times10^{-4}$ moles of green spectral sensitizing dye Dye B, followed by a colloidal suspension of gold sulfide as a chemical sensitizer in the amount of 2.95 mg per Ag-M. The emulsion temperature was then raised to 70° C. to effect sensitization. During the sensitization process, $7.71\times10^{-4}$ moles of 1-(3-acetamidophenyl)-5-mercaptotetrazole was added followed by solutions of $3.1\times10^{-8}$ moles of $K_2IrCl_6$ and 0.005 moles of emulsion 2.

Emulsion 36:

To one mole of a pure silver chloride cubic emulsion having an edge length of 0.54μ which had been precipitated using conventional double jet techniques and contains $2.11\times10^{-8}$ moles of $Cs_2OsNOCl_5$, was added $1.80\times10^{-4}$ moles of green spectral sensitizing dye Dye B, followed by a colloidal suspension of gold sulfide as a chemical sensitizer in the amount of 2.95 mg per Ag-M. The emulsion temperature was then raised to 70° C. to effect sensitization. During the sensitization process, $7.71\times10^{-4}$ moles of 1-(3-acetamidophenyl)-5-mercaptotetrazole was added followed by solutions of $3.1\times10^{-8}$ moles of $K_2IrCl_6$ and 0.005 moles of emulsion 2.

Emulsion 37:

To one mole of a pure silver chloride cubic emulsion having an edge length of 0.62μ which had been precipitated using conventional double jet techniques and contains $5.54\times10^{-9}$ moles of $Cs_2OsNOCl_5$, a colloidal suspension of gold sulfide as a chemical sensitizer in the amount of 46.1 mg per Ag-M. The emulsion temperature was then raised to 65° C. to effect sensitization. During the sensitization process, $6.59\times10^{-4}$ moles of 1-(3-acetamidophenyl)- 5-mercaptotetrazole was added followed by an aqueous solution containing $1.78\times10^{-4}$ moles of compound S, $2.05\times10^{-8}$ moles of $K_2IrCl_6$ and 0.011 moles of emulsion 2. After the emulsion had been cooled to 40° C., a mixture of red spectral sensitizing dyes was added to complete the sensitization process. The mixture was comprised of $1.81\times10^{-4}$ moles of dye C and $1.66\times10^{-5}$ moles of dye D.

Emulsion 38:

To one mole of a pure silver chloride cubic emulsion having an edge length of 0.62μ which had been precipitated using conventional double jet techniques and contains $1.89\times10^{-8}$ moles of $Cs_2OsNOCl_5$, a colloidal suspension of gold sulfide as a chemical sensitizer in the amount of 46.1 mg per Ag-M. The emulsion temperature was then raised to 65° C. to effect sensitization. During the sensitization process, $6.59\times10^{-4}$ moles of 1-(3-acetamidophenyl)- 5-mercaptotetrazole was added followed by an aqueous solution containing $1.78\times10^{-4}$ moles of compound S, $2.05\times10^{-8}$ moles of $K_2IrCl_6$ and 0.011 moles of emulsion 2. After the emulsion had been cooled to 40° C., a mixture of red spectral sensitizing dyes was added to complete the sensitization process. The mixture was comprised of $1.81\times10^{-4}$ moles of dye C and $1.66\times10^{-5}$ moles of dye D.

Emulsion 39:

To one mole of a pure silver chloride cubic emulsion having an edge length of 0.62μ which had been precipitated using conventional double jet techniques and contains $3.56\times10^{-8}$ moles of $Cs_2OsNOCl_5$, a colloidal suspension of gold sulfide as a chemical sensitizer in the amount of 46.1 mg per Ag-M. The emulsion temperature was then raised to 65° C. to effect sensitization. During the sensitization process, $6.59\times10^{-4}$ moles of 1-(3-acetamidophenyl)- 5-mercaptotetrazole was added followed by an aqueous solution containing $1.78\times10^{-4}$ moles of compound S, $2.05\times10^{-8}$ moles of $K_2IrCl_6$ and 0.011 moles of emulsion 2. After the emulsion had been cooled to 40° C., a mixture of red spectral sensitizing dyes was added to complete the sensitization process. The mixture was comprised of $1.81\times10^{-4}$ moles of dye C and $1.66\times10^{-5}$ moles of dye D.

Emulsions 40, 41,42:

Chemical and blue spectral sensitization

Emulsion 1i, 1j, and 1k were chemically and spectrally sensitized in an identical manner, resulting in emulsions 40, 41, and 42.

A colloidal suspension of gold sulfide as a chemical sensitizer in the amount of 5.0 mg per Ag-M was added to each emulsion with stirring. The emulsion temperature was raised to 60° C. effecting chemical sensitization. During the sensitization process, $2.62\times10^{-4}$ moles of sensitizing dye A and $2.88\times10^{-4}$ moles of 1-(3-acetamidophenyl)-5-mercaptotetrazole were added during chemical ripening.

Emulsion 45:

Emulsion 1n was prepared in a manner identical to that of Emulsion A described by Brust, et al in U.S. Pat. No. 5,314,798. This tabular chloride emulsion has an ECD of 1.6μ and a mean grain thickness of 0.125μ.

Emulsion 45a:

Emulsion 1o was prepared in a manner identical to that of emulsion 1n except that an aqueous solution of $Cs_2OsNOCl_5$ was simultaneously added to the grain in a uniform fashion during the first 90% of the grain volume. The resultant grain has an ECD of 1.87μ and a thickness of 0.141μ. The concentration of $Cs_2OsNOCl_5$ was $2.64\times10^{-9}$ moles per mole of silver.

Emulsion 46: Chemical and blue spectral sensitization

Emulsion 1o was chemically and spectrally sensitized by adding a colloidal suspension of 0.25 mg of gold sulfide per silver mole, followed by $8.22\times10^{-4}$ moles of spectral sensitizing dye A and 0.4 mole percent of an aqueous potassium bromide solution. The resultant mixture was heated to 60° C. for 40 minutes. After cooling, $1.06\times10^{-4}$ moles of 1-(3-acetamidophenyl)-5-mercaptotetrazole was added to stabilize the emulsion and complete the chemical and spectral sensitization process.

Emulsion 47: Chemical and blue spectral sensitization

To one mole of a pure silver chloride cubic emulsion having an edge length of 0.78μ which had been precipitated using conventional double jet techniques and contains $3.62\times10^{-9}$ moles of $Cs_2OsNOCl_5$ and 0.3 mole percent of potassium iodide added rapidly at 93% of the grain volume, was added a colloidal suspension of gold sulfide as a chemical sensitizer in the amount of 5.0 mg per silver mole. The emulsion temperature was then raised to 60° C. to effect sensitization. During the sensitization process, $2.10\times10^{-4}$ moles of blue spectral sensitizing dye A was added followed by $3.59\times10^{-4}$ moles of 1-(3-acetamidophenyl)-5-mercaptotetrazole.

Single Layer Coating Evaluation Format:

The emulsions described above were first evaluated in a single emulsion 1layer coating format using conventional coating preparation methods and techniques. This coating format is described below in detail:

TABLE 1

Single Layer Coating Format

| Layer | Coating Material | Coverage mg/m$^2$ |
|---|---|---|
| Overcoat | Gelatin | 1064 |
| | Gel hardener | 105 |
| Emulsion/Coupler | Emulsion(s) | varies with color |
| | Coupler | varies with color |
| | Gelatin | 1596 |
| Sub-layer | Gelatin | 3192 |
| Resin coated paper support | | |

Coating Example 1

Emulsions 6 and 7 were blended in a 0.588/1.000 molar ratio and coated in the format described above, using 380 mg/m$^2$ of silver and 1064 mg/m$^2$ of yellow dye forming coupler Y-1. Coupler Y-1 was first dispersed in a permanent coupler solvent (dibutyl phthlate) using conventional dispersing techniques. This constituted coating Y-1.

Coating Example 2

Emulsions 8 and 9 were blended in a 0.929/1.000 molar ratio and coated in the format described above, using 380 mg/m$^2$ of silver and 426 mg/m$^2$ of magenta dye forming coupler M-1. Coupler M-1 was first dispersed in a permanent coupler solvent (dibutyl phthlate) using conventional dispersing techniques. This constituted coating M-1.

Coating Example 3

Emulsions 10 and 11 were blended in a 0.75/1.000 molar ratio and coated in the format described above, using 190 mg/m$^2$ of silver and 426 mg/m$^2$ of cyan dye forming coupler C-3. Coupler C-3 was first dispersed in a permanent coupler solvent (dibutyl phthlate) using conventional dispersing techniques. This constituted coating C-1.

Coating Example 4

Emulsions 12 and 13 were blended in a 1.0/1.0 molar ratio and coated in the format described above, using 181 mg/m$^2$ of silver and 426 mg/m$^2$ of cyan dye forming coupler C-3. Coupler C-3 was first dispersed in a permanent coupler solvent (dibutyl phthlate) using conventional dispersing techniques. This constituted coating C-2.

Coating Example 5

Emulsions 14 and 15 were blended in a 1.0/1.0 molar ratio and coated in the format described above, using 280 mg/m$^2$ of silver and 426 mg/m$^2$ of magenta dye forming coupler M-1. Coupler M-1 was first dispersed in a permanent coupler solvent (dibutyl phthlate) using conventional dispersing techniques. This constituted coating M-2.

Coating Example 6

Emulsions 16 and 17 were blended in a 1.0/1.0 molar ratio and coated in the format described above, using 280 mg/m$^2$ of silver and 426 mg/m$^2$ of magenta dye forming coupler M-1. Coupler M-1 was first dispersed in a permanent coupler solvent (dibutyl phthlate) using conventional dispersing techniques. This constituted coating M-3.

Coating Example 7

Emulsions 18 and 19 were blended in a 1.0/1.0 molar ratio and coated in the format described above, using 280 mg/m$^2$ of silver and 426 mg/m$^2$ of magenta dye forming coupler M-1. Coupler M-1 was first dispersed in a permanent coupler solvent (dibutyl phthlate) using conventional dispersing techniques. This constituted coating M-4.

Coating Example 8

Emulsions 21 and 22 were blended in a 0.42/0.57 molar ratio and coated in the format described above, using 280 mg/m$^2$ of silver and 426 mg/m$^2$ of magenta dye forming coupler B. Coupler B was first dispersed in a permanent coupler solvent (dibutyl phthlate) using conventional dispersing techniques. This constituted coating M-5.

Coating Example 8a

Emulsions 25 and 26 were blended in a 0.58/0.42 molar ratio and coated in the format described above, using 233 mg/m$^2$ of silver and 1076 mg/m$^2$ of yellow dye forming coupler Y-1. Coupler Y-1 was first dispersed in a permanent coupler solvent (dibutyl phthlate) using conventional dispersing techniques. This constituted coating Y-2.

Single Layer Coating Example 8b

Emulsions 46 and 47 were blended in a 0.50:0.50 molar ratio and coated in the format described above, using 233 mg/M$^2$ of silver and 1076 mg/M$^2$ of yellow dye forming coupler Y-1.

Multilayer Coating Evaluation Format:

The emulsions described above were also evaluated in various multilayer coating formats using conventional coating preparation methods and techniques. These coating formats are described below in more detail:

Example 9

A multilayer color paper example was formulated using the emulsions described in the examples in a conventional color paper format using the structure illustrated in Table 2.

Example 10

A multilayer color paper example was formulated using the emulsions described in the examples in a conventional color paper layer order except that the emulsions of like spectral sensitivity are coated in adjacent layers. The structure of this multilayer example is illustrated in Table 3.

Example 11

An example of a trichromatic image reproduction system exhibiting the preferred tone reproduction of the invention was prepared using a conventional silver halide negative film and the sample multilayer silver halide negative paper described in Table 4.

Multilayer Coating Example 12

An example of a trichromatic image reproduction system exhibiting the preferred tone reproduction of the invention was prepared using a conventional silver halide negative film and the sample multilayer silver halide negative color paper described in Table 15. This example illustrates the use of three, like sensitized silver halide emulsions per color record.

TABLE 2

Conventional Layer Order Multilayer Coating Format

| Layer | Coating Material | Coverage mg/m$^2$ |
|---|---|---|
| Overcoat | Gelatin | 1064 |
| | Gel hardener | 162 |
| UV-light | Gelatin | 1064 |
| Absorbing layer | UV-absorber 2 | 362 |
| | UV-absorber 1 | 64 |
| | Oxidized developer scavenger ST-4 | 85 |
| Red sensitive | Emulsion 12 | 95 |
| Emulsion layer | Emulsion 13 | 95 |
| | Cyan Coupler C-3 | 426 |
| | Solvent 1 | 234 |
| | Gelatin | 1596 |
| UV-light | Gelatin | 1064 |
| Absorbing layer | UV-absorber 2 | 362 |
| | UV-absorber 1 | 64 |
| | Oxidized developer scavenger ST-4 | 85 |
| Green sensitive | Emulsion 14 | 138 |
| Emulsion layer | Emulsion 15 | 138 |
| | Magenta Coupler M-1 | 426 |
| | Stabilizer ST-2 | 183 |
| | Stabilizer ST-4 | 43 |
| | Solvent 1 | 213 |
| | Gelatin | 1596 |

TABLE 2-continued

Conventional Layer Order Multilayer Coating Format

| Layer | Coating Material | Coverage mg/m$^2$ |
|---|---|---|
| Interlayer | Gelatin | 1076 |
| | Oxidized developer scavenger ST-4 | 106 |
| Blue sensitive Emulsion layer | Emulsion 6 | 141 |
| | Emulsion 7 | 239 |
| | Yellow Coupler Y-1 | 1064 |
| | Solvent 1 | 266 |
| | Gelatin | 1596 |
| Resin coated paper support | | |

TABLE 3

Conventional Split-Layer Multilayer Coating Format

| Layer | Coating Material | Coverage mg/m$^2$ |
|---|---|---|
| Overcoat | Gelatin | 1064 |
| | Gel hardener | 185 |
| UV-light Absorbing layer | Gelatin | 1064 |
| | UV-absorber 2 | 362 |
| | UV-absorber 1 | 64 |
| | Oxidized developer scavenger ST-4 | 85 |
| First Red sensitive Emulsion layer | Emulsion 12 | 95 |
| | Cyan coupler C-3 | 213 |
| | Solvent 1 | 117 |
| | Gelatin | 1064 |
| Second Red sensitive Emulsion layer | Emulsion 13 | 95 |
| | Cyan Coupler C-3 | 213 |
| | Solvent 1 | 117 |
| | Gelatin | 1064 |
| UV-light Absorbing layer | Gelatin | 1064 |
| | UV-absorber 2 | 362 |
| | UV-absorber 1 | 64 |
| | Oxidized developer scavenger ST-4 | 85 |
| First Green sensitive Emulsion layer | Emulsion 14 | 138 |
| | Magenta Coupler M-1 | 213 |
| | Stabilizer ST-2 | 91 |
| | Stabilizer ST-4 | 21 |
| | Solvent 1 | 50 |
| | Gelatin | 1064 |
| Second Green sensitive Emulsion layer | Emulsion 15 | 138 |
| | Magenta Coupler M-1 | 213 |
| | Stabilizer ST-2 | 91 |
| | Stabilizer ST-4 | 21 |
| | Solvent 1 | 50 |
| | Gelatin | 1064 |
| Interlayer | Gelatin | 745 |
| | Oxidized developer scavenger ST-4 | 106 |
| First Blue sensitive Emulsion layer | Emulsion 6 | 141 |
| | Yellow Coupler Y-1 | 395 |
| | Solvent 1 | 99 |
| | Gelatin | 1064 |
| Second Blue sensitive Emulsion layer | Emulsion 7 | 239 |
| | Yellow Coupler Y-1 | 669 |
| | Solvent 1 | 167 |
| | Gelatin | 1064 |
| Resin coated paper support | | |

TABLE 4

Inverted Layer Order Multilayer Coating Format

| Layer | Coating Material | Coverage mg/m$^2$ |
|---|---|---|
| Overcoat | Gelatin | 1064 |
| | Gel hardener | 200 |
| Blue sensitive | Emulsion 6 | 141 |

TABLE 4-continued

Inverted Layer Order Multilayer Coating Format

| Layer | Coating Material | Coverage mg/m$^2$ |
|---|---|---|
| Emulsion layer | Emulsion 7 | 239 |
| | Yellow Coupler Y-1 | 1064 |
| | Solvent 1 | 266 |
| | Gelatin | 1596 |
| Blue light Absorbing layer | Gelatin | 1064 |
| | Yellow colored colloidal silver | 266 |
| | Oxidized developer scavenger ST-4 | 96 |
| Green sensitive Emulsion layer | Emulsion 8 | 183 |
| | Emulsion 9 | 197 |
| | Magenta Coupler M-1 | 426 |
| | Stabilizer ST-2 | 182 |
| | Stabilizer ST-4 | 43 |
| | Solvent 1 | 213 |
| | Gelatin | 1596 |
| Interlayer | Gelatin | 1076 |
| | Oxidized developer scavenger ST-4 | 96 |
| Red sensitive Emulsion layer | Emulsion 12 | 81 |
| | Emulsion 13 | 109 |
| | Cyan Coupler C-3 | 426 |
| | Solvent 1 | 234 |
| | Gelatin | 1596 |
| Sub-layer | Gelatin | 3192 |
| Resin coated paper support | | |

TABLE 15

Split-Layer Multilayer Coating Format

| Layer | Coating Material | Coverage mg/M$^2$ |
|---|---|---|
| Overcoat | Gelatin | 1064. |
| | Coating aids | |
| | Gel hardener | 185. |
| | Intergrain absorber dyes | |
| UV-light Absorbing layer | Gelatin | 1064. |
| | UV-absorber 2 | 362. |
| | UV-absorber 1 | 64. |
| | Oxidized developer scavenger ST4 | 85. |
| Red sensitive Emulsion layer | Emulsion 37 | 44.6 |
| | Emulsion 38 | 22.3 |
| | Emulsion 39 | 27.6 |
| | Emulsion Stabilizer ST5 | 1.14 |
| | Cyan coupler C3 | 213. |
| | Solvent 1 | 117. |
| | Gelatin | 1064. |
| UV-light Absorbing layer | Gelatin | 1064. |
| | UV-absorber 2 | 362. |
| | UV-absorber 1 | 64. |
| | Oxidized developer scavenger ST4 | 85. |
| Green sensitive Emulsion layer | Emulsion 34 | 55.2 |
| | Emulsion 35 | 27.6 |
| | Emulsion 36 | 55.2 |
| | Magenta Coupler M1 | 213. |
| | Stabilizer ST2 | 91. |
| | Stabilizer ST4 | 21. |
| | Solvent 1 | 50. |
| | Gelatin | 1064. |
| Interlayer | Gelatin | 745. |
| | Oxidized developer scavenger ST4 | 106. |
| Yellow Dye Forming layer | Yellow Coupler Y1 | 395. |
| | Solvent 1 | 99. |
| | Gelatin | 1064. |
| Blue sensitive Emulsion layer | Emulsion 31 | 89.6 |
| | Emulsion 32 | 59.7 |
| | Emulsion 33 | 88.4 |
| | Yellow Coupler Y1 | 669. |

TABLE 15-continued

| Split-Layer Multilayer Coating Format | | |
|---|---|---|
| Layer | Coating Material | Coverage mg/M$^2$ |
| | Solvent 1 | 167. |
| | Gelatin | 1064. |
| Resin coated paper support such as disclosed in U.S. Pat. No. 4,917,994 | | |

Once the coated paper samples described above had been prepared, they were evaluated as follows:

The respective single layer color paper samples were exposed to light in a Kodak Model 1B sensitometer with a color temperature of 3000 K. which was filtered with a combination of a Kodak Wratten™ 2C plus a Kodak Color Compensating™ filter of 85 cc magenta plus a Kodak Color Compensating™ filter of 130 cc yellow. Exposure time was adjusted to 0.1 seconds. The exposures were performed by contacting the paper samples with a neutral stepped exposure tablet having an exposure range of 0 to 3 log-E.

The respective multilayer color paper samples were exposed in a Kodak Model 1B sensitometer with a color temperature of 3000 K. and filtered with a Kodak Wratten™ 2C plus a Kodak Wratten™ 98 filter to obtain the characteristic response of the blue record or a Kodak Wratten™ 99 to obtain the characteristic response of the green record or a Kodak Wratten™ 70 filter to obtain the characteristic response of the red record. Exposure time was adjusted to 0.1 seconds. The exposures were performed by contacting the paper samples with a neutral density step exposure tablet having an exposure range of 0 to 3 log-E.

The paper samples described above as coating examples 1 to 11 were processed in the Kodak Ektacolor RA-4 Color Development™ process. The color developer and bleach-fix formulations are described below in Tables 5 and 6. The chemical development process cycle is described in Table 7.

Example 11 represents a multilayer color paper format unique in that the order of the light sensitive emulsions is inverted as compared to the conventional emulsion 1layer order. While it is generally desirable to place the blue light sensitive emulsion 1layer next to the resin coated paper support with the green and red light sensitive placed above it, this format in combination with the unique false-sensitized emulsions can also be prepared. Using this format with the false-spectrally sensitized emulsions, requires the inclusion of a blue light absorbing filter layer to reduce or eliminate blue light from exposing the green and red light sensitive emulsions placed below it. It is common where blue light filters are required in other color negative systems to employ the use of a yellow filter dye or a fine particle silver dispersion such as Carey Lea silver. The presence of a fine particle silver dispersion in the multilayer coating requires a more potent bleach be used in the post process step in which the developed silver is bleached with oxidant before fixing and washing the fixed silver out of the film. For this reason the alternate chemical development and processing cycle were developed to facilitate removal of the extra silver. The modified chemical development and process cycle is shown in Table 8. The chemical developer used is the same as in the Table 5. The composition of the stop bath, bleach and fix solutions is given in Tables 11, 9 and 10.

After processing, the Status A reflection densities of each sample were measured.

Figure 6:
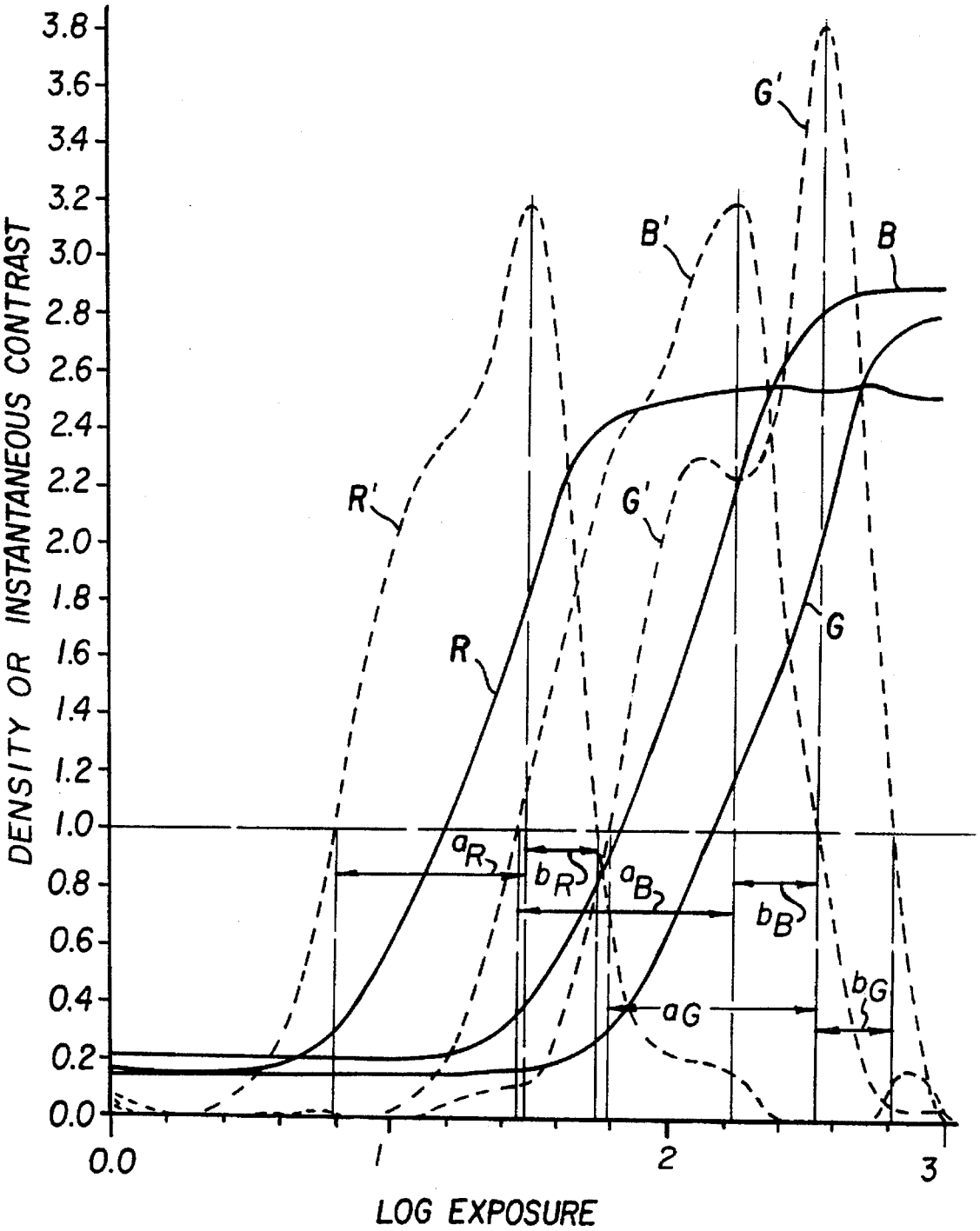
FIG. 6 shows the characteristic red, green and blue curves from coating Example 11 (solid line) and the calculated dD/dlog-E curves (shown as dashed lines).
Figure 7:
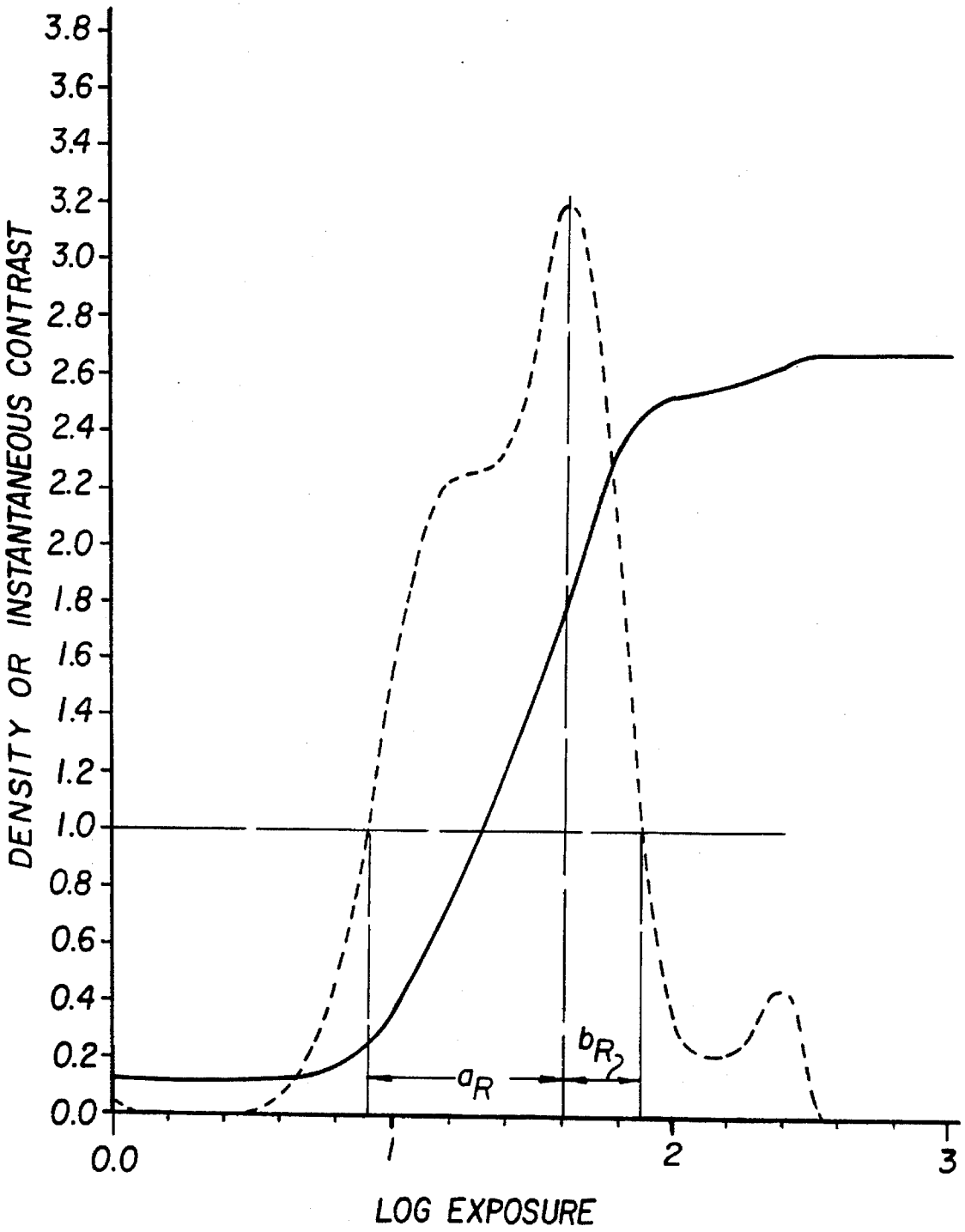
FIG. 7 shows the characteristic red curve from coating Example 4 (solid line) and the calculated dD/dlog-E curve (shown as dashed lines).
Figure 8:
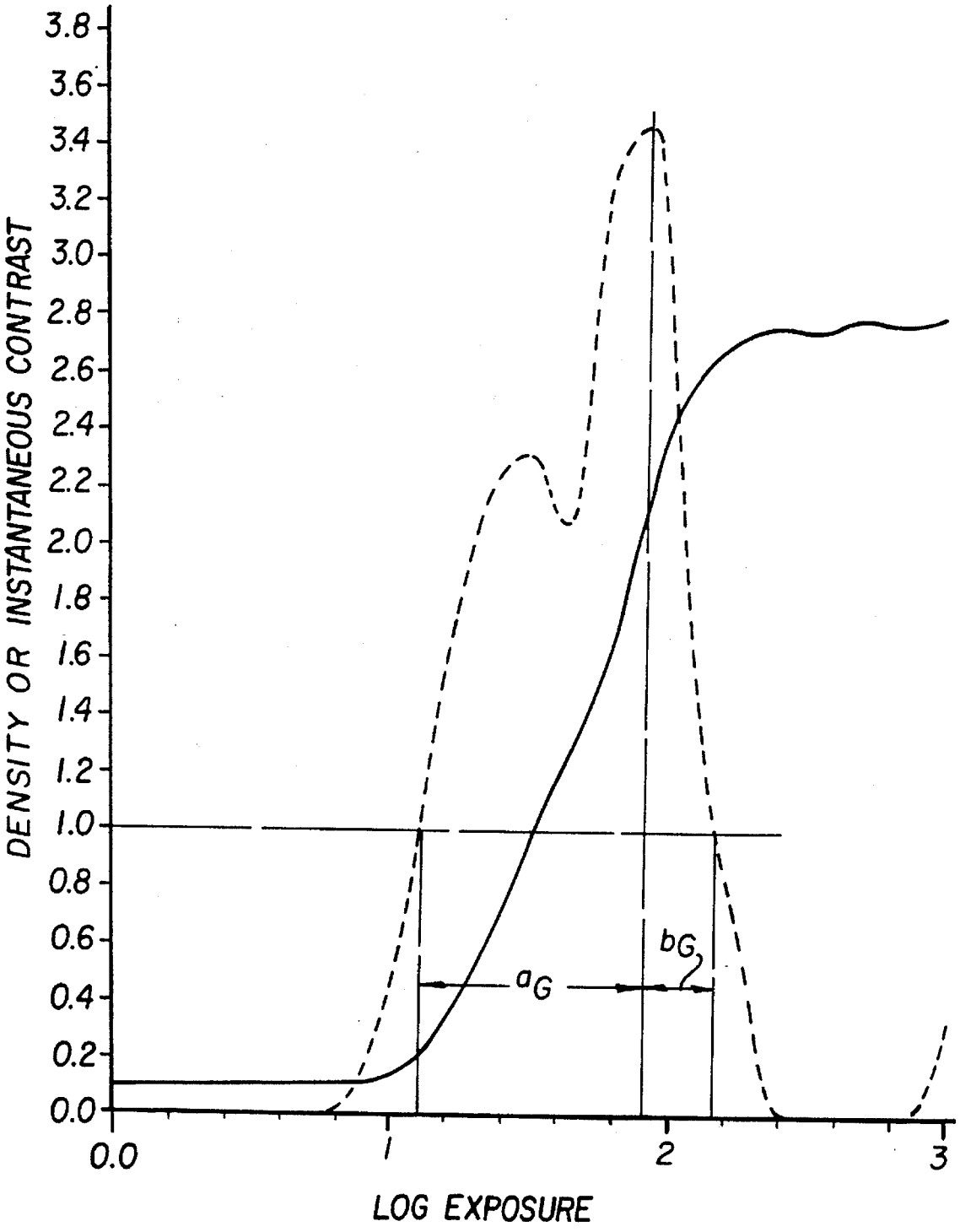
FIG. 8 shows the characteristic green curve from coating Example 7 (solid line) and the calculated dD/dlog-E curve (shown as dashed lines).

FIGS. 3, 4, 5, 7 and 8 show the density vs. log-E relationships (solid line) for coating examples 1, 2, 3, 4 and 7. Additionally the instantaneous contrasts for each D vs. log-E curve are given (dashed line). FIG. 6 gives the results from the multilayer coating example described in coating example 11. In each of the examples described, the instantaneous contrasts are shown for each color record.

In each of the D vs. log-E plots for each sample are plotted the dD/dlog-E or instantaneous contrast plots. On each of the instantaneous contrast curves a baseline corresponding to an instantaneous contrast of 1.0 has been placed. Two additional marks have been made on each example instantaneous contrast curve. The first marks the log-E exposure where the instantaneous contrast reaches a value of 1.0 and the second mark is placed on the instantaneous contrast curve where the slope of the instantaneous contrast becomes zero or generally, increasingly negative. (Note that due to the computer algorithms used to plot the instantaneous contrast curves, some minor negative inflections may be unavoidable and do not represent the general trend of progressively increasing contrast.)

The difference between the two points placed on the log-E axis represents, the exposure range of the characteristic curve in which the instantaneous contrast is progressively increasing as exposure increases. The greater the separation between the two points the greater, it is understood, will be the improvement in reproduced detail in the higher density portion of the D vs. log-E curve and hence result in improved shadow detail.

Table 12 summarizes the log exposure ranges for each of the two commercially available color papers and for the coating examples as a function their respective color.

As can be seen from the log exposure ranges in Table 12, all of the inventive examples have log exposure ranges ($a_R$, $a_G$ and $a_B$) in which the instantaneous contrasts are increasing as exposure increases which are significantly larger than two commercially available color negative papers. This additional exposure range translates directly into increased upper scale latitude and hence shadow detail.

The terms $a_R$, $a_G$ and $a_B$, are defined as the log exposure range between the points where the instantaneous contrast initially reaches a value of 1.0 and the maximum value of the instantaneous contrast.

Additionally, it is important that the instantaneous contrast also be increasing over a substantial portion of the exposure range. It is convenient to quantify this range by measuring the log exposure between the points where the instantaneous contrast initially reaches a value of 1.0 and the point at increased exposure where it falls below the value of 1.0. Since it is difficult to see detail when contrast is less than 1.0, this value seems adequate to define the relevant exposure range. Since the terms $a_R$, $a_G$ and $a_B$ have been defined above as the exposure range between the initial instantaneous contrast of 1.0 and the maximum instantaneous contrast, the terms $f_R$, $f_G$ and $f_B$ can be defined as the fraction of the entire exposure range where contrast is increasing divided by the total exposure range which is the sum of the fractional parts. Thus:

$$\% f = a/(a+b) \times 100$$

It is important that f be as close to 100 percent as possible. Our studies have shown however that physical limitations prohibit reaching 100 percent, and thus it is important to attain as great an 'a' value as possible. The 'f' values shown in Table 12 for the inventive papers are clearly larger than the commercially available papers. Unbiased, independent judges who have viewed the pictures resulting from multi-layer coatings in which the f-values are greater than 70 percent and in which the a-values are greater than 0.6 log E find the pictures more pleasing as there is especially more detail in shadow areas and saturated colors of the color print.

TABLE 12

Fractional and log E Ranges of Increasing Instantaneous Contrast as a Function of Color Negative Paper and Color

| | | Color | | | | | |
|---|---|---|---|---|---|---|---|
| | | Red | | Green | | Blue | |
| | Color Negative Paper | % F | a log E | % F | a log E | % F | a log E |
| Comparison | Kodak Ektacolor Supra ™ | 62 | 0.57 | 48 | 0.44 | 58 | 0.50 |
| Comparison | Fuji SFA 3 Type C ™ | 65 | 0.55 | 56 | 0.56 | 65 | 0.58 |
| Invention | Coating Example 1 | | | | | 70 | 0.75 |
| Invention | Coating Example 2 | | | 75 | 0.77 | | |
| Invention | Coating Example 3 | 77 | 0.74 | | | | |
| Invention | Coating Example 11 | 76 | 0.71 | 74 | 0.75 | 74 | 0.81 |
| Invention | Coating Example 4 | 74 | 0.73 | | | | |
| Invention | Coating Example 7 | | | 79 | 0.83 | | |
| Invention | Coating Example 8b | | | | | 67 | 0.75 |
| Invention | Coating Example 12 | 80 | 0.71 | 77 | 0.74 | 69 | 0.66 |

TABLE 13

Fractional Percentage and log E Ranges of Increasing Instantaneous Contrast as a Function of Emulsion Combination and Coupler

| Coupler | Example | Emulsion 1 | Ag mg/M$^2$ | Emulsion 2 | Ag mg/M$^2$ | a (log E) | % F |
|---|---|---|---|---|---|---|---|
| M1 | Comparison | 29 | 280. | none | 0. | 0.48 | 49 |
| M1 | Invention | 1e | 56. | 1f | 186. | 0.78 | 70 |
| M2 | Invention | 1e | 86. | 1f | 119. | 0.83 | 75 |
| M10 | Invention | 1e | 42. | 1f | 97. | 0.72 | 69 |
| M11 | Invention | 1e | 42. | 1f | 97. | 0.80 | 81 |
| M4 | Invention | 1e | 68. | 1f | 103. | 0.83 | 76 |
| M3 | Invention | 1e | 68. | 1f | 103. | 0.80 | 71 |
| M7 | Invention | 1e | 65. | 1f | 97. | 0.63 | 65 |
| M9 | Invention | 1e | 59. | 1f | 59. | 0.84 | 84 |
| M13 | Invention | 1e | 65. | 1f | 97. | 0.63 | 65 |
| Y1 | Comparison | 30 | 280. | none | 0. | 0.56 | 61 |
| Y1 | Invention | 6 | 140. | 7 | 238. | 0.74 | 70 |
| Y3 | Invention | 42 | 140. | 27 | 140. | 0.93 | 81 |
| Y14 | Invention | 42 | 140. | 27 | 140. | 0.93 | 81 |
| Y11 | Invention | 6 | 140. | 7 | 238. | 0.71 | 71 |
| C3 | Comparison | 28 | 194. | none | 0. | 0.47 | 54 |
| C3 | Invention | 12 | 97. | 13 | 97. | 0.68 | 73 |
| C22 | Invention | 12 | 97. | 13 | 97. | 0.69 | 70 |

The data in this table show that the invention is not limited to a specific class of dye forming couplers. The inventive examples illustrate that the tone scale metrics 'a' and '% F' can be achieved by properly choosing the emulsion or combination or emulsions required to achieve the desired tone scale reproduction and that any coupler can be chosen.

TABLE 14

Improving Color Lightness and Saturation with Preferred Emulsion Combinations and Couplers

| Coupler | Example | Emulsion 1 | Ag mg/M$^2$ | Emulsion 2 | Ag mg/M$^2$ | L* | C* |
|---|---|---|---|---|---|---|---|
| M1 | Comparison | 29 | 280. | none | 0. | 50 | 79 |
| M1 | Comparison | 1e | 56. | 1f | 186. | 50 | 79 |
| M2 | Invention | 1e | 86. | 1f | 119. | 50 | 84 |
| M10 | Invention | 1e | 42. | 1f | 97. | 50 | 91 |
| M11 | Invention | 1e | 42. | 1f | 97. | 50 | 94 |

TABLE 14-continued

Improving Color Lightness and Saturation with Preferred Emulsion Combinations and Couplers

| Coupler | Example | Emulsion 1 | Ag mg/M² | Emulsion 2 | Ag mg/M² | L* | C* |
|---|---|---|---|---|---|---|---|
| M4 | Invention | 1e | 68. | 1f | 103. | 50 | 84 |
| M3 | Invention | 1e | 68. | 1f | 103. | 50 | 83 |
| M7 | Invention | 13 | 65. | 1f | 97. | 48 | 94 |
| M9 | Invention | 1e | 59. | 1f | 59. | 50 | 94 |
| M13 | Invention | 1e | 65. | 1f | 97. | 50 | 92 |
| Y1 | Comparison | 30 | 280. | none | 0. | 90 | 52 |
| Y1 | Comparison | 6 | 140. | 7 | 238. | 90 | 52 |
| Y11 | Invention | 6 | 140. | 7 | 238. | 90 | 77 |
| C3 | Comparison | 28 | 194. | none | 0. | 65 | 45 |
| C3 | Comparison | 12 | 97. | 13 | 97. | 65 | 45 |
| C22 | Invention | 12 | 97. | 13 | 97. | 65 | 57 |

In the table, L* is defined as lightness and C* is defined as chroma (or color saturation) c.f.: Principles of Color Technology, second edition, by Billmeyer and Saltzman, John Wiley and Sons, 1981,p. 63.

In this table, it is illustrated that certain classes of dye forming couplers are preferred over other classes. Cyan, magenta, and yellow dye forming couplers which yield dyes of higher color saturation or chroma (C*) are preferred over classes of couplers which produce less saturated dyes (i.e.: lower C*). The combination of the preferred cyan, magenta, and yellow coupler classes with emulsions which produce the improved tone scale result in photographs which have colors which are brighter and are more accurately reproduce the original color. This is because the silver halide tone scale produced by the inventive emulsions more accurately reproduces the lightness (L*) and contrast of the original color. And in combination with dye forming couplers which demonstrate higher chroma (C*), at a given lightness, increased color saturation at that lightness level is achieved.

Thus according to the present invention, it is understood that a preferred and excellent tone and color reproduction for reflection color negative papers over a very wide range of densities has become possible.

TABLE 5

The Kodak Ektacolor RA-4 Color Developer:

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 ™ (60%) | 1.16 |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/− 0.05

TABLE 6

The Kodak Ektacolor RA-4 Bleach-Fix consists of:

| Chemical | Grams/Liter |
|---|---|
| Ammonium thiosulfate (56.5%) | 127.40 |
| Sodium metabisulfite | 10.00 |

TABLE 6-continued

The Kodak Ektacolor RA-4 Bleach-Fix consists of:

| Chemical | Grams/Liter |
|---|---|
| Glacial acetic acid | 10.20 |
| Ammonium ferric EDTA (44%) | 110.40 |
| Water | to make 1 liter |

pH @ 26.7° C. is 5.5 +/− 0.10

TABLE 7

Kodak Ektacolor RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

TABLE 8

Modified Color Paper Process

| Process Step | Time (seconds) |
|---|---|
| Color Development | 45 |
| Stop | 30 |
| Bleach | 60 |
| Wash | 30 |
| Fix | 60 |
| Wash | 120 |
| Dry | |

Processing the exposed paper samples is done with the developer and bleach-fix temperatures adjusted to 35° C. Washing is performed with tap water at 32.2° C.

TABLE 9

Bleach Formula for Modified Color Paper Process

| Chemical | Grams/Liter |
|---|---|
| Ammonium bromide | 150.0 |
| Ammonium ferric EDTA (1.56M, pH 7.05 44%) (contains 10% molar excess EDTA, | 175.0 |

TABLE 9-continued

| Bleach Formula for Modified Color Paper Process | |
|---|---|
| Chemical | Grams/Liter |
| 3.5%) | |
| Glacial acetic acid | 9.5 |
| Sodium nitrate | 35.0 |
| Water to make 1.0 liter | |

The pH of the bleach at 26.7° C. is adjusted to 6.00±0.05 with either ammonium hydroxide or nitric acid.

TABLE 10

| Fix Formula for Modified Color Paper Process | |
|---|---|
| Chemical | Grams/Liter |
| Ammonium thiosulfate (56.5% ammonium thiosulfate, 4% ammonium sulfite) | 162.0 |
| Sodium metabisulfite | 11.85 |
| Sodium hydroxide (50% solution) | 2.0 |
| Water to make 1.0 liter | |

The pH of the fix at 26.7° C. is 6.5±0.15

TABLE 11

| Stop Bath Formula for Modified Color Paper Process | |
|---|---|
| Chemical | Grams/Liter |
| Glacial acetic acid | 100.0 |
| Water to make 1.0 liter | |

An example of a trichromatic image reproduction system exhibiting the preferred tone reproduction of the invention was prepared using a conventional silver halide negative film and the sample multilayer silver halide negative color paper described in Table 16. This color paper example illustrates the use of two, like sensitized silver halide emulsions per color record to obtain the desired tone reproduction.

It differs from other examples in that the coated silver halide emulsion amounts are substantially lower than generally used and that this reduction in silver halide requires special chemical development processing using a process called developer-amplification (dev-amp process). Details of the 'dev amp' process are given in Tables 17, 18, and 19.

It is also specifically contemplated that in combination with a 'dev-amp' process, it would be particularly advantageous process elements of this type in low volume, thin tank processors such as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559, 027; U.S. Pat. No. 5,179,404; EP 559025; U.S. Pat. No. 5,270,762; EP 559 026; U.S. Pat. Nos. 5,313,243; and 5,339,131.

TABLE 16

| Color Paper for 'Dev-Amp' Processing | | |
|---|---|---|
| Layer | Coating Material | Coverage mg/M$^2$ |
| Overcoat | Gelatin | 1064. |
| | Coating aids | |
| | Gel hardener | 185. |
| | Intergrain absorber dyes | |
| UV-light Absorbing layer | Gelatin | 1064. |
| | UV-absorber 2 | 362. |
| | UV-absorber 1 | 64. |
| | Oxidized developer scavenger ST4 | 85. |
| Red sensitive Emulsion layer | Emulsion 37 | 11.0 |
| | Emulsion 38 | 5.0 |
| | Emulsion Stabilizer ST5 | 1.14 |
| | Emulsion Stabilizer ST6 | 0.114 |
| | Cyan coupler C3 | 213. |
| | Solvent 1 | 117. |
| | Gelatin | 1064. |
| UV-light Absorbing layer | Gelatin | 1064. |
| | UV-absorber 2 | 362. |
| | UV-absorber 1 | 64. |
| | Oxidized developer scavenger ST4 | 85. |
| Green sensitive Emulsion layer | Emulsion 34 | 12.0 |
| | Emulsion 35 | 6.0 |
| | Magenta Coupler M1 | 213. |
| | Stabilizer ST2 | 91. |
| | Stabilizer ST4 | 21. |
| | Solvent 1 | 50. |
| | Gelatin | 1064. |
| Interlayer | Gelatin | 745. |
| | Oxidized developer scavenger ST4 | 106. |
| Blue sensitive Emulsion layer | Emulsion 31 | 15.0 |
| | Emulsion 32 | 10.0 |
| | Yellow Coupler Y1 | 915. |
| | Solvent 1 | 167. |
| | Gelatin | 1064. |
| Resin coated paper support such as disclosed in U.S. Pat. No. 4,917,994 | | |

TABLE 17

| Process Cycle Description | | |
|---|---|---|
| Solution | Time (seconds) | Temperature °C. |
| Developer | 45. | 32 |
| Fixer | 45. | 32 |
| Water wash | 90. | 32 |

TABLE 18

| Developer and Replenisher Formulas | | | |
|---|---|---|---|
| Component | Developer | Developer Replenisher | Peroxide Replenisher |
| Dequest 2011 ™ | 0.6 g/L | 0.9 g/L | |
| Kodak Antical-8 ™ | 2.0 ml/L | 3.0 ml/L | |
| $K_2HPO_4$:$3H_2O$ | 40.0 g/L | 60.0 g/L | |
| KBr | 1.0 mg/L | 0.0 g/L | |
| KCl | 0.5 g/L | 0.5 g/L | |
| Catechol disulfonate | 0.3 g/L | 0.45 g/L | |
| Hydroxylamine sulfate | 1.0 g/L | 3.45 g/L | |
| KOH (50%) | 10 ml/L | 30 ml/L | |
| Kodak Color Developer #3 | 4.5 g/L | 10.03 g/L | |
| Tween 80 ™ | 0.4 g/L | 0.6 g/L | |

TABLE 18-continued

| Developer and Replenisher Formulas | | | |
|---|---|---|---|
| Component | Developer | Developer Replenisher | Peroxide Replenisher |
| Dodecylamine | 0.1 g/L | 0.15 g/L | |
| $H_2O_2$ (30%) | 2.2 ml/L | 0.0 ml/L | 10.23 ml/L |
| Water to make 1.0 L | | | |
| pH | 11.4 | | |

TABLE 19

| Fixer Formula | |
|---|---|
| Component | Amount |
| Ammonium thiosulfate (56%) | 162.0 ml |

TABLE 19-continued

| Fixer Formula | |
|---|---|
| Component | Amount |
| Sodium metabisulfate | 11.85 g |
| Sodium hydroxide (50%) | 2.00 ml |
| Water | to make 1 L |
| pH 6.5 | |

Dye A

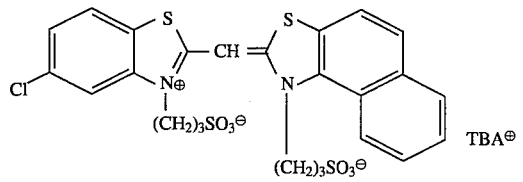

TBA = tetrabutyl ammonium

Dye B

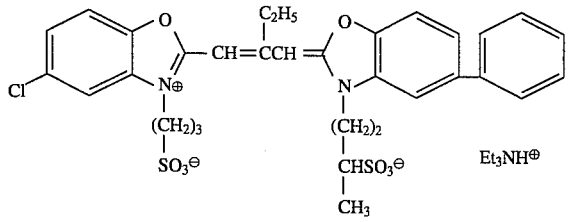

Dye C

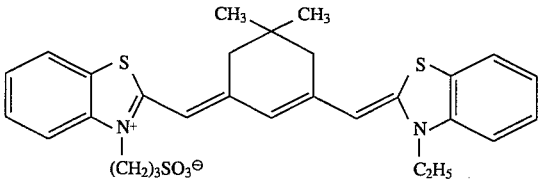

Dye D

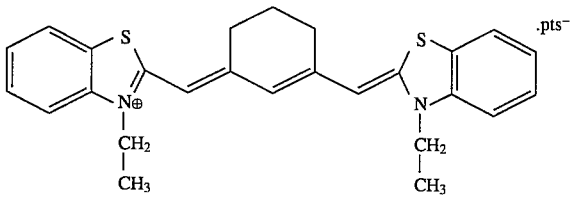

pts = p-toluene sulfonic acid

Compound S

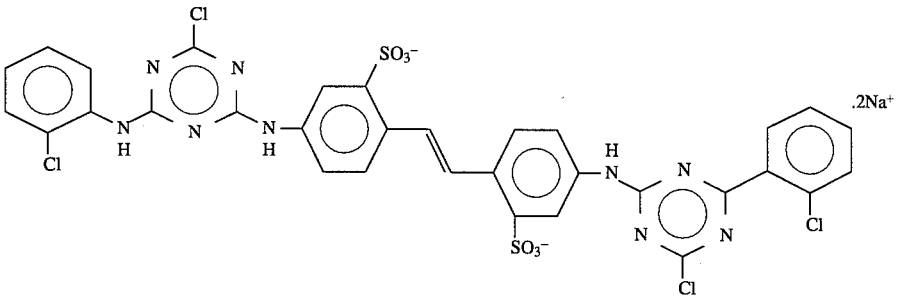

Dye A2

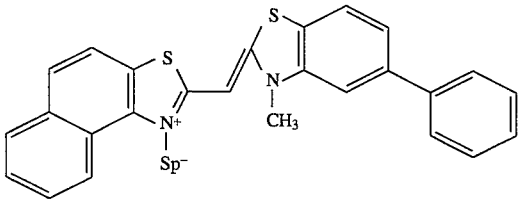

Dye A3

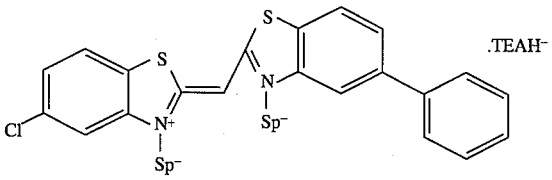

Sp⁻ = sulfo-propyl
TEAH⁻ = triethylammonium

-continued
ST5
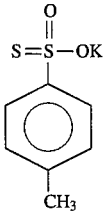
ST6
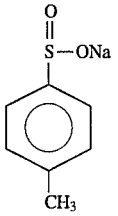
M13
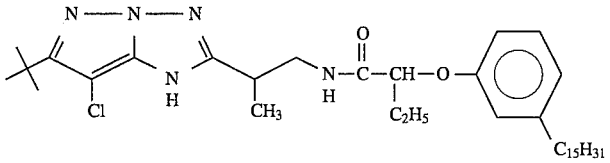
M14
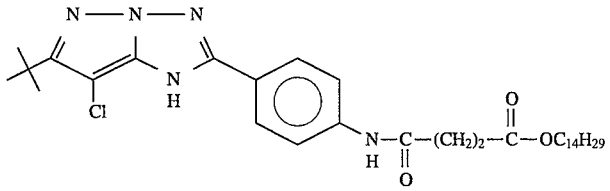
Y11
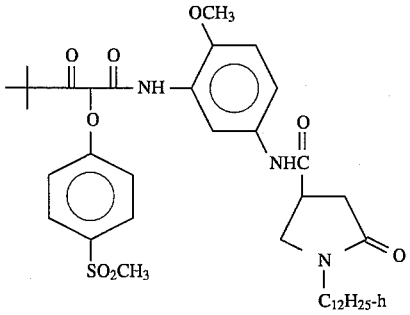
Y12
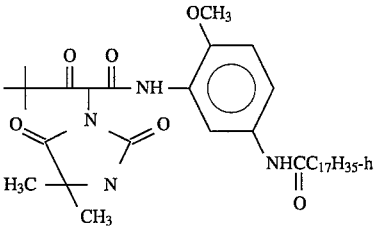
Y13
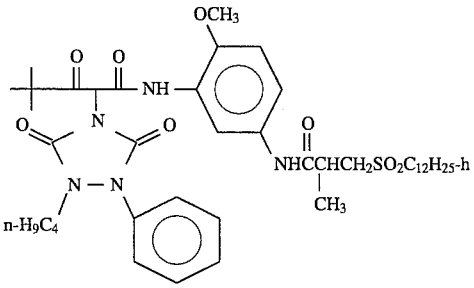
Y14
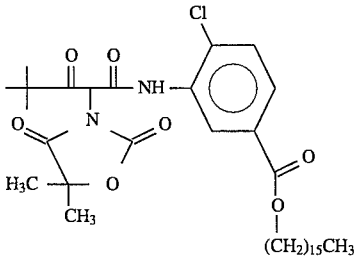

-continued
C22
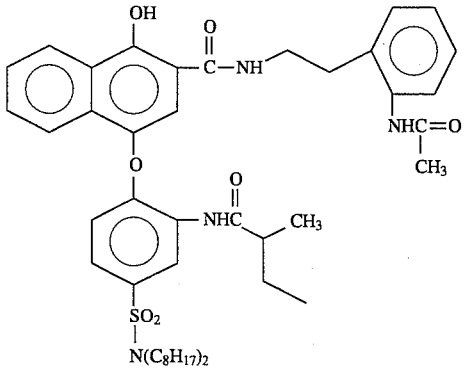
C23
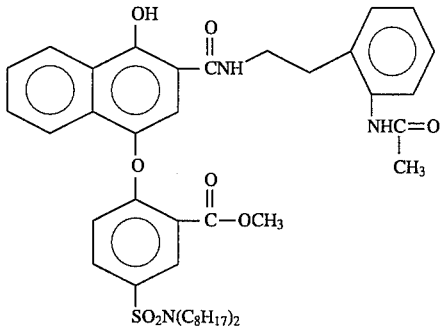
C24
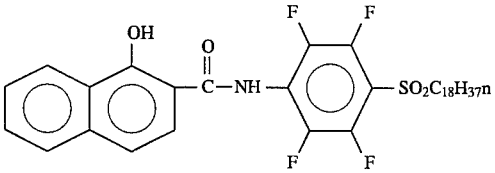
A4
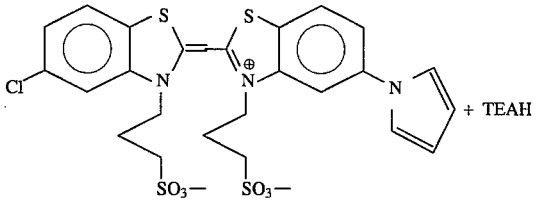
A5
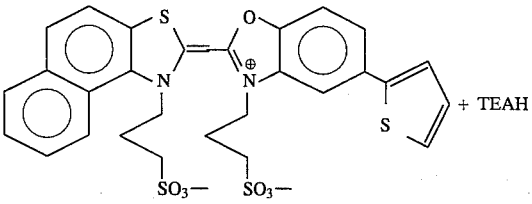
A6
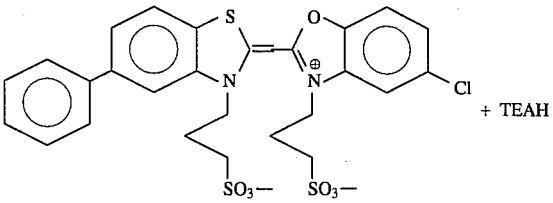
A7
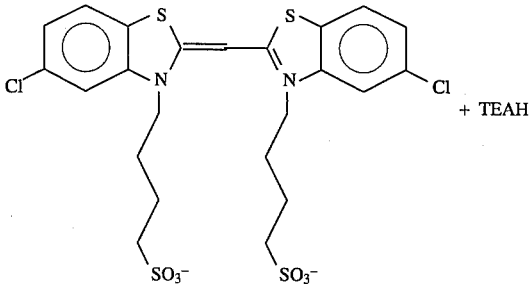
A8
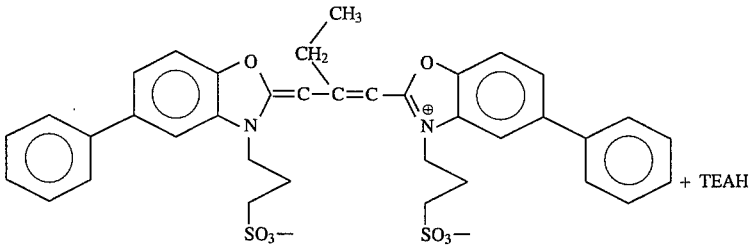

-continued

Antihalation Dyes

A9

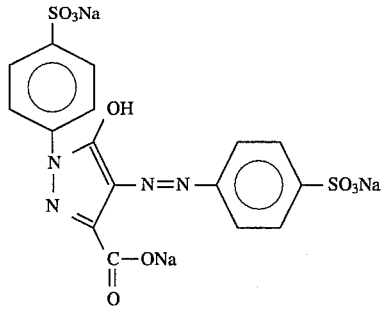

A10

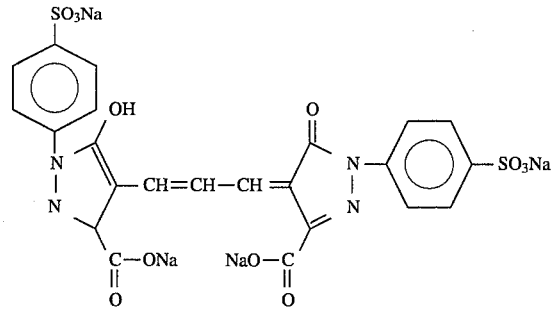

A11

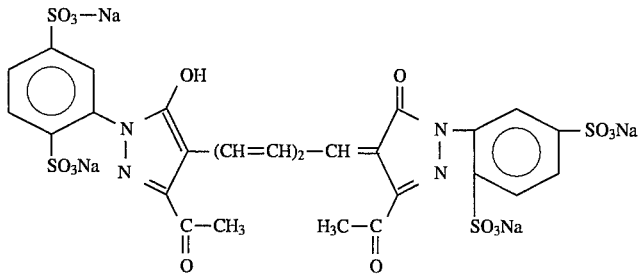

The invention has been described in detail with particular reference to preferred embodiments thereof, but it will be understood that variations and modifications can be effected within the spirit and scope of the invention.

We claim:

1. A method of forming a photographic image comprising providing a multicolor photographic element comprising at least one layer said at least one layer comprising a silver halide emulsion layer containing a cyan dye-forming coupler capable of producing cyan color or a silver halide emulsion layer containing a magenta dye-forming coupler capable of producing a magenta color wherein said at least one layer has an exposure range of at least 0.6 log E from the point where the instantaneous contrast is 1.0 and wherein the instantaneous contrast of said layer increases as a function of increasing exposure over at least 70 percent of said exposure range, exposing said element to actinic radiation to form a latent image, and developing said latent image with a color developing agent to yield a color image.

2. The method of claim 1 wherein said layer containing a cyan dye-forming coupler has an exposure range of at least 0.6 log E from the point where the instantaneous contrast is 1.0 and wherein the instantaneous contrast of said layer increases as a function of increasing exposure over at least 70 percent of said exposure range.

3. The method of claim 2 wherein said cyan color producing layer comprises at least one coupler selected from the group consisting of

CYAN-1

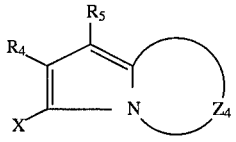

-continued

CYAN-2

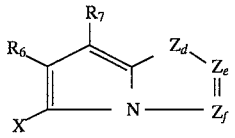

CYAN-3

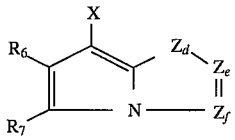

CYAN-4

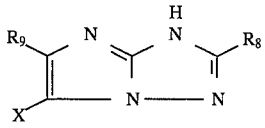

wherein $R_4$ and $R_8$ each represent a hydrogen or a phenyl group; $R_5$ represents a CN; $R_6$ and $R_7$ each represent an electron attractive group having a Hammett's substituent constant $\sigma_{para}$ of 0.2 or more and the sum of the $\sigma_{para}$ values of $R_6$ and $R_7$ is 0.65 or more; $R_9$ represents an electron attractive group having a Hammett's substituent constant $\sigma_{para}$ of 0.35 or more; X represents a hydrogen or a coupling-off group; $Z_4$ represents nonmetallic atoms necessary for forming a nitrogen-containing, six-membered, heterocyclic ring which has at least one dissociative group; $Z_d$ represents —C($R_{10}$)= or —N=; and $Z_e$ and $Z_f$ each represent —C($R_{11}$)= or —N=; $R_{11}$ represents hydrogen and $R_{10}$ represents an electron group having a Hammett's substituent constant $\sigma_{para}$ of 0.2 or more.

4. The method of claim 1 wherein said emulsion layer containing a magenta dye-forming coupler has an exposure range of at least 0.6 log E from the point where the instantaneous contrast is 1.0 and wherein the instantaneous contrast of said layer increases as a function of increasing exposure over at least 70 percent of said exposure range.
5. The method of claim 4 wherein said magenta color producing layer comprises at least one coupler selected from the following group consisting of
M-1
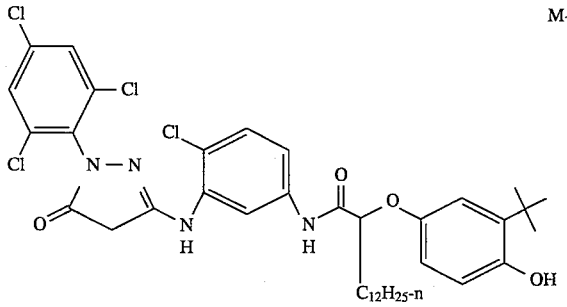
M-2
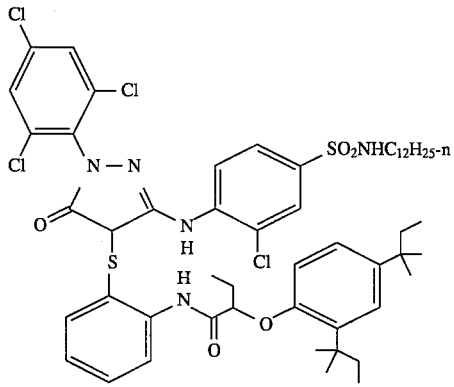
M-3
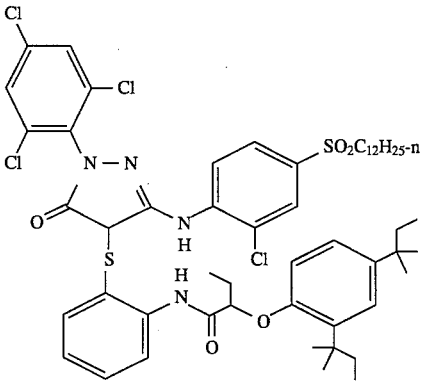
M-4
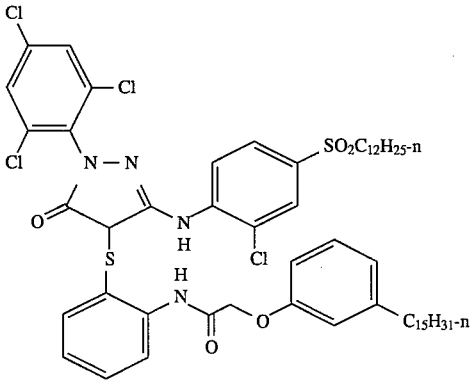
M-5
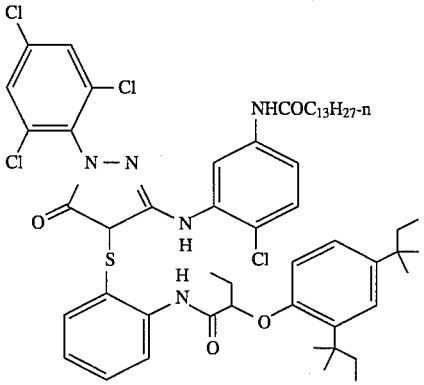
M6
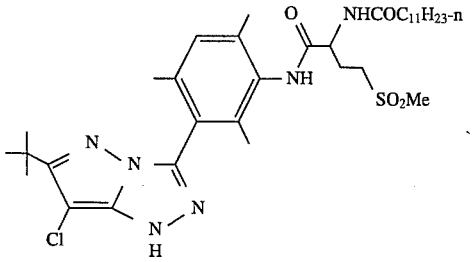
M7
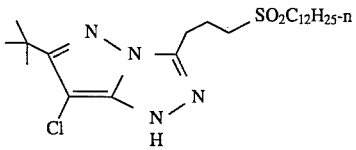
M8
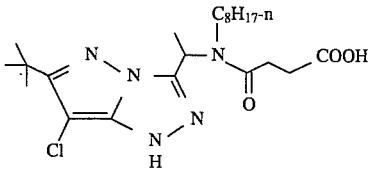

-continued

M-9

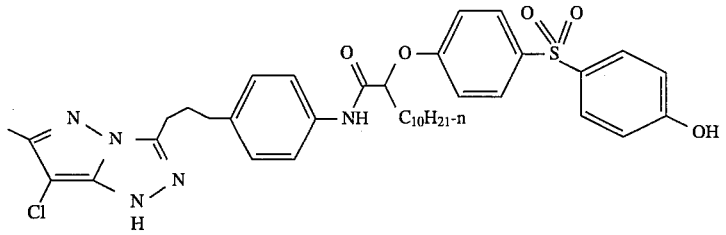

M-10

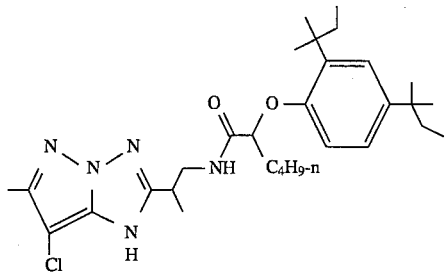

M-11

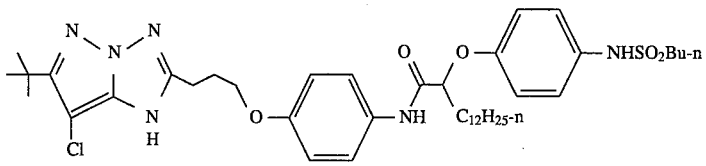

and

M-12

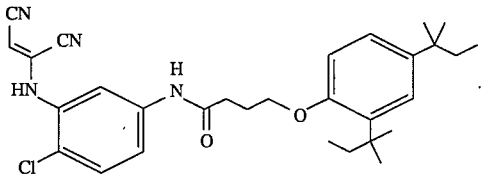

6. The method of claim 4 wherein said magenta color producing layer comprises at least one coupler selected from the group consisting of

MAGENTA-1

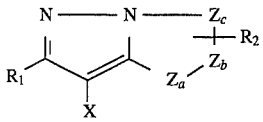

wherein $R_1$ and $R_2$ independently represent H or a substituent; X is hydrogen or a coupling-off group; and $Z_a$, $Z_b$, and $Z_c$ are independently a methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_2$.

7. The method of claim 1 wherein said at least one layer comprises both cyan and magenta dye-forming coupler containing layers that have an exposure range of greater than or equal to 0.6 log E from the point where the instantaneous contrast is 1.0 and wherein the instantaneous contrast of said layers increases as a function of increasing exposure over at least 70 percent of said exposure range.

8. The method of claim 7 wherein said layer comprising a cyan dye-forming coupler producing cyan color comprises a blended emulsion wherein one emulsion has a lower sensitivity to light and has higher contrast than the other emulsion.

9. The method of claim 7 wherein said layer comprising a magenta dye-forming coupler producing magenta color comprises two separate layers having different sensitivities to light.

10. The method of claim 7 wherein said layer comprising a magenta dye-forming coupler producing magenta color comprises a blended emulsion wherein one emulsion of said blended emulsion has less sensitivity to light and has higher contrast than the other emulsion of said blended emulsion.

11. The method of claim 1 wherein said at least one layer comprises cyan, magenta, and yellow dye-forming coupler containing silver halide emulsion layers having an exposure range of at least 0.6 log E from the point where the instantaneous contrast is 1.0 and wherein the instantaneous contrast of said layers increases as a function of increasing exposure over at least 70 percent of said exposure range.

12. The method of claim 11 wherein said yellow color producing layer comprises at least one coupler selected from the group consisting of

YELLOW-1

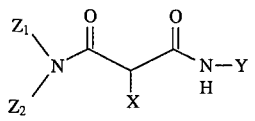

YELLOW-2

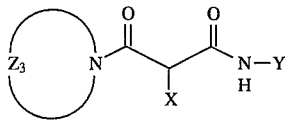

-continued

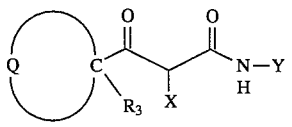

YELLOW-3 wherein $Z_1$ represents a phenyl group and $Z_2$ represents a methyl group, $R_3$ represents an ethyl group; X is hydrogen or a coupling-off group; Y represents an aryl group or a heterocyclic group; $Z_3$ represents an organic residue required to form a nitrogen-containing heterocyclic group together with the >N—; and Q represents nonmetallic atoms necessary to from a 3- to 5-membered hydrocarbon ring or a 3- to 5-membered heterocyclic ring which contains at least one hetero atom selected from N, O, S, and P in the ring.

13. The element of claim 1 wherein said exposure range is at least 0.7 log E.

14. The method of claim 1 wherein the instantaneous contrast of said layer increases in a function of increasing exposure over at least 75 percent of said exposure range.

15. The element of claim 1 having an exposure range of at least 0.75 log E.

16. The element of claim 1 having an exposure range of at least 0.8 log E.

17. The method of claim 1 wherein the instantaneous contrast of said layer increases in a function of increasing exposure over at least 80 percent of said exposure range.

18. The method of claim 1 wherein the emulsion of said at least one silver halide emulsion layer comprises silver halide particles of greater than 90 mole percent chloride.

19. The method of claim 18 wherein said at least one layer comprises silver halide particles of greater than 95 mole percent chloride.

20. The method of claim 1 wherein the instantaneous contrast increase is continuous.

21. The method of claim 1 wherein the instantaneous contrast increase may include a deviation of up to 15 percent from a continuous increase.

22. The method of claim 1 wherein the instantaneous contrast increase may include a deviation of up to 10 percent from a continuous increase.

23. The method of claim 1 wherein the contrast in a higher exposure range of said at least one layer is greater than in the lower exposure range of said layer.

24. The method of claim 1 wherein said layer comprising a cyan dye-forming coupler producing cyan color comprises two separate layers each having different sensitivities to light.

25. The method of claim 1 wherein silver halide particles in at least one silver halide emulsion layer contain iridium.

26. The method of claim 1 wherein silver halide particles in at least one silver halide emulsion layer contain a desensitizing ion or complex.

27. The method of claim 1 wherein said method comprises at least one silver halide emulsion containing a contrast increasing ion or complex.

28. The method of claim 1 wherein said method comprises at least one silver halide emulsion containing a shallow electron trapping ion or complex.

29. The method of claim 1 wherein said method comprises at least one silver halide emulsion containing (1) either a desensitizing or contrast increasing ion or complex and (2) a shallow electron trapping ion or complex.

30. The method of claim 1 wherein said exposing of said element is with a color negative film having a spectral sensitivity in the red region of the visible light spectrum of between 610 nm and 645 nm.

31. The method of claim 1 having a spectral sensitivity in the blue region of the visible light spectrum of between 450 nm and 470 nm.

32. The method of claim 1 further comprising a reflective base.

33. The method of claim 1 wherein silver halide particles in at least one silver halide layer contain an organic dopant or a metal ion complex containing an organic ligand.

34. The method of claim 1 wherein said element comprises at least one silver halide emulsion comprising at least one of Rh, Ru, Fe, and osmium.

* * * * *